US010011927B2

(12) United States Patent
Fukui

(10) Patent No.: US 10,011,927 B2
(45) Date of Patent: Jul. 3, 2018

(54) STITCH-SIZE CONTROLLABLE KNITTING MACHINE, AND MANUFACTURING METHOD OF KNITTED FABRIC

(71) Applicant: OKAMOTO CORPORATION, Kitakatsuragi-gun, Nara (JP)

(72) Inventor: Takao Fukui, Nara (JP)

(73) Assignee: OKAMOTO CORPORATION, Nara (JP)

( * ) Notice: Subject to any disclaimer, the term of this patent is extended or adjusted under 35 U.S.C. 154(b) by 1189 days.

(21) Appl. No.: 13/767,287

(22) Filed: Feb. 14, 2013

(65) Prior Publication Data

US 2013/0205836 A1 Aug. 15, 2013

(30) Foreign Application Priority Data

Feb. 15, 2012 (JP) ..... 2012-031154

(51) Int. Cl.

| | |
|---|---|
| ***D04B 9/46*** | (2006.01) |
| ***D04B 15/06*** | (2006.01) |
| ***D04B 15/78*** | (2006.01) |
| ***D04B 15/34*** | (2006.01) |
| ***D04B 9/02*** | (2006.01) |

(52) U.S. Cl.

CPC ..... *D04B 9/46* (2013.01); *D04B 9/02* (2013.01); *D04B 15/06* (2013.01); *D04B 15/34* (2013.01); *D04B 15/78* (2013.01)

(58) Field of Classification Search

CPC ..... D04B 9/12; D04B 9/025; D04B 1/02

See application file for complete search history.

(56) References Cited

U.S. PATENT DOCUMENTS

| | | | | | |
|---|---|---|---|---|---|
| 2,184,088 | A | * | 12/1939 | Weinberg | 66/93 |
| 2,921,454 | A | | 1/1960 | Shastany | |
| 3,668,902 | A | * | 6/1972 | Sanders | 66/54 |
| 4,103,518 | A | * | 8/1978 | Lombardi et al. | 66/107 |
| 4,589,266 | A | * | 5/1986 | Oakley et al. | 66/12 |
| 4,989,421 | A | * | 2/1991 | Schmidt | 66/9 R |
| 5,167,133 | A | * | 12/1992 | Schmidt | 66/9 R |
| 5,931,025 | A | * | 8/1999 | Lonati et al. | 66/217 |
| 6,105,402 | A | * | 8/2000 | Lee | 66/217 |

(Continued)

FOREIGN PATENT DOCUMENTS

| | | | |
|---|---|---|---|
| EP | 0 757 124 | A1 | 2/1997 |
| EP | 2 412 853 | A1 | 2/2012 |
| JP | 2004-316000 | A | 11/2004 |

OTHER PUBLICATIONS

Official Communication issued in corresponding European Patent Application No. 13155304.2, dated May 27, 2013.

(Continued)

*Primary Examiner* — Megan Lynch
(74) *Attorney, Agent, or Firm* — Keating & Bennett, LLP

(57) ABSTRACT

A circular knitting machine includes sinkers and selector jacks corresponding thereto that are provided as separate components. The selector jacks are arranged radially outside the sinkers, and are provided with selector butts such that the selector butts of circumferentially adjacent selector jacks are arranged at different radial positions. An actuator that acts on the selector butts is arranged radially outside the cylinder. The circular knitting machine prevents a failure of sinker selection, while increasing a rotation speed of a cylinder holding knitting needles.

9 Claims, 48 Drawing Sheets

(56) References Cited

U.S. PATENT DOCUMENTS

| | | | | |
|---|---|---|---|---|
| 2003/0154747 | A1* | 8/2003 | Plath et al. | 66/8 |
| 2005/0081569 | A1* | 4/2005 | Lonati | D04B 9/26 66/104 |
| 2005/0155391 | A1* | 7/2005 | Wang | 66/104 |
| 2009/0249836 | A1* | 10/2009 | Stingel | 66/104 |
| 2013/0205837 | A1* | 8/2013 | Fukui | 66/92 |

OTHER PUBLICATIONS

Official Communication issued in corresponding Chinese Patent Application No. 201310049825.8, dated Mar. 17, 2014.

"Knitting", Long Ruhai, China Textile Press, (Jun. 30, 2008), pp. 117-118.

* cited by examiner

STITCH-SIZE CONTROLLABLE KNITTING MACHINE, AND MANUFACTURING METHOD OF KNITTED FABRIC

BACKGROUND OF THE INVENTION

1. Field of the Invention

The present invention relates to a stitch size controllable knitting machine for forming a knitted fabric by taking in and out sinkers to/from between reciprocating knitting needles, and to a manufacturing method of knitted fabric.

2. Description of the Related Art

A conventional circular knitting machine or hosiery circular knitting machine includes a stitch size controlling sinker, as described in JP 2004-316000A, for example. FIGS. 31A and 31B show an exemplary conventional stitch size controlling sinker and an actuator, respectively. Referring to FIG. 31A, each stitch size controlling sinker 201 has one of a plurality of selector butts 202 to 205 which can be pressed when the corresponding stitch size controlling sinker 201 is selected. In the example of FIG. 31A, four selector butts 202 to 205 are arranged at different levels in a height direction of the knitting machine. That is, the selector butts 202-205 of adjacent stitch size controlling sinkers are arranged at different levels in the height direction.

As shown in FIG. 31B, when a selector head 207 of the actuator 206 comes into contact with the selector butt 202, the corresponding stitch size controlling sinker 201 is pushed out, i.e., selected. The selected stitch size controlling sinker 201 is therefore arranged at a position different from non-selected stitch size controlling sinkers 201. In accordance with the position of the stitch size controlling sinker 201, an arrangement of knitting yarns is changed, thus enabling the stitch size to be changed.

A knitting machine enabling the stitch size to be changed on a stitch-by-stitch basis has been required to have improved productivity. By increasing a rotation speed of a cylinder holding knitting needles, the productivity can be also improved. However, increasing the rotation speed of the cylinder can cause failure or omission of selection of the selector butt. Moreover, with the increase in the rotation speed of the cylinder, the movement of the actuator also has to be accelerated. If the number of the selector butts is increased, a space between adjacent selector butts arranged at the same level can be ensured. Therefore, increasing the number of the selector butts and reliable selection of the selector butts are required to correspond to the speed-up of the rotation of the cylinder.

However, in the conventional knitting machine described above, the selector butts are arranged at a plurality of different levels along a vertical direction parallel to the rotation axis of the cylinder. This makes it difficult to increase the number of the selector butts in the vertical direction and therefore an increase in the rotation speed of the cylinder is difficult.

SUMMARY OF THE INVENTION

Preferred embodiments of the present invention provide a stitch size controllable knitting machine which can control the stitch size on a stitch-by-stitch basis and can increase a rotation speed of a cylinder thereof while preventing a failure of selection of a sinker.

Preferred embodiments of the present invention also provide a manufacturing method of knitted fabric by using a knitting machine which can control the stitch size on a stitch-by-stitch basis, which enables a rotation speed of a cylinder of the knitting machine to be increased while preventing a failure of selection of a sinker.

According to an aspect of a preferred embodiment of the present invention, a stitch-size controllable knitting machine for forming tubular knitted fabric includes a cylinder which is arranged to be rotatable around its center axis and to accommodate a plurality of knitting needles extending in a vertical direction parallel or substantially parallel to the center axis, and a disk-shaped sinker bed arranged with a radial direction thereof perpendicular or substantially perpendicular to the vertical direction. The stitch-size controllable knitting machine further includes a plurality of sinkers radially arranged on the sinker bed to be movable radially inwardly and outwardly between the knitting needles, each of the sinkers including a first yarn holding portion arranged to hold knitting yarn when a first stitch is formed and a second yarn holding portion top arranged to hold the knitting yarn when a second stitch is formed, the first and second stitches having different knitting structures from each other; a plurality of selector jacks provided radially outside the sinkers as separate components from the sinkers to respectively correspond to the sinkers, the selector jacks being movable radially inwardly and outwardly and, when moving radially inwardly, moving the corresponding sinkers radially inwardly between the knitting needles; a selection member arranged to selectively act on the selector jacks in the vertical direction; an actuator arranged to drive the selection member in accordance with which one of the first stitch and the second stitch is to be formed; and a sinker cap, covering the sinker bed, provided with a group of cams arranged to act on the sinkers and the selector jacks. Each of the selector jacks includes a selector butt projecting to one side in the vertical direction and a selector boss projecting to an opposite side in the vertical direction. The selector butt is arranged to be subjected to a vertical action of the selection member. The selector butt of each of the selector jacks is arranged at a different radial position from that of an adjacent one of the selector jacks. The group of cams includes a cam arranged to act on the sinkers and another cam arranged to, when the actuator drives the selection member to act on one of the selector jacks, come into contact with the selector boss of that selector jack to limit vertical movement of that selector jack and convert it into radially inward movement thereof. When the first stitch is formed, the actuator has no action on a corresponding one of the selector jacks via the selection member and the cam acts on a corresponding one of the sinkers to move the sinker to a position at which the first yarn holding portion holds knitting yarn. When the second stitch is formed, the actuator acts on the selector butt of the corresponding one of the selector jacks via the selection member to bring the selector boss of that selector jack into contact with the other cam so as to cause that selector jack to move radially inwardly to move the corresponding sinker at another position at which the second yarn holding portion holds the knitting yarn.

The first and second stitch having different structures may be different in a stitch size by about 0.1 mm to about 2.0 mm, for example.

The group of cams may be arranged radially outside the cylinder above the sinkers and the selector jacks.

The selector butt is preferably arranged to project downward and the selector boss is preferably arranged to project upward.

In the aforementioned arrangement of the stitch-size controllable knitting machine, the sinkers and the selector jacks are separate components from each other and the selector jacks radially outside the sinkers are provided with the selector butts. Therefore, the selector butts of different steps can be arranged in the radial direction. Moreover, the selector butts of circumferentially adjacent selector jacks can be arranged at one or more different radial directions. Thus, this arrangement can correspond to high-speed rotation of the cylinder. Therefore, even in a case of high-speed rotation of the cylinder, selection of the selector butts can be surely and reliably performed.

In addition, in the aforementioned arrangement of the stitch-size controllable knitting machine, a mechanism is provided in which the selector jack pushes its corresponding sinker out by the action of the cam. Thus, the movement of the sinker is synchronized with the action of the cam. Therefore, the position of the sinker is limited by the cam, so that stable positioning of the sinker can be realized. Consequently, the occurrence of problems can be reduced and productivity can be improved. For example, the stitch sizes of larger and small stitches can be stably obtained.

Furthermore, when the sinkers and the selector jacks are separate components from each other and the selector jacks are arranged radially outside the sinkers, it is possible to easily keep the space for the actuator which is to act on the selector butts, radially outside the cylinder. That is, the actuator can be arranged at a more radially outward position.

The sinker bed may be arranged to perform both forward rotation and reverse rotation. In this case, the selection member may include a first slope arranged to come into contact with the selector butt during the forward rotation and a second slope arranged to come into contact with the selector butt during the reverse rotation.

Due to this arrangement, the tubular knitting fabric can be formed while the cylinder is reciprocating (forward rotation and reverse rotation).

Each sinker further may include a third yarn holding portion which is arranged to hold the knitting yarn when a third stitch is formed and is different from the first and second yarn holding portions. The third stitch has a different stitch size from those of the first and second stitches. In this case, the other cam that acts on the selector butt may be provided with a stepped portion to change a moving distance of each of the selector jacks between the formation of the second stitch and the formation of the third stitch. In this arrangement, when the third stitch is formed, the actuator acts on a corresponding selector jack to lift up it via the selection member and bring it into contact with the other cam; the other cam limits the vertical movement of that selector jack to move that selector jack radially inward so as to move a corresponding one of the sinkers to a position at which the third yarn holding portion holds the knitting yarn.

In this arrangement, the knitted fabric having the first stitch (large stitch), the third stitch (middle stitch), and the second stitch (small stitch) can be formed.

Alternatively, each of the sinkers may further include a third yarn holding portion which is arranged to hold the knitting yarn when a third stitch is formed and is different from the first and second yarn holding portions, the third stitch having a stitch size between those of the first and second stitches. Also, each of the selector jacks may include a further selector butt for the third stitch, the further selector butt being shorter than the selector butt for the second stitch. In this arrangement, the other cam may be provided with a stepped portion which is arranged to come into contact with the further selector butt and change a moving distance of each of the selector jacks between the formation of the second stitch and the formation of the third stitch. When the third stitch is formed, the actuator acts on the further selector butt of a corresponding one of the selector jacks via the selection member to lift the corresponding one of the selector jacks to a level which is lower than a level to which the corresponding one of the selector jack is lifted when the second stitch is formed, thus bringing the selector boss of the selector jacks into contact with the stepped portion of the other cam and causing the corresponding one of the selector jacks to move radially inwardly, and the moved one of the selector jacks causes a corresponding one of the sinkers to move to a position at which the third yarn holding portion holds the yarn.

The plurality of selector jacks may be a plurality of groups of selector jacks, in each of which a first selector butt, a second selector butt located radially inside the first selector butt, a third selector butt located radially inside the second selector butt, a fourth selector butt located radially inside the third selector butt, a fifth selector butt located radially inside the fourth selector butt, and a six selector butt located radially inside the fifth selector butt are included. In this case, the first, second and third selector butts serve as second-stitch-forming selector butts, and the fourth, fifth and sixth selector butts serve as third-stitch-forming selector butts. When the second stitch is formed, the actuator acts on the second-stitch-forming selector butt of a corresponding one of the selector jacks via the selection member to lift the one of the selector jacks, and the lifted one of the selector jacks comes into contact with the other cam to move radially inwardly to cause a corresponding one of the sinkers to move to the position at which the second yarn holding portion holds the yarn. When the third stitch is formed, the actuator acts on the third-stitch-forming selector butt of a corresponding one of the selector jacks via the selection member to lift the one of the selector jacks, and the lifted one of the selector jacks comes into contact with the stepped portion of the other cam so as to move radially inwardly to cause a corresponding one of the sinkers to move to another position at which the third yarn holding portion holds the yarn.

The third yarn holding portion may be located radially outside the second yarn holding portion.

Each of the plurality of groups of the selector jacks may include a first selector jack having the first selector butt, a second selector jack having the second selector butt, a third selector jack having the third selector butt, a fourth selector jack having the fourth selector butt, a fifth selector jack having the fifth selector butt, and a sixth selector jack having the sixth selector butt.

According to another preferred embodiment of the present invention, a method for forming tubular knitted fabric with a circular knitting machine is provided. The circular knitting machine includes a cylinder arranged to be rotatable around its center axis and accommodating a plurality of knitting needles extending in a vertical direction parallel or substantially parallel to the center axis; a disk-shaped sinker bed arranged with a radial direction thereof perpendicular or substantially perpendicular to the vertical direction; a plurality of sinkers arranged to be movable radially inwardly and outwardly between the knitting needles; a plurality of selector jacks arranged radially outside the sinkers as separate components therefrom to correspond thereto, respectively, and be movable radially inwardly and outwardly to act on the sinkers, respectively; an actuator arranged to act on the selector jacks; and a sinker cap, covering the sinker bed, provided with a cam arranged to act on the sinkers and the selector jacks. The method includes the steps of forming a first stitch by, while knitting yarn is held by a first yarn holding portion of a corresponding one of the sinkers, drawing the knitting yarn in with a corresponding one of the knitting needles without the actuator acting on a corresponding one of the selector jacks; and forming a second stitch by acting on a selector butt of a corresponding one of the selector jacks, which is provided at a different radial portion from that of at least adjacent one of the selector jacks, by using the actuator to lift and bring that selector jack into contact with the cam so as to cause that selector jack radially inward to move the corresponding one of the sinkers radially inwardly, and by drawing in the knitting yarn with a corresponding one of the knitting needles while the knitting yarn is held by a second yarn holding portion of the corresponding one of the sinkers which is different from the first yarn holding portion.

According to this method for forming knitted fabric, the selector jacks which are arranged radially outside the sinkers as separate components from the sinkers are provided with a plurality of selector butts, and, by selecting at least one of the selector butts, it is possible to act on a corresponding selector jack. Thus, even when the rotation speed of the cylinder is accelerated, it is possible to surely select the selector butt. Therefore, the knitted fabric in which the stitch sizes or types are changed on a stitch-by-stitch basis can be formed while the cylinder is rotated at a higher speed.

In a preferred embodiment of the present invention, each of the selector jacks may include the selector butt for the second stitch and a further selector butt for a third stitch having a different stitch size from the second stitch. In this case, the third stitch is formed by acting on the further selector butt of a corresponding one of the selector jacks, which is provided at a different radial portion from that of at least adjacent one of the selector jacks, by using the actuator to lift and bring that selector jack into contact with the cam so as to cause that selector jack radially inward to move the corresponding one of the sinkers radially inwardly, and by drawing in the knitting yarn with a corresponding one of the knitting needles while the knitting yarn is held by a third yarn holding portion of the corresponding one of the sinkers which is different from the first and second yarn holding portions.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Figure 1:
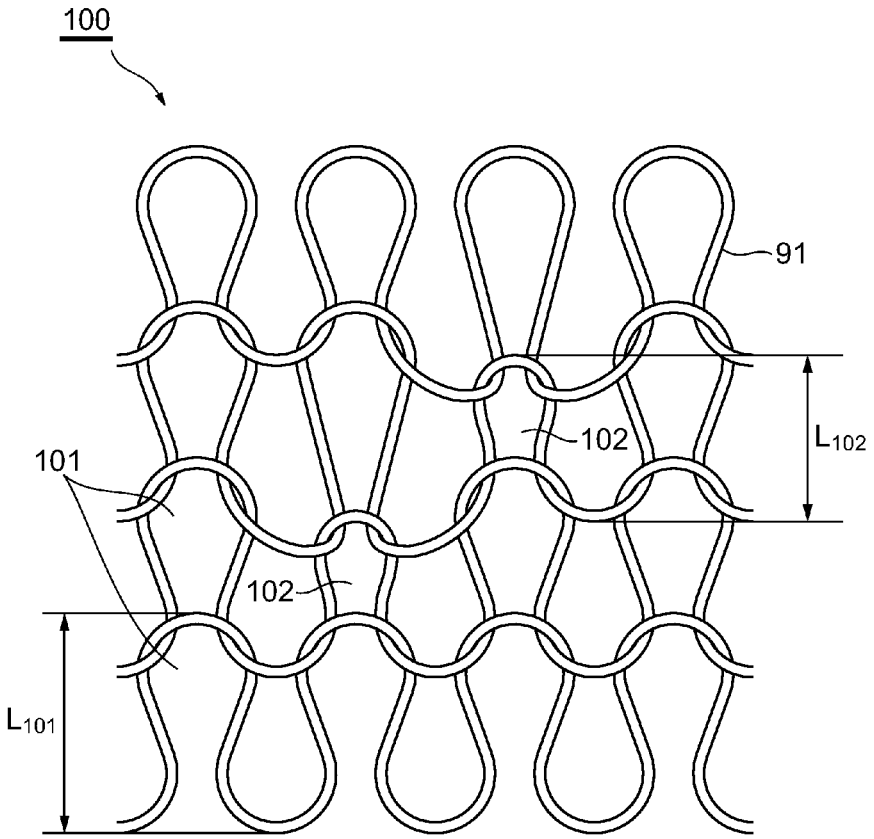
FIG. 1 shows exemplary knitting structures which can be formed by a circular knitting machine according to a first preferred embodiment of the present invention.

Hereinafter, preferred embodiments of the present invention are described referring to FIGS. 1 through 48B in which the same reference signs refer to the same or equivalent elements. Please note that the dimension ratio is not coincident with that in the description. In the description, the term describing the direction such as "upper", "lower" or the like is used for convenience based on the state shown in the drawings.

First Preferred Embodiment

Knitted fabric which can be formed by a circular knitting machine (stitch size controllable knitting machine) according to the first preferred embodiment is now described. FIG. 1 shows exemplary knitting structures (knitted fabric) which can be formed by the circular knitting machine of the first preferred embodiment. Referring to FIG. 1, the knitted fabric 100 includes stitches of a plurality of stitch sizes. For example, the knitted fabric 100 includes a first stitch 101 and a second stitch 102 having a smaller stitch size than the first stitch 101, as shown in FIG. 1. For example, the difference $L_{101}-L_{102}$ of the stitch size between the first stitch 101 and the second stitch 102 preferably is about 0.1 mm to about 2.0 mm, where $L_{101}$ is the stitch size of the first stitch 101 and $L_{102}$ is that of the second stitch 102.

Figure 2:
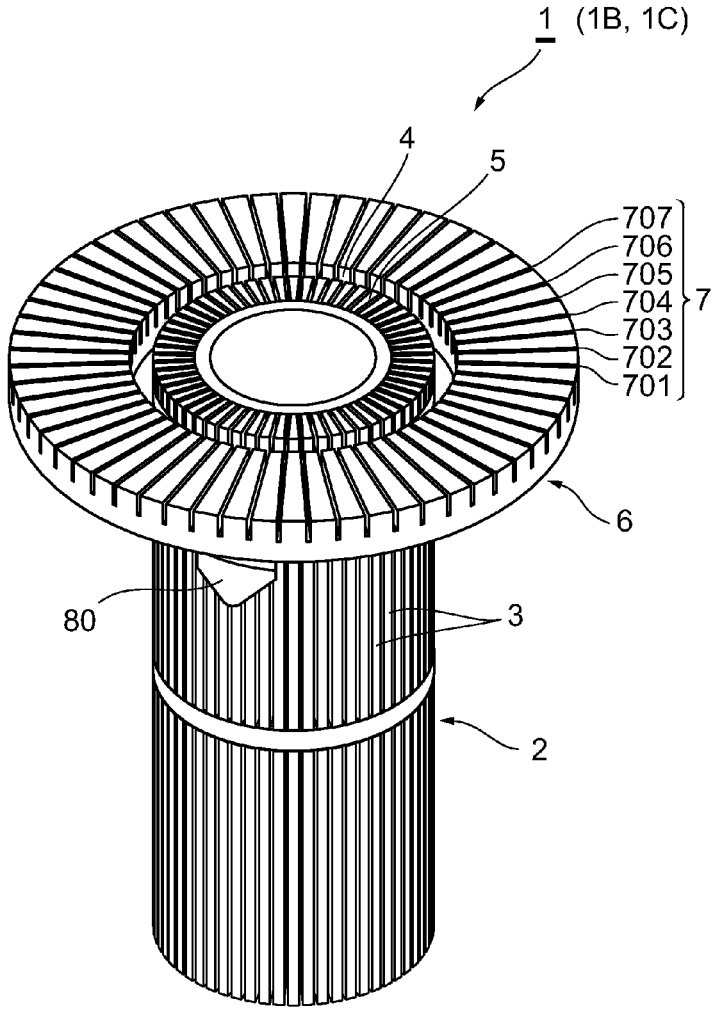
FIG. 2 is a perspective view of a stitch forming device included in the circular knitting machine according to the first preferred embodiment of the present invention.

The circular knitting machine 1 of the first preferred embodiment is now described, referring to FIGS. 2 to 14B. FIG. 2 is an enlarged perspective view of a stitch forming device included in the circular knitting machine 1 of this preferred embodiment and its surrounding portion. The circular knitting machine 1 includes a needle cylinder 2 supported by a stand (not shown) to be rotatable around its center axis, a top cylinder 4 attached inside an upper portion of the needle cylinder 2, a substantially disk-shaped sinker bed 6 arranged outside the upper portion of the needle cylinder 2, and the stitch forming device 10 arranged to take in and out sinkers 120 described later to/from between reciprocating knitting needles 11.

The needle cylinder 2 is a substantially tubular component of the circular knitting machine 1 and is arranged to accommodate the knitting needles 11. On the outer surface of the needle cylinder 2, a number of vertical slits 3 extending along a vertical direction parallel or substantially parallel to the central axis of the needle cylinder 2 are arranged to be equally spaced from each other in a circumferential direction of the needle cylinder 2. The vertical slits 3 are arranged to accommodate the knitting needles 11 therein such that the knitting needles 11 can slide along the vertical direction. For example, the needle cylinder 2 preferably includes 14 to 24 vertical slits 3 per inch in the outer circumferential direction of the needle cylinder 2.

The top cylinder 4 is arranged to be rotatable together with the needle cylinder 2 and is provided with a plurality of horizontal slits 5 which are arranged in a radial direction of the needle cylinder 2 to guide the sinkers described later. Each of the horizontal slits 5 is formed to be located between the vertical slits 3 of the needle cylinder 2, when seen from above in an axial direction parallel or substantially parallel to the axis if the cylinder 2. In other words, when seen from above, the horizontal slits 5 and the vertical slits 3 are alternately arranged in the circumferential direction of the cylinder 2.

The sinker bed 6 is an approximately disk-shaped component arranged to accommodate the sinkers 120 and selector jacks 130 both described later. The sinker bed 6 is arranged with its radial direction perpendicular or substantially perpendicular to the vertical direction so as to be rotatable together with the needle cylinder 2 and is provided with a plurality of horizontal slits 7 to arrange the sinkers 120 and the selector jacks 130 along the radial direction. The number of the horizontal slits 7 of the sinker bed 6 and the number of the horizontal slits 5 of the top cylinder 4 are preferably the same, and each horizontal slit 7 and its corresponding slit 5 are arranged on the same line in the radial direction.

Figure 10A:
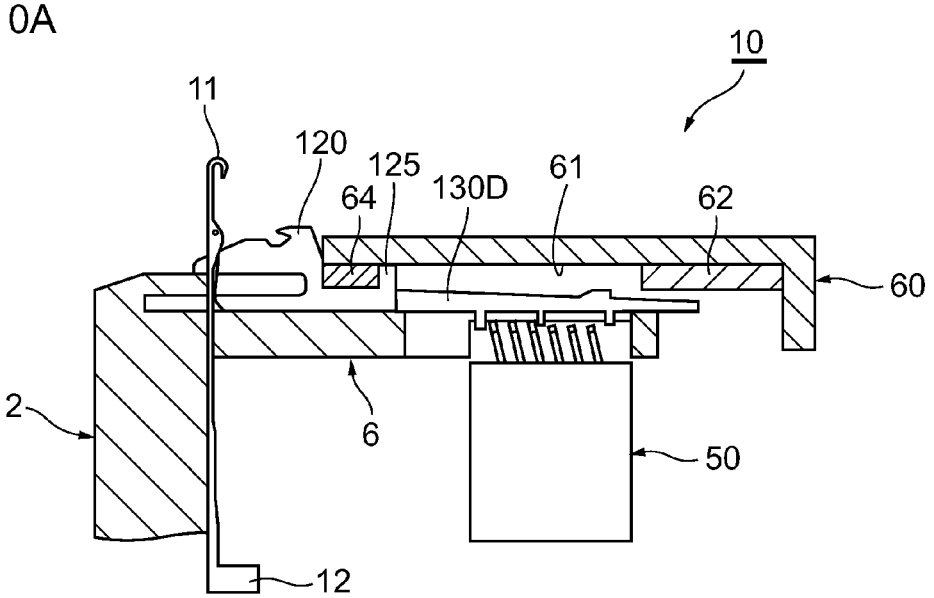
FIGS. 10A and 10B are cross-sectional views of the stitch forming device and the sinker cap, taken along a line O-C and a line O-D in FIG. 7, respectively.
Figure 10B:
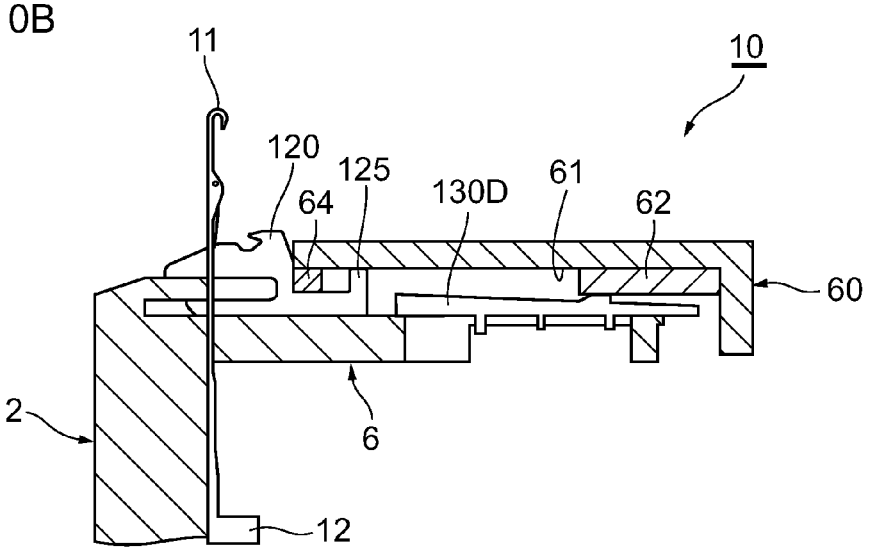

Referring to FIGS. 10A and 10B, the stitch forming device 10 includes sinkers 120 arranged to, when yarn forming a new loop is drawn into an old yarn, hold the yarn; selector jacks 130 each of which can selectively push out the corresponding sinker 120; an actuator 50 arranged to selectively act on the selector jacks 130; and a sinker cap 60 with a group of cams including a first cam 62 that pushes the selector jack 130 subjected to the action of the actuator 50 to between the knitting needles 11.

Figure 3:
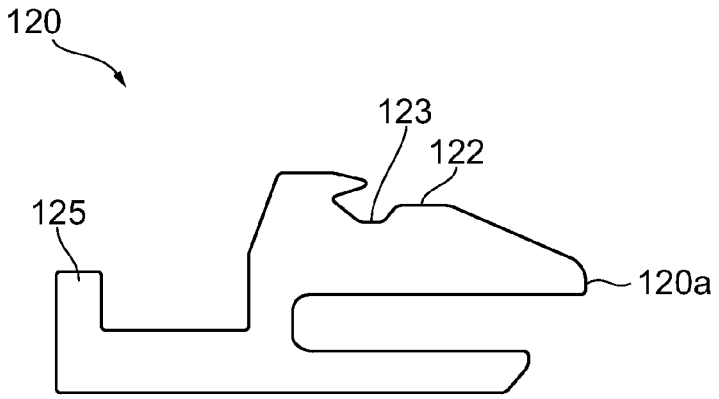
FIG. 3 is a side view of a two-step stitch size controlling sinker in the first preferred embodiment of the present invention.

FIG. 3 is a side view of a stitch size controlling sinker which is a two-step sinker in this preferred embodiment. The sinker 120 in FIG. 3 includes a plate-shaped member having a predetermined thickness, for example, about 0.4 mm. A first sinker top 122 and a second sinker top 123 are provided in the upper edge of the sinker 120. The first sinker top 122 is arranged to hold yarn 91 during formation of a first stitch, and the second sinker top 123 is arranged to hold the yarn 91 during formation of a second stitch.

The sinker 120 is arranged so that its leading end 120*a* can be moved in and out to/from between knitting needles 11. The first sinker top 122 is arranged closer to the leading end 120*a* than the second sinker top 123. The second sinker top 123 is arranged on the rear side (left in FIG. 3) of the first sinker top 122. In addition, the first sinker top 122 is arranged higher than the second sinker top 123. While being set in the knitting machine, the first sinker top 122 is arranged at a higher level than the second sinker top 123.

Figure 4:
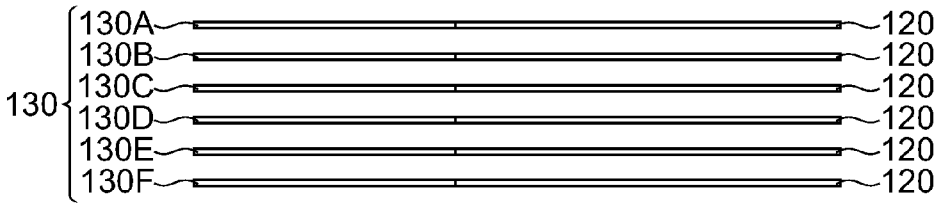
FIG. 4 shows an arrangement of sinkers and selector jacks in the first preferred embodiment of the present invention.

The selector jacks 130 (130A to 130F in this example) are accommodated in the horizontal slits 7 of the sinker bed 6, and are arranged to extend along a direction in which the selector jacks 130 are moved in and out, as shown in FIG. 4. FIG. 4 shows a plurality of selector jacks 130 are arranged parallel or substantially parallel to each other, but actually the selector jacks 130 are arranged radially along the radial direction of the sinker bed 6. The selector jacks 130 are arranged radially outside the corresponding sinkers 120, i.e., on the opposite side to the leading ends 120*a*, respectively.

Referring to FIGS. 5A to 5F, each selector jack 130 includes a selector butt 132 (132*a* to 132*f*) arranged to be subjected to the action of the actuator 50, a leading end 131*a* that pushes out the corresponding sinker 120 arranged radially inside thereof, and a rear end 131*b* which is an opposite end to the leading end 131*a*. The selector butt 132 is arranged on the lower surface 130*c* of an extending portion of the selector jack 130 between the leading end 131*a* and the rear end 131*b*. In addition, on the upper surface 130*d* of the extending portion of the selector jack 130, a selector boss 133 is arranged to be subjected to the action of the first cam 62 described later to be opposed to the first cam 62.

The circular knitting machine 1 includes a plurality of groups of six selector jacks 130*a* to 130*f*. In each group, the position of the selector butt 132 of each selector jack 130 is different from that of any other selector jack 130. More specifically, the selector butts 132*a* to 132*f* are arranged at different radial positions from one another. The selector butt 132*a* is arranged at a rear-most position in the radial direction (i.e., a radially outermost position), and the selector butt 132*b* is arranged closer to the leading end 131*a* of the corresponding selector jack 130 than the selector butt 132*a*. The selector butts 132*c*, 132*d*, 132*e*, and 132*f* are arranged at different radial positions so that they become closer to the leading ends in that order.

Figure 5A:
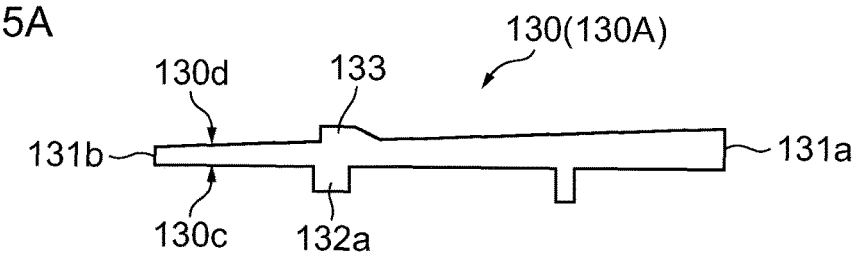
FIGS. 5A, 5B, 5C, 5D, 5E, and 5F are side views of the selector jacks, showing types of the selector jacks used in the first preferred embodiment of the present invention.
Figure 5B:
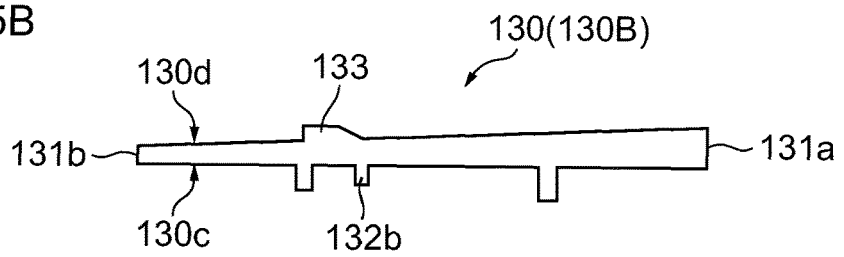
Figure 5C:
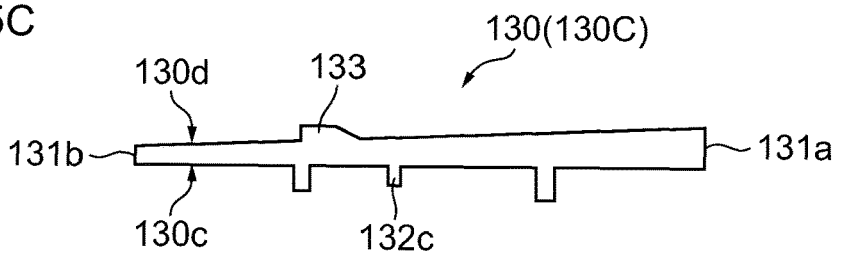
Figure 5D:
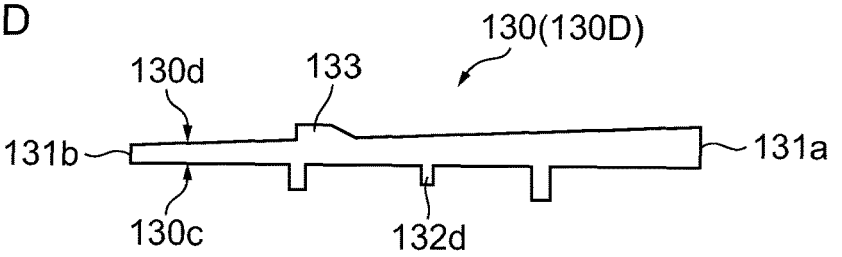
Figure 5E:
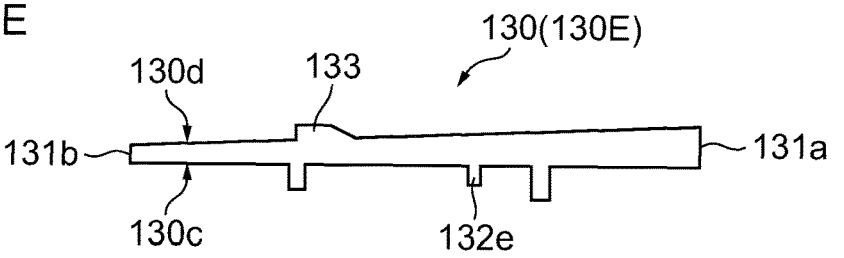
Figure 5F:
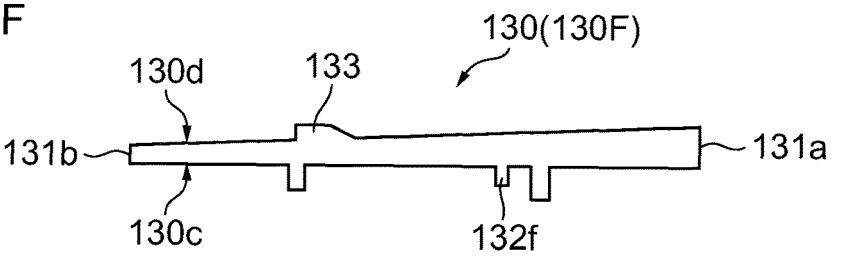

As shown in FIG. 5A, the selector jack 130A is provided with the selector butt 132*a*. As shown in FIG. 5B, the selector jack 130B is provided with the selector butt 132*b*. As shown in FIG. 5C, the selector jack 130C is provided with the selector butt 132*c*. As shown in FIG. 5D, the selector jack 130D is provided with the selector butt 132*d*. As shown in FIG. 5E, the selector jack 130E is provided with the selector butt 132*e*. As shown in FIG. 5F, the selector jack 130F is provided with the selector butt 132*f*.

The selector jacks 130A, 130B, 130C, 130D, 130E, and 130F are arranged in that order in the circumferential direction of the sinker bed 6, as shown in FIG. 4.

Referring to FIG. 2, in the first horizontal slit 7 on the sinker bed 6 (shown with 701 in FIG. 2), the sinker 120 and the selector jack 130A are inserted. Please note that FIG. 2 omits the sinkers 120 and the selector jacks 130 for the sake of simplicity. In the second horizontal slit 7 (702), the sinker 120 and the selector jack 130B are inserted. In the third horizontal slit 7 (703), the sinker 120 and the selector jack 130C are inserted. In the fourth horizontal slit 7 (704), the sinker 120 and the selector jack 130D are inserted. In the fifth horizontal slit 7 (705), the sinker 120 and the selector jack 130E are inserted. In the sixth horizontal slit 7 (706), the sinker 120 and the selector jack 130F are inserted.

From the seventh horizontal slit 7 (707) on the sinker bed 6, the aforementioned arrangement for the first to sixth horizontal slits is repeated. In this example, a case is described where the selector butts preferably have six steps, for example. However, the number of the sinker butt steps is not limited thereto, as long as the response speed of the actuator 50 electronically controlled with a signal input thereto can meet the rotation speed of the knitting machine. For example, the number of the selector butt steps may be one or more than six.

Figure 6A:
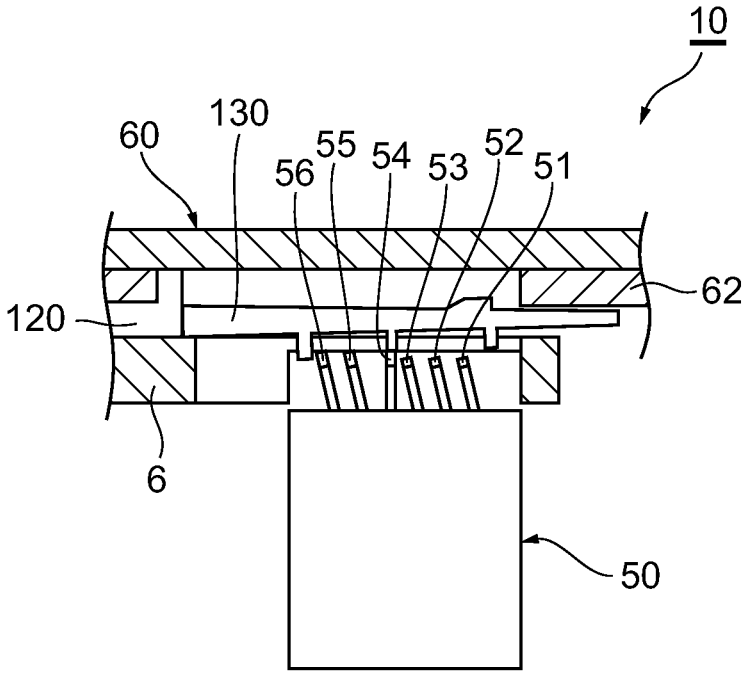
FIGS. 6A and 6B are a cross-sectional view of a portion of the stitch forming device which includes an actuator in the first preferred embodiment of the present invention, and a front view of a head included in the actuator, respectively.

FIG. 6A shows a cross section of a portion of the stitch forming device 10 in which the actuator 50 is arranged. In FIG. 6, the selector jack 130 is located above the actuator 50. The actuator 50 is arranged below the sinker bed 6, as shown in FIG. 6A, and can selectively act on the selector butts 132*a* to 132*f* of the selector jacks 130.

The actuator 50 includes heads 51, 52, 53, 54, 55, and 56 arranged to correspond to the selector butts 132*a*, 132*b*, 132*c*, 132*d*, 132*e*, and 132*f*, respectively.

More specifically, the head 51 is provided at a position corresponding to the selector butt 132*a*; the head 52 is provided at a position corresponding to the selection butt 132*b*; the head 53 is provided at a position corresponding to the selection butt 132*c*; the head 54 is provided at a position corresponding to the selector butt 132*d*; the head 55 is provided at a position corresponding to the selector butt 132*e*; and the head 56 is provided at a position corresponding to the selector butt 132*f*.

Figure 6B:
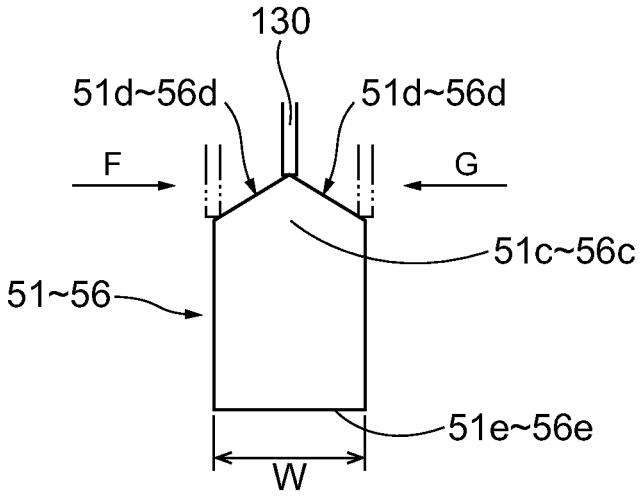

FIG. 6B is a front view of the head 51 to 56 of the actuator 50. Each of the heads 51 to 56 includes a plate-shaped member. The heads 51 to 56 are arranged such that the plate thickness direction is along the radial direction of the sinker bed 6 and the plate width direction W is along the tangential direction of the sinker bed 6.

The top of each of the heads 51 to 56 is provided with a convex portion 51*c* to 56*c* including slopes 51*d* to 56*d*. The height of the convex portion 51*c* to 56*c* becomes lower towards the outside in the width direction W. The slopes 51*d* to 56*d* are arranged on both sides of the convex portion 51*c* to 56*c* in the width direction W. The convex portion 51*c* to 56*c* is the highest at the center in the width direction W in this example. Those slopes 51*d* to 56*d* come into contact with the corresponding selector butts 132*a* to 132*f* of the selector jacks 130 so as to act on the corresponding selector jacks 130, that is, push the corresponding selector jacks 130 upward.

The heads 51 to 56 are supported at lower ends 51*e* to 56*e* thereof to be pivotable around a predetermined rotation axis which passes through the lower ends and extends along the width direction W. When the head 51 to 56 stands straight, the top of the convex portion 51*c* to 56*c* thereof reaches its highest position. When the head 51 to 56 is tilted, the top of the convex portion 51*c* to 56*c* is moved to a lower position. Therefore, when the head 51 to 56 stands straight, the slopes 51*d* to 56*d* thereof can come into contact with the corresponding one of the selector butts 132*a* to 132*f*. When the head 51 to 56 is tilted, the convex portion 51*c* to 56*c* is arranged so that the corresponding slopes 51*d* to 56*d* do not come into contact with the selector butts 132*a* to 132*f*.

FIG. 6A shows the state where the head 54 stands straight and the convex portion thereof 54*c* is in contact with the selector butt 132*c* of the corresponding selector jack 130 whereas the heads 51, 52, 53, 55 and 56 are tilted and the convex portions 51*c*, 52*c*, 53*c*, 55*c*, and 56*c* are not in contact with the selector jack 130.

Both in a case of forward rotation in which the needle cylinder 2 rotates in counterclockwise direction when the circular knitting machine 1 is seen from above and in a case of reverse rotation in which the needle cylinder 2 rotates in clockwise direction, the actuator 50 can provide the same or similar action to the selector butts 132. Thus, even in a case of "reciprocating rotational movement" in which the needle cylinder 2 makes an approximately half turn in the direction of forward rotation and that in the direction of reverse rotation alternately, it is possible to perform the same or similar control as/to that in a case of normal rotational movement.

Figure 7:
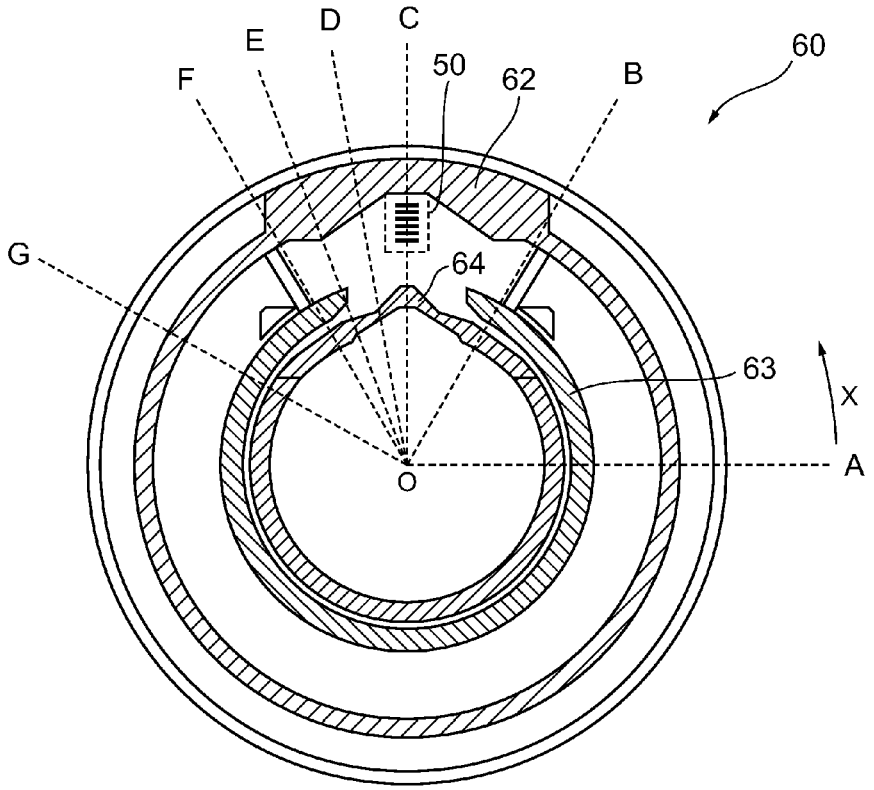
FIG. 7 is a plan view of a sinker cap in the first preferred embodiment of the present invention, showing an arrangement of a group of cams provided in the sinker cap.

FIG. 7 is a plan view of the sinker cap 60, showing the arrangement of a group of cams provided in the sinker cap. The sinker cap 60 is provided with cams 62 to 64 on its bottom surface to project below. FIG. 7 shows the sinker cap 60 when seen from above, but the cams arranged on the bottom side are shown with solid line for sake of convenience. The sinker cap 60 is arranged above the sinker bed 6 and supported by a stand (not shown) such that the sinker cap 60 cannot rotate and its cam-containing surface 61 having the cams 62 to 64 thereon faces down. In FIG. 7, the position of the actuator 50 when seen from above is shown with broken line.

The cam group includes the first cam 62 arranged at a radially outermost position, the second cam 63 arranged radially inside the first cam 62 (i.e., the center O side of the first cam 62), and the third cam 64 arranged radially inside the second cam 63.

The first cam 62 can act on the selector boss 133 of the selector jack 130 to limit the position of the selector jack 130. The second cam 63 can act on the rear end, i.e., the radially outer end of the butt 125 of the sinker 120 to limit the position of the sinker 120. The third cam 64 can act on the leading end, i.e., the radially inner end of the butt 125 of the sinker 120 to limit the position of the sinker 120.

Figure 8A:
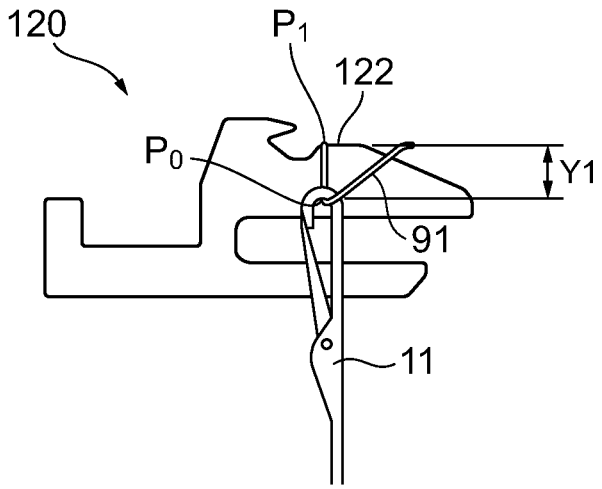
FIGS. 8A and 8B are side views of the sinker according to the first preferred embodiment of the present invention, showing how to hold yarn during formation of a first stitch and formation of a second stitch, respectively.
Figure 8B:
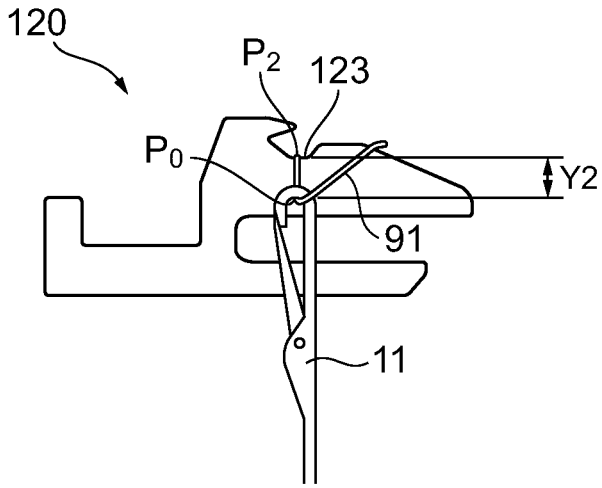

Referring to FIGS. 8A and 8B, it is now described how to hold knitting yarn 91 with the sinker 120. FIG. 8A shows a state where the first sinker top 122 of the sinker 120 holds the knitting yarn 91. The first stitch 101 (having a normal stitch length Y1) is formed by drawing the knitting yarn 91 in by a knitting needle 11, while the knitting yarn 91 is held by the first sinker top 122.

FIG. 8B shows a state where the second sinker top 123 of the sinker 120 holds the knitting yarn 91. In this state, the second stitch 102 (having a small stitch length Y2 smaller than the normal stitch length Y1) is formed by drawing in the knitting yarn 91 by the knitting needle 11. The height difference (Y1−Y2) between the height at which the first sinker top 122 holds the yarn during formation of the first stitch and the height at which the second sinker top 123 holds the yarn during formation of the second stitch preferably is about 0.1 mm to about 2.0 mm in this example. When the height difference (Y1−Y2) is about 0.1 mm or more, the size of the first stitch formed while the yarn is held by the first sinker top 122 and that of the second stitch formed while the yarn is held by the second sinker top 123 is apparently different. But when the height difference (Y1−Y2) exceeds 2.0 mm, an excessive load may be applied to the yarn. Thus, it is preferable that the difference (Y1−Y2) is about 0.1 mm to about 2.0 mm.

Next, operations of the circular knitting machine 1 of this preferred embodiment are described, mainly referring to FIGS. 9A to 14B showing a cross section of a portion of the stitch forming device 10 in which the selector jack 130D is arranged.

(Operation for Forming the First Stitch: Forward Rotation)

While the cylinder 2 and the sinker bed 6 are rotating (in the counterclockwise direction in FIG. 7), stitches are formed. In the state shown in FIG. 7, the rotation in the counterclockwise direction is referred to as forward rotation. The sinkers 120 and the selector jacks 130 rotate together with the sinker bed 6. The sinkers 120 and the selector jacks 130 move from rotational positions A to G in that order.

Figure 9A:
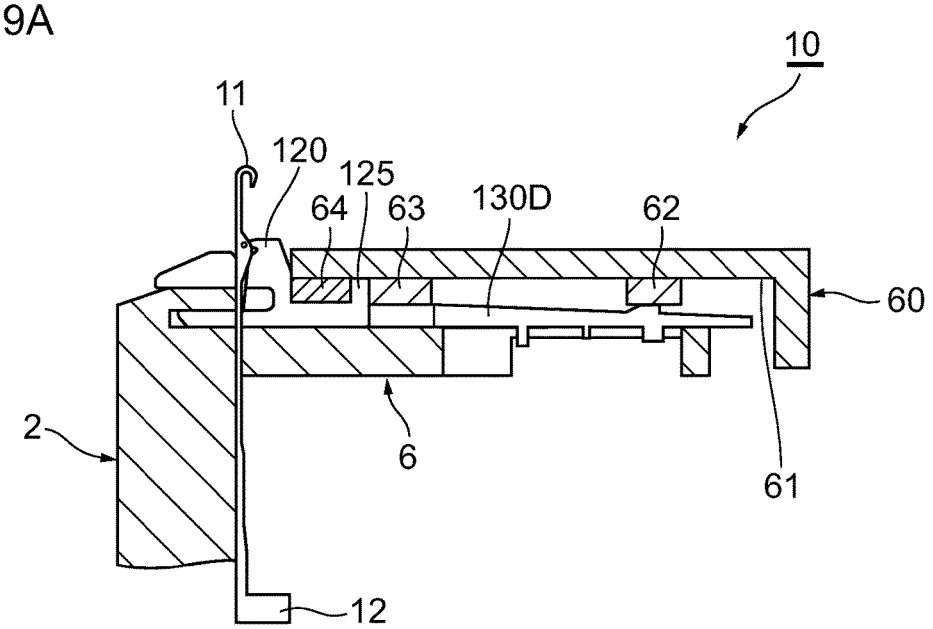
FIGS. 9A and 9B are cross-sectional views of the stitch forming device and the sinker cap, taken along a line O-A and a line O-B in FIG. 7, respectively.

FIG. 9A shows a state where the sinker 120 and the selector jack 130D are located at the rotational position A, i.e., on the line O-A in FIG. 7. At the rotational position A, the sinker 120 and the selector jack 130 are spaced away from each other in the radial direction, that is, are not in contact with each other. The movement of the butt 125 of the sinker 120 in the radial direction is limited by the second cam 63 and the third cam 64. As the knitting-needle cylinder 2 rotates in direction X, the sinker 120 and the selector jack 130 moves from the rotational position A to the rotational position B. During this movement, a knitting-needle butt 12 integrally formed with a knitting needle 11 is subjected to the action of a stitch 80 (see FIG. 2) and therefore the knitting needle 11 is moved upward. Thus, the yarn 91 forming a new loop is held by the knitting needle 11. When the sinker 120 and the selector jack 130 have reached the rotational position B, the knitting-needle butt 12 is subjected to the action of the stitch cam 80 (see FIG. 2) and therefore the knitting needle 11 holding the yarn 91 starts moving down.

Figure 9B:
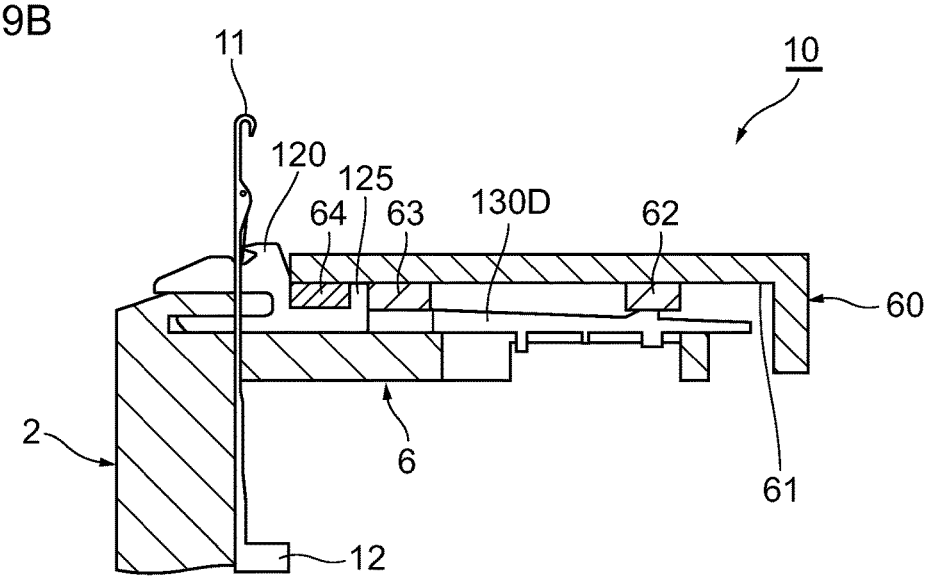

FIG. 9B shows a state where the sinker 120 and the selector jack 130 are located at the rotational position B, i.e., on the line O-B in FIG. 7. At the rotational position B, the sinker 120 and the selector jack 130 are spaced away from each other in the radial direction, that is, they are not in contact with each other. The movement of the butt 125 of the sinker 120 in the radial direction is limited by the second cam 63 and the third cam 64. At the rotational position B, the knitting needle 11 is located higher than at the rotational position A.

FIG. 10A shows a state where the sinker 120 and the selector jack 130 are located at the rotational position C, i.e., on the line O-C in FIG. 7. At the rotational position C, the selector jack 130 is arranged above the actuator 50. At this time, the heads 51 to 56 of the actuator 50 are tilted and they are not in contact with the selector butt 132. Therefore, the actuator 50 does not act on the selector jack 130.

While moving from the rotational position B to the rotational position C, the sinker 120 moves forward (radially outward) because the movement thereof in the radial direction is limited by the third cam 64.

FIG. 10B shows a state where the sinker 120 and the selector jack 130 are located at the rotational position D, i.e., on the line O-D in FIG. 7. The sinker 120 moves forward while moving from the rotational position C to the rotational position D, because the movement thereof in the radial direction is limited by the third cam 64.

Figure 11A:
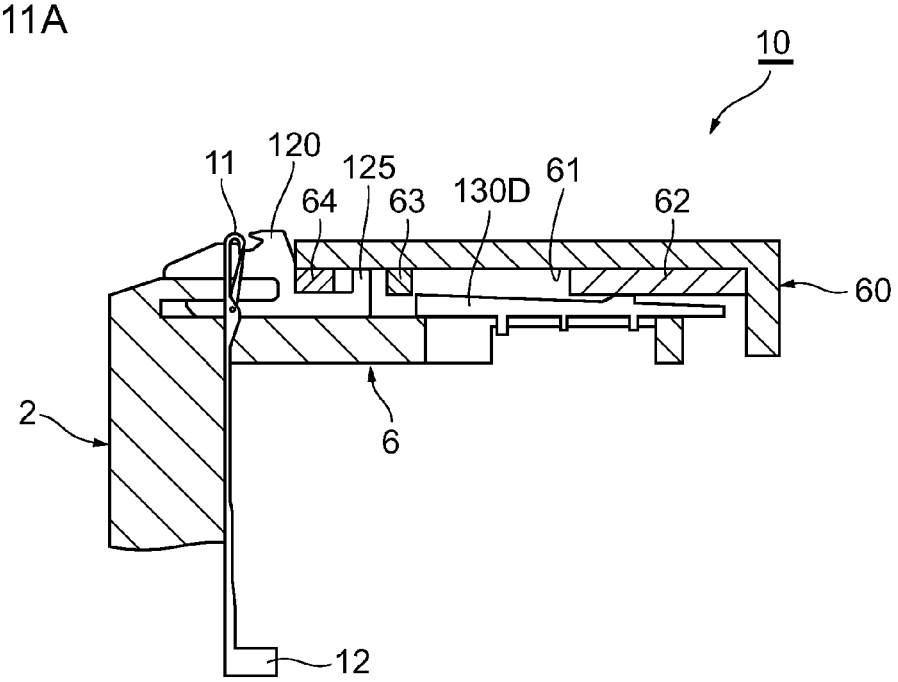
FIGS. 11A and 11B are cross-sectional views of the stitch forming device and the sinker cap, taken along a line O-E and a line O-F in FIG. 7, respectively.

FIG. 11A shows a state where the sinker 120 and the selector jack 130 are located at the rotational position E, i.e., on the line O-E in FIG. 7. The movement of the sinker 120 in the radial direction is limited by the third cam 64. The sinker 120 moves to a position at which the first sinker top 122 can hold the knitting yarn 91 (see FIG. 8A). That is, the sinker 120 holds the knitting yarn with the first sinker top 122.

Figure 11B:
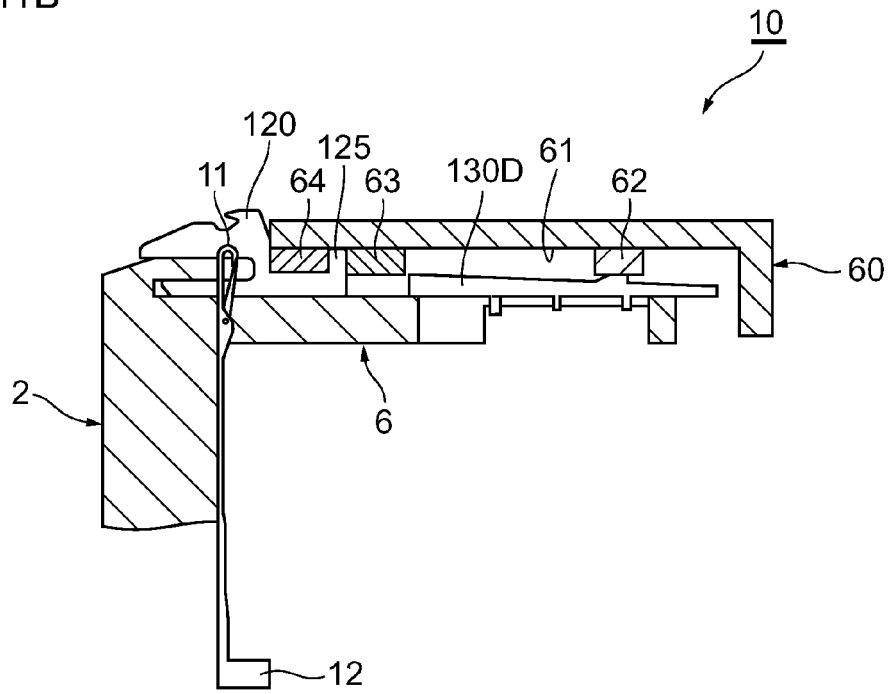

FIG. 11B shows a state where the sinker 120 and the selector jack 130 are located at the rotational position F, i.e., on the line O-F in FIG. 7. While the first sinker top 122 holds the knitting yarn, the knitting needle 11 goes down to draw in the knitting yarn so as to form the first stitch.

Figure 12:
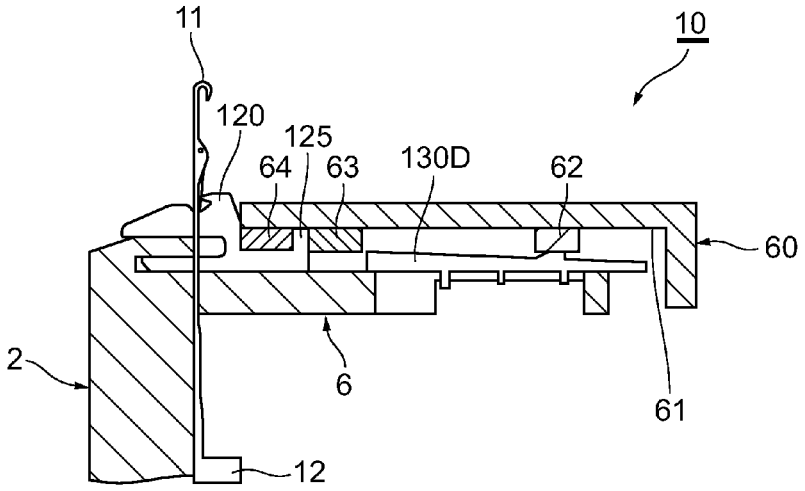
FIG. 12 is a cross-sectional view of the stitch forming device and the sinker cap, taken along a line O-G in FIG. 7.

FIG. 12 shows a state where the sinker 120 and the selector jack 130 are located at the rotational position G, i.e., on the line O-G in FIG. 7. The knitting needle 11 goes upward while moving from the rotational position F to the rotational position G. The knitting yarn caught by the knitting needle 11 falls out of the knitting needle 11.

(Operation for Forming the First Stitch: Reverse Rotation)

While the cylinder 2 and the sinker bed 6 are rotating in the direction of reverse rotation (clockwise direction in FIG. 7), stitches are formed. The rotation in the clockwise direction in FIG. 7 is referred to as reverse rotation. The sinkers 120 and the selector jacks 130 rotate together with the sinker bed 6. The same processes as those described for the forward rotation are performed during the reverse rotation of the cylinder 2 so as to form the first stitch.

(Operation for Forming the Second Stitch: Forward Rotation)

At the rotational positions A and B, the operation for forming the first stitch and that for forming the second stitch are substantially the same, as shown in FIGS. 9A and 9B.

Figure 13A:
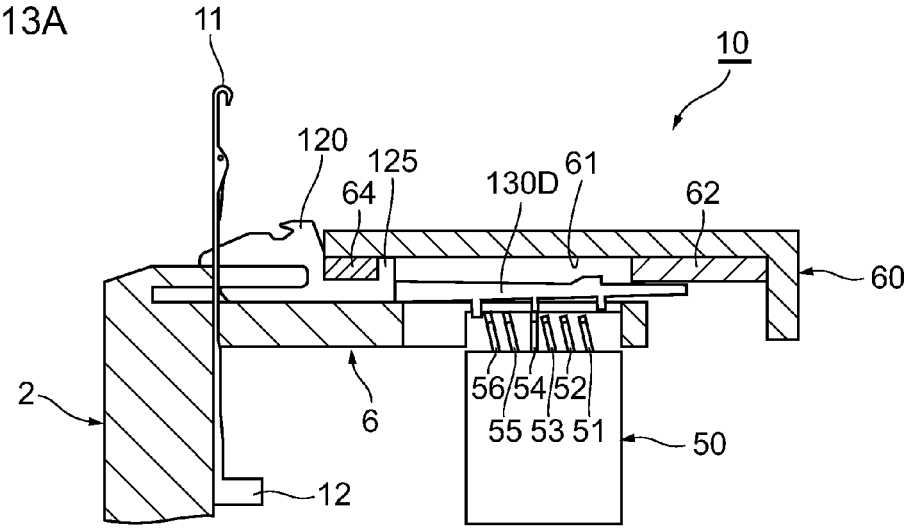
FIGS. 13A and 13B are cross-sectional views of the stitch forming device and the sinker cap, taken along the line O-C and the line O-D in FIG. 7, respectively.

FIG. 13A shows a state where the sinker 120 and the selector jack 130 are located at the rotational position C. At the rotational position C, the selector jack 130 is arranged above the actuator 50. At this time, the head 54 of the actuator 50 stands straight and is in contact with the selector butt 132*d*. The actuator 50 acts on the selector jack 130.

The selector jack 130 (130D) comes into contact with the head 54 so as to be lifted upward (see FIG. 6B). The rear end of the sinker 120 is in contact with the leading end of the selector jack 130.

Figure 13B:
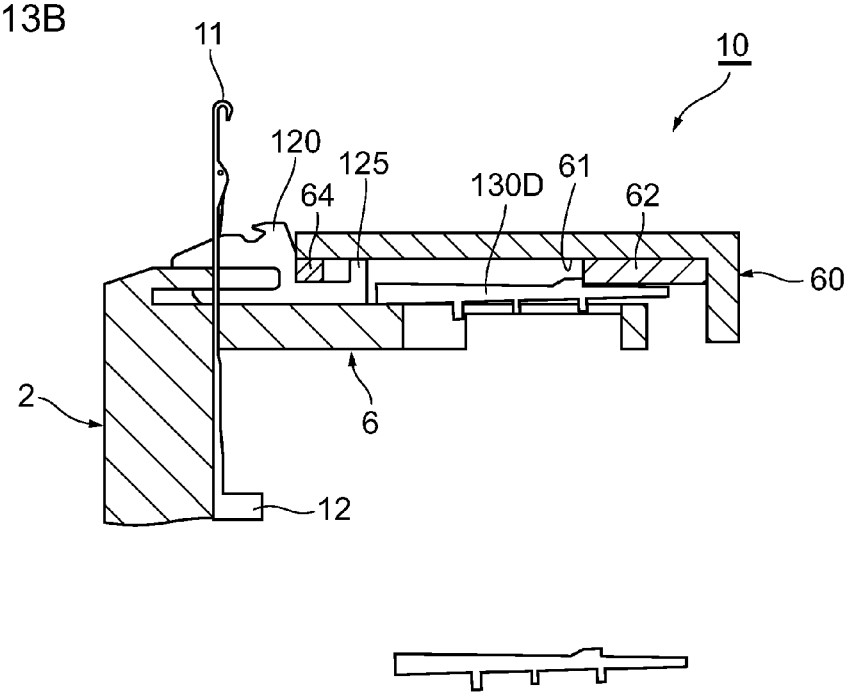

FIG. 13B shows a state where the sinker 120 and the selector jack 130 are located at the rotational position D. The selector jack 130 moves forward while moving from the rotational position C to the rotational position D, because the movement of the selector jack 130 is limited by the first cam 62.

Figure 14A:
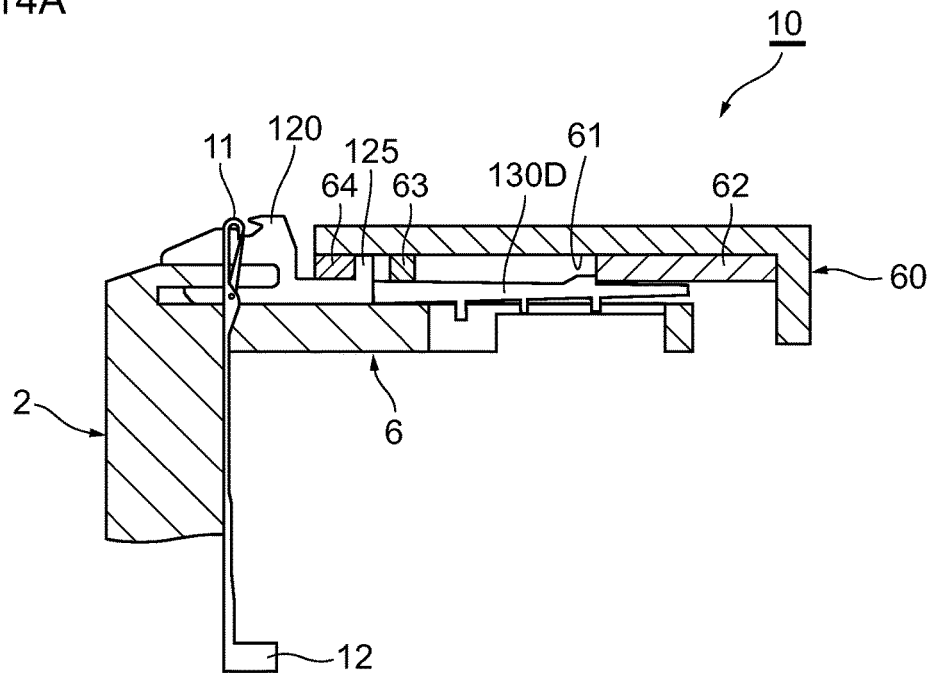
FIGS. 14A and 14B are cross-sectional views of the stitch forming device and the sinker cap, taken along the line O-E and the line O-F in FIG. 7, respectively.

FIG. 14A shows a state where the sinker 120 and the selector jack 130 are located at the rotational position E. The selector jack 130 moves forward while moving from the rotational position D to the rotational position E, because the movement of the selector jack 130 in the radial direction is limited by the first cam 62. The selector boss 133 of the selector jack 130 comes into contact with the first cam 62 to move the selector jack 130 forward so as to push out the sinker 120. Thus, the sinker 120 moves and reaches such a position that the second sinker top 123 can hold the knitting yarn 91 (see FIG. 8B). The sinker 120 holds the knitting yarn with the second sinker top 123.

Figure 14B:
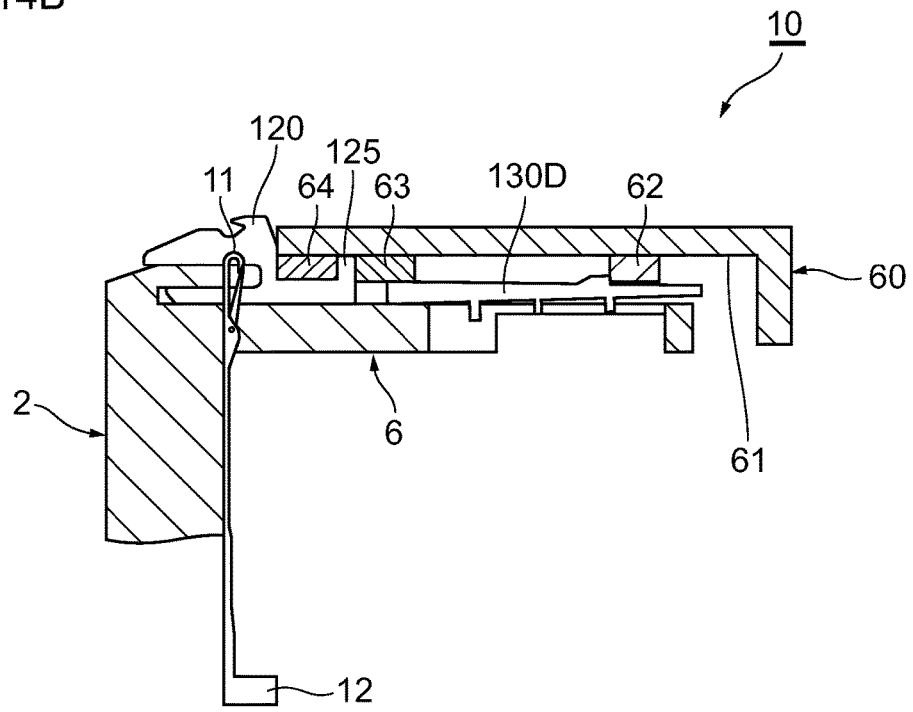

FIG. 14B shows a state where the sinker 120 and the selector jack 130 are located at the rotational position F. While the second sinker top 123 holds the knitting yarn, the knitting needle 11 moves down and draws in the knitting yarn so as to form the second stitch. As shown in FIGS. 8A and 8B, because of the height difference of the knitting yarn held by the sinker 120 (Y1>Y2), it is possible to provide a size difference between the stitches.

The knitting needle 11 moves upward while moving from the rotational position F to the rotational position G. The knitting yarn 11 caught by the knitting needle 11 falls out of the knitting needle 11.

(Operation for Forming the Second Stitch: Reverse Rotation)

While the cylinder 2 and the sinker bed 6 are rotating in the reverse direction (counterclockwise direction in FIG. 7), a stitch is formed. The same processes as those performed during forward rotation are also performed during reverse rotation of the cylinder 2 so as to form the second stitch. In the knitting machine 1 of this preferred embodiment, each of the heads 51 to 56 includes the slopes on both sides thereof to correspond to both forward rotation and reverse rotation. Therefore, also in a case of reverse rotation, the heads 51 to 56 are selectively driven to act on the corresponding selector jacks 130, make the corresponding sinkers 120 go forward in turn, so as to make the second sinker top 123 hold the knitting yarn. While the second sinker top 123 is holding the knitting yarn, the knitting needle 11 moves down to draw in the knitting yarn, so as to form the second stitch.

According to the circular knitting machine 1 of this preferred embodiment, the sinker 120 and the selector jack 130 preferably are separate portions, and the selector jack 130 arranged on the rear side of the sinker 120 is provided with the selector butt. Therefore, the selector butts 132 corresponding to different steps can be arranged in the radial direction. Thus, the stitch forming device can correspond to high-speed rotation, and selection of the selector butt 132 can be performed reliably even during high-speed rotation.

Moreover, the circular knitting machine 1 of the above configuration includes the mechanism that enables the selector jack to push out the corresponding the sinker 120 by the action of the cams. Therefore, the movement of the sinker 120 is synchronized with the action of the cams. Thus, the position of the sinker 120 can be limited by the cams, resulting in stable positioning of the sinker 120. Consequently, the occurrence of errors can be reduced and productivity can be increased. For example, the sizes of larger stitches and smaller stitches can be stably obtained.

Second Preferred Embodiment

Next, a circular knitting machine according to the second preferred embodiment of the present invention is described. The same description as that of the first preferred embodiment is omitted. The circular knitting machine of the second preferred embodiment can form stitches of three different sizes.

Hereinafter, differences between the first preferred embodiment and the second preferred embodiment are mainly described. The circular knitting machine 1B of the second preferred embodiment includes a stitch size controlling sinker 120B shown in FIG. 16 configured to form stitches of three different sizes, in place of the stitch size controlling sinker 120 shown in FIG. 3 that forms stitches of two different sizes. Also, the circular knitting machine of this preferred embodiment includes selector jacks 230 shown in FIGS. 18A to 18C in place of the selector jacks 130 shown in FIGS. 5A to 5F. Please note that three selector jacks 230 define one group in this preferred embodiment, whereas six selector jacks 130 define one group in the first preferred embodiment. Moreover, the circular knitting machine of the second preferred embodiment includes a sinker cap 60B shown in FIG. 19 in place of the sinker cap 60 shown in FIG. 7.

Figure 15:
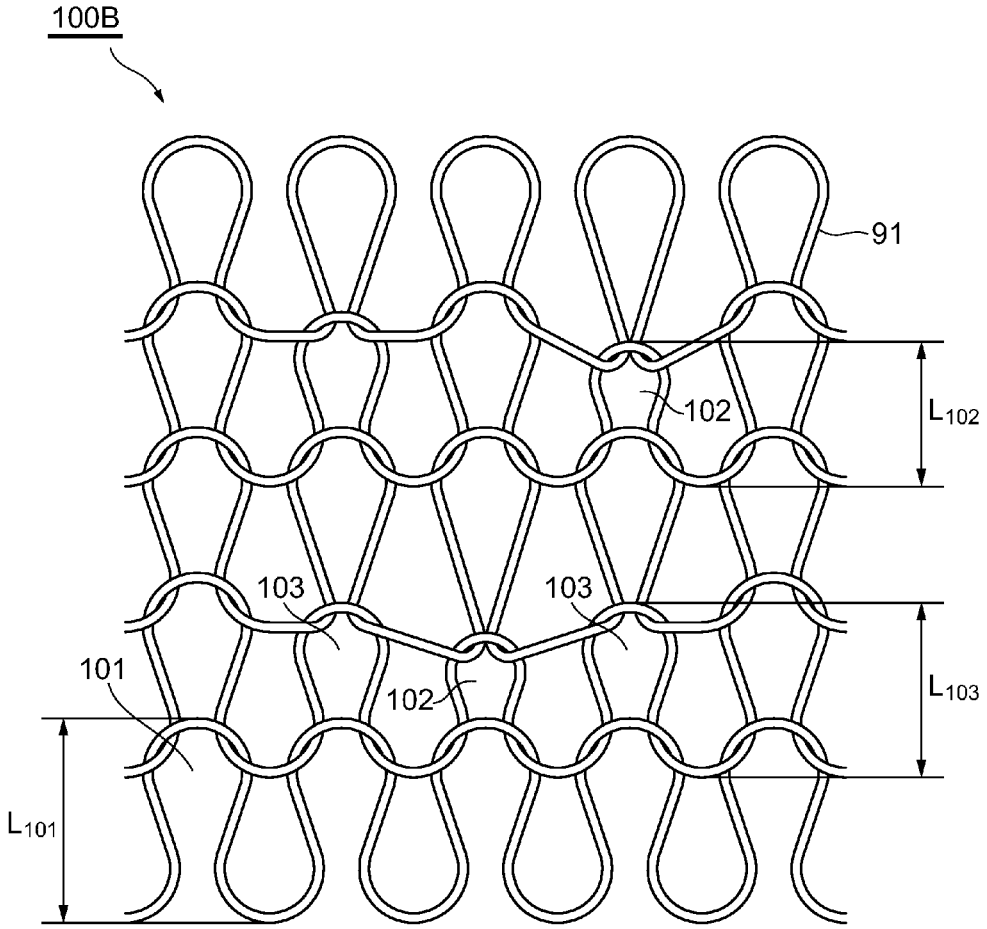
FIG. 15 shows exemplary knitting structures which can be formed by a circular knitting machine according to a second preferred embodiment of the present invention.

FIG. 15 shows exemplary knitting structures of the circular knitting machine of this preferred embodiment. Referring to FIG. 15, knitted fabric 100B includes stitches of a plurality of stitch sizes, i.e., a first stitch 101, a second stitch 102 having a smaller stitch size than the first stitch 101, and a third stitch 103 having a stitch size smaller than the first stitch 101 and larger than the second stitch 102, as shown in FIG. 15. That is, the sizes become larger in the order of the second stitch 102, the third stitch 103, and the first stitch 101. The difference ($L_{101}$–$L_{102}$) of the stitch size between the first stitch 101 and the second stitch 102 preferably is about 0.1 mm to about 2.0 mm, for example, where $L_{101}$ is the stitch size of the first stitch 101 and $L_{102}$ is that of the second stitch 102, respectively. Also, the third stitch 103 has the stitch size of $L_{103}$.

Figure 16:
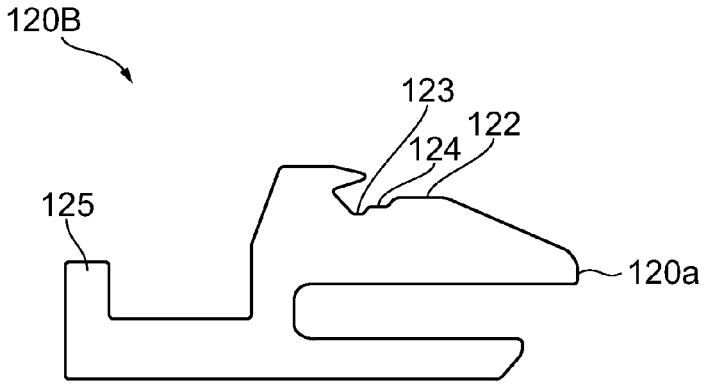
FIG. 16 is a side view of a three-step stitch size controlling sinker in the second preferred embodiment of the present invention.

FIG. 16 is a side view of the stitch size controlling sinker 120B which can provide three-step control. The sinker 120B in FIG. 16 is a plate-shaped member having a predetermined thickness, for example, about 0.4 mm. The first sinker top 122, the second sinker top 123, and the third sinker top 124 are provided in the upper edge of the sinker 120B. The first sinker top 122 is arranged to hold yarn 91 during formation of the first stitch 101, the second sinker top 123 is arranged to hold the yarn 91 during formation of the second stitch 102, and the third sinker top 124 is arranged to hold yarn 91 during formation of the third stitch 103.

The sinker 120B is arranged so that its leading end 120*a* can be moved in and out to/from between knitting needles 11. The first sinker top 122 is arranged at a closest position to the leading end 120*a*, and the third sinker top 124 is arranged next to the first sinker top 122 on the rear side (left in FIG. 16) of the first sinker top 122. The second sinker top 123 is arranged next to the third sinker top 124 on the rear side thereof. In addition, among the first, second, and third sinker tops 122, 123, and 124, the first sinker top 122 is the highest and the second sinker top 123 is the lowest. The height of the third sinker top 124 is between those of the first and second sinker tops 122 and 123. Please note that the term "height" refers to a level in the vertical direction when the sinker 120B is placed in the circular knitting machine.

Figure 17:
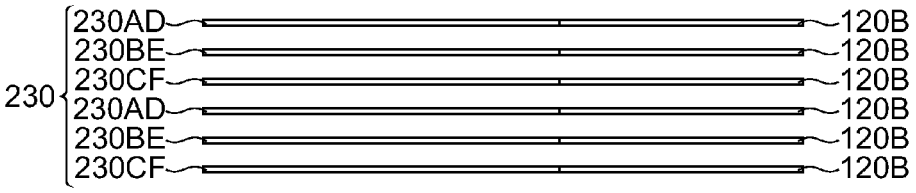
FIG. 17 shows an arrangement of sinkers and selector jacks in the second preferred embodiment of the present invention.

The selector jacks 230 (230AD, 230BE, and 230CF) are accommodated in the horizontal slits 7 of the sinker bed 6 (see FIG. 2) and are arranged to extend along a direction in which the selector jacks 230 are moved in and out, as shown in FIG. 17. FIG. 17 shows a plurality of selector jacks 230 arranged parallel or substantially parallel to each other, but actually the selector jacks 230 are arranged radially, not parallel to each other. The selector jacks 230 are arranged radially outside the corresponding sinkers 120B, i.e., on the opposite side to the leading ends 120*a*, respectively.

Figure 18A:
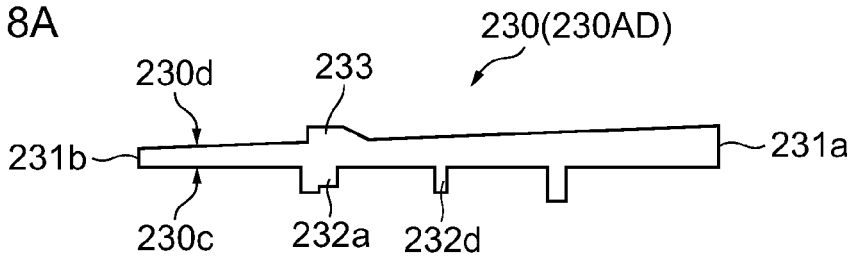
FIGS. 18A, 18B, and 18C are side views of the selector jacks, showing types of the selector jacks used in the second preferred embodiment of the present invention, respectively.
Figure 18B:
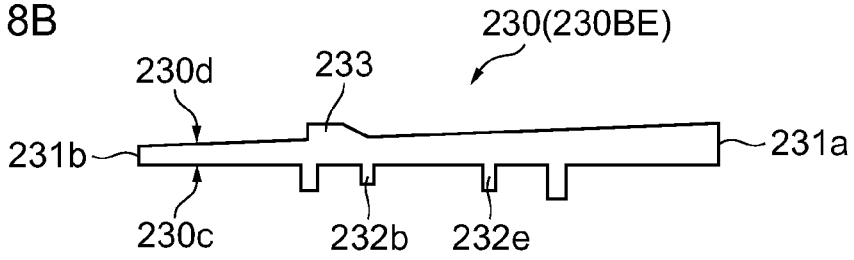
Figure 18C:
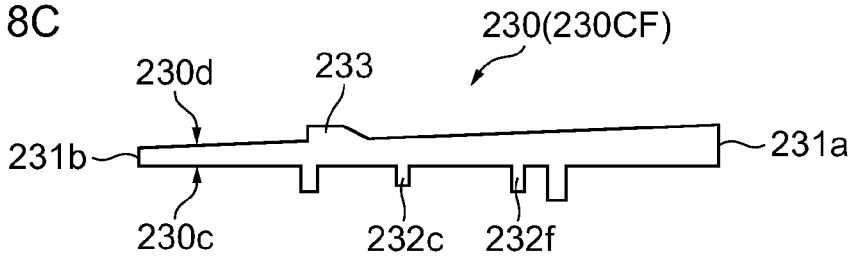

Referring to FIGS. 18A to 18C, each selector jack 230 includes a selector butt 232 (232*a* to 232*f*) arranged to be subjected to the action of the actuator 50, a leading end 231*a* that pushes out the corresponding sinker 120B arranged radially inside thereof, and a rear end 231*b* which is an opposite end to the leading end 231*a*. The selector butt 232 is arranged on the lower surface 230*c* of the extending portion of the selector jack 230. On the upper surface 230*d* of the extending portion, a selector boss 233 is arranged to be subjected to the action of the first cam described later. More specifically, each selector jack has the selector butt used for formation of the second stitch and the selector butt used for formation of the third stitch. The selector butt used for the third stitch is shorter than the selector butt used for the second stitch in the vertical direction. Thus, the moved amount of the selector jack by the action of the actuator 50 is smaller in formation of the third stitch than in formation of the second stitch in the vertical direction.

The circular knitting machine 1B of this preferred embodiment includes a plurality of groups of three selector jacks 230 which are different in the position of the selector butt 232 (232*a* to 232*f*). In this preferred embodiment, each selector jack 230 preferably includes two selector butts 232. The selector butts 232*a* to 232*f* are different from one another at positions in the radial direction. More specifically, the selector butt 232*a* is arranged at the rear-most position in the radial direction, and the selector butt 232*b* is arranged closer to the leading end 231*a* than the selector butt 232*a*. The selector butts 232*c*, 232*d*, 232*e*, and 232*f* are arranged at different positions so that they become closer to the leading ends in that order.

As shown in FIG. 18A, the selector jack 230AD is provided with the selector butts 232*a* and 232*d*. As shown in FIG. 18B, the selector jack 230BE is provided with the selector butts 232*b* and 232*e*. As shown in FIG. 18C, the selector jack 230CF is provided with the selector butts 232*c* and 232*f*.

The selector jacks 230AD, 230BE, and 230CF are arranged in that order along the circumferential direction of the sinker bed 6, as shown in FIG. 17.

In the first horizontal slit 7 on the sinker bed 6 (shown with 701 in FIG. 2), the sinker 120B and the selector jack 230AD are inserted. Please note that FIG. 2 omits the sinkers 120B and the selector jacks 230 (230AD, 230BE, and 230CF) for the sake of simplicity. In the second horizontal slit 7 (702), the sinker 120B and the selector jack 230BE are inserted. In the third horizontal slit 7 (703), the sinker 120B and the selector jack 230CF are inserted.

From the fourth horizontal slit 7 (704) on the sinker bed 6, the aforementioned arrangement for the first to third horizontal slits is repeated. In this example, a case is described where the selector butts have three steps. However, the number of steps of the selector butts is not limited thereto, as long as the response speed of the actuator 50 electronically controlled with a signal input thereto can meet the rotation speed of the knitting machine.

Figure 19:
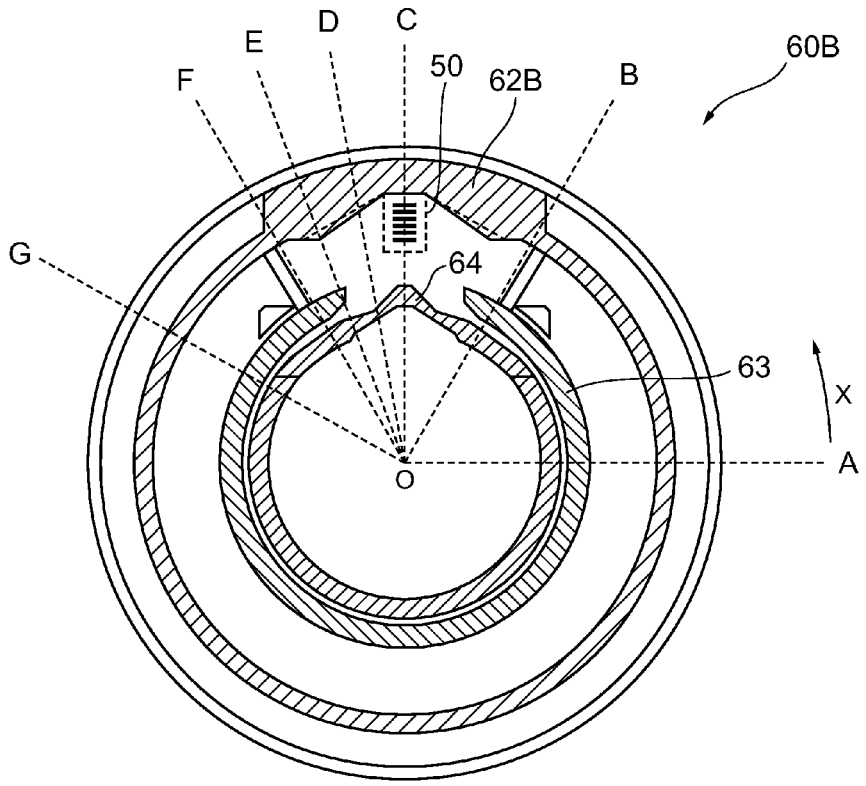
FIG. 19 is a plan view of a sinker cap in the second preferred embodiment of the present invention, showing an arrangement of a group of cams provided in the sinker cap.

FIG. 19 is a plan view of the sinker cap 60B showing the arrangement of a group of cams provided in the sinker cap 60B. The sinker cap 60 is provided with cams 62B, 63 and 64 on its bottom surface to project below. FIG. 19 shows the sinker cap 60B when seen from above, but the cams arranged on the bottom side are shown with solid line for sake of convenience. The sinker cap 60B is arranged above the sinker bed 6 and supported by a stand (not shown) not to be rotatable such that the bottom surface having the cams 62B to 64 thereon faces down. In FIG. 19, the position of the actuator 50 when the sinker cap 60B is seen from above is shown with broken line.

Figure 20:
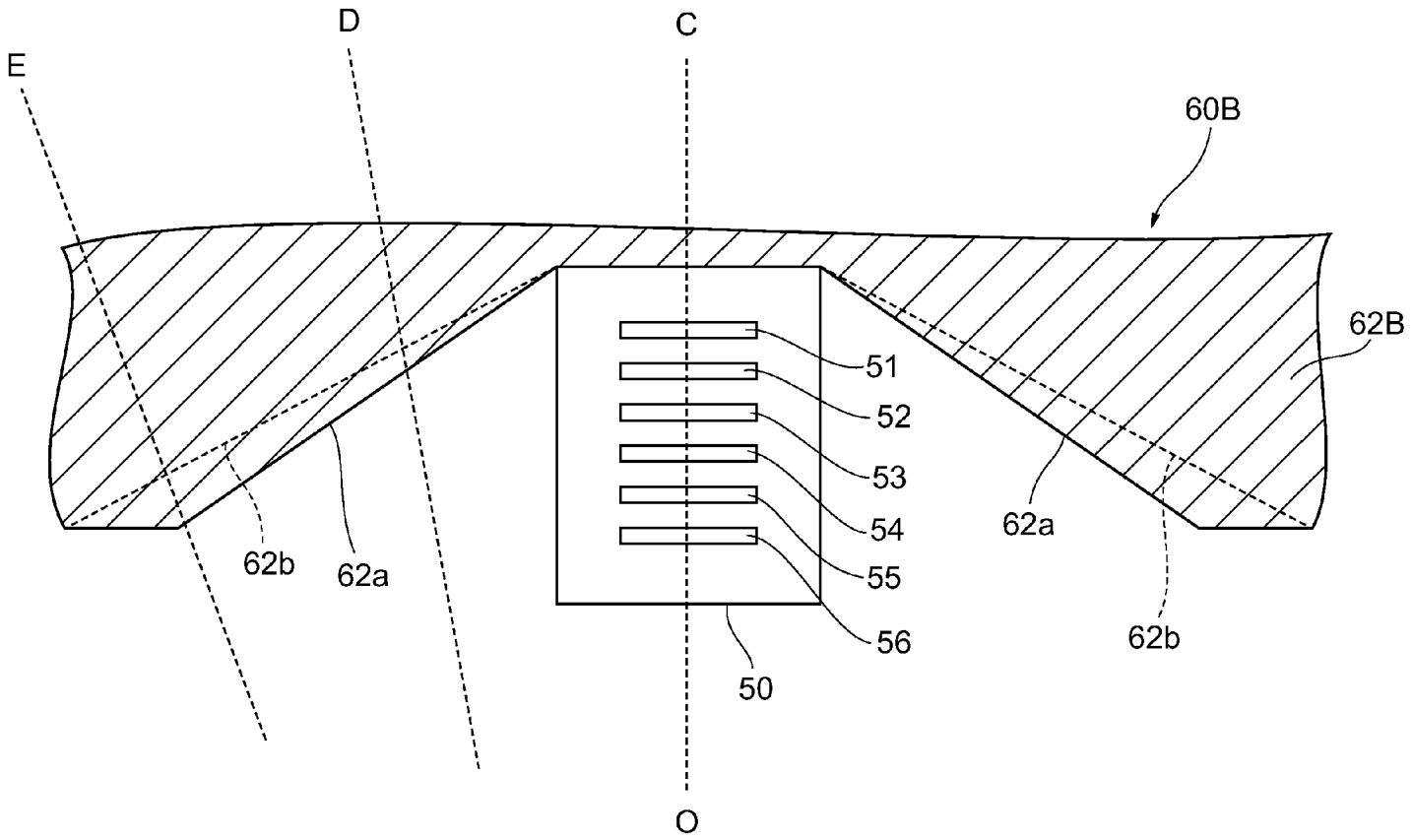
FIG. 20 is an enlarged view of a portion of the cam group of FIG. 19, showing an arrangement of a stepped portion.
Figure 21A:
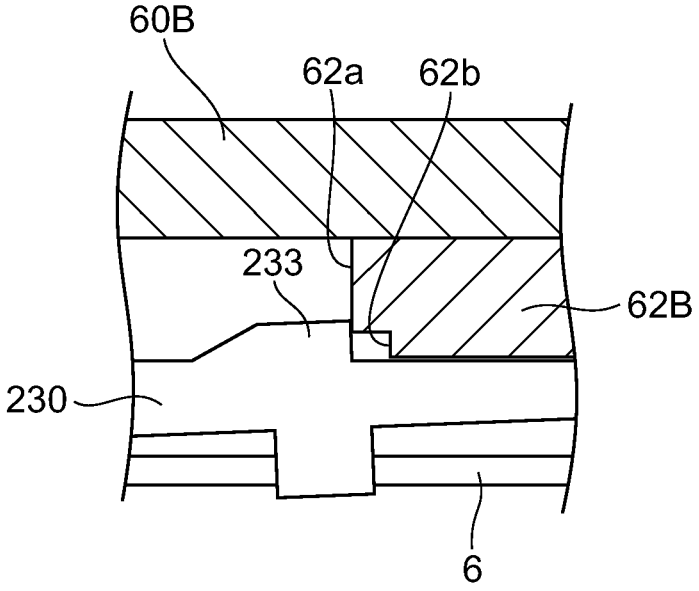
FIGS. 21A and 21B are cross-sectional views of another portion of the cam group of FIG. 19.
Figure 21B:
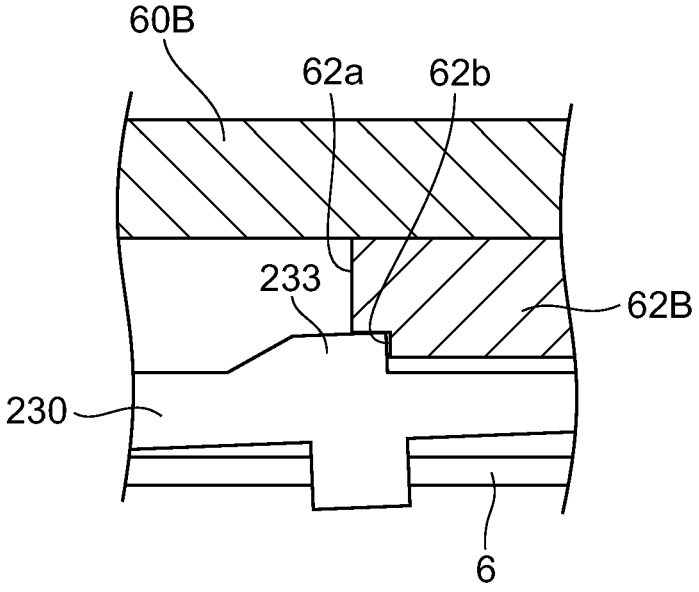

FIG. 20 is an enlarged view of a portion of the cam group. FIGS. 21A and 21B are partial cross-sectional views of the cam 62. Referring to FIG. 20, the first cam 62B is provided with a stepped portion 62*b* for the third stitch at a portion adjacent to the actuator 50. More specifically, the stepped portion 62*b* is arranged on the radially inner side of the cam 62B so as to be located on both sides of the actuator 50 in the circumferential direction, as shown in FIG. 20. As shown in FIGS. 21A and 21B, the stepped portion 62B is arranged to be concave toward the radially outside.

FIG. 21A shows a state where the selector boss 233 of the selector jack 230 is in contact with a front surface (radially inner surface) 62*a* of the first cam 62B, while FIG. 21B shows a state where the selector boss 233 is in contact with the stepped portion 62*b* of the first cam 62B. As shown in FIGS. 21A and 21B, the selector boss 233 is located at a radially outer position in the state of FIG. 21B than in the state of FIG. 21A.

Figure 22A:
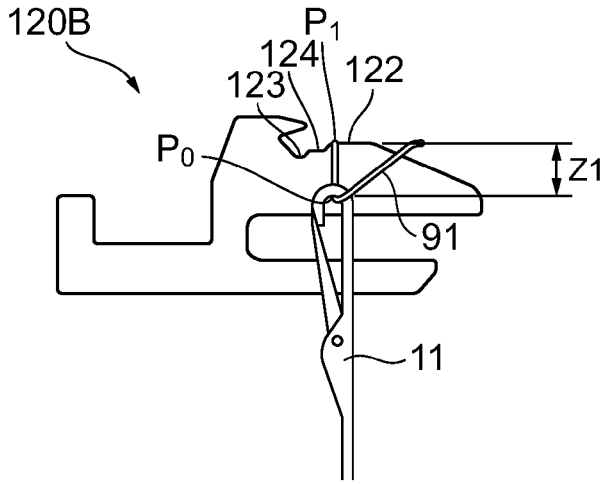
FIGS. 22A, 22B and 22C are side views of the sinker according to the second preferred embodiment of the present invention, showing how to hold yarn during formation of a first stitch, a second stitch, and a third stitch, respectively.
Figure 22B:
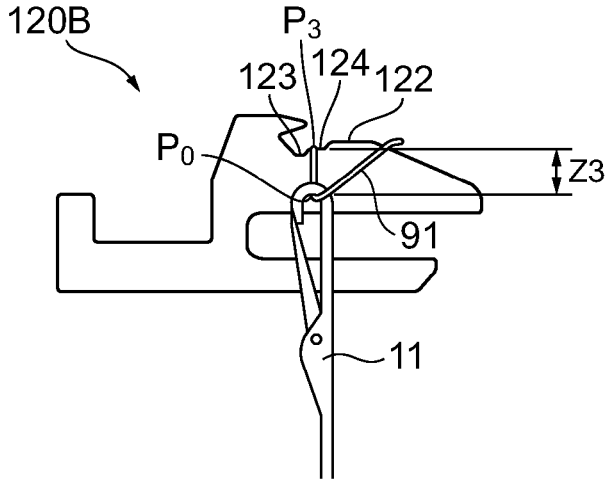

Next, referring to FIGS. 22A and 22B, states where the sinker 120B holds yarn 91 are described. FIG. 22A shows a state where the first sinker top 122 of the sinker 120B holds the yarn 91. When the knitting needle 11 draws in the yarn 91 while the first sinker top 122 holds the yarn 91, the first stitch 101 (having a normal stitch length Z1) is formed.

FIG. 22B shows a state where the third sinker top 124 of the sinker 120B holds the yarn 91. When the knitting needle 11 draws in the yarn 91 while the third sinker top 124 holds the yarn 91, the third stitch 103 (having a middle stitch length Z3) is formed.

Figure 22C:
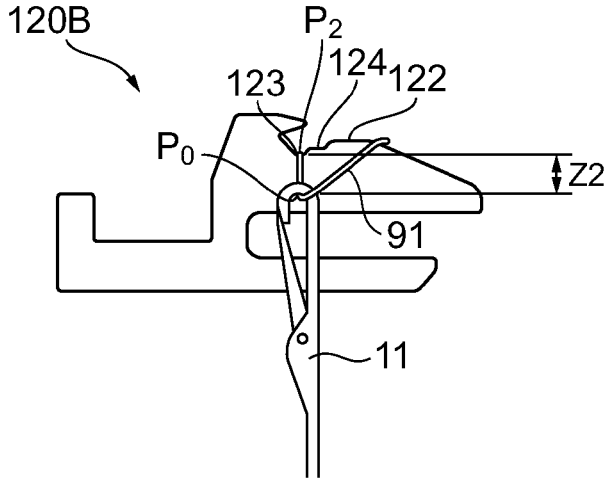

FIG. 22C shows a state where the second sinker top 123 of the sinker 120B holds the yarn 91. When the knitting needle 11 draws in the yarn 91 while the second sinker top 123 holds the yarn 91, the second stitch 102 (having a small stitch length Z2) is formed. The height difference (Z1−Z2) between the position at which the first sinker top 122 holds the yarn 91 during formation of the first stitch and the position at which the second sinker top 123 holds the yarn during formation of the second stitch preferably is about 0.1 mm to about 2.0 mm, for example.

Next, operations of the circular knitting machine 1B of this preferred embodiment are described, mainly referring to FIGS. 23A to 30B showing a cross section of a portion of the stitch forming device in which the selector jack 230AD (230) is arranged.

(Operation for Forming the First Stitch: Forward Rotation)

While the cylinder 2 and the sinker bed 6 rotate in the counterclockwise direction in FIG. 19, stitches are formed. In this description, the rotation in the counterclockwise direction in FIG. 19 is referred to as forward rotation. The sinkers 120B and the selector jacks 230 rotate together with the sinker bed 6. The sinker 120B and the selector jack 230 move from rotational positions A to G in that order.

Figure 23A:
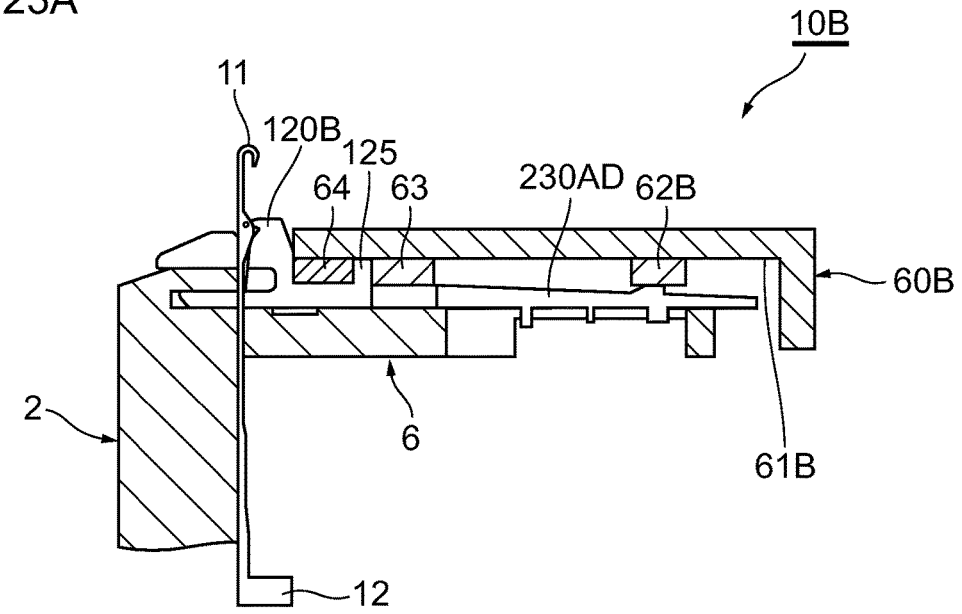
FIGS. 23A and 23B are cross-sectional views of the stitch forming device and the sinker cap, taken along a line O-A and a line O-B in FIG. 19, respectively.

FIG. 23A shows a state where the sinker 120B and the selector jack 230AD are located at the rotational position A, i.e., on the line O-A in FIG. 19. At the rotational position A, the sinker 120B and the selector jack 230 are spaced away from each other in the radial direction, that is, are not in contact with each other. The movement of the butt 125 of the sinker 120B in the radial direction is limited by the second cam 63 and the third cam 64. As the knitting-needle cylinder 2 rotates in the direction X, the sinker 120B and the selector jack 230 move from the rotational position A to the rotational position B. During this movement, the knitting-needle butt 12 integrally formed with the knitting needle 11 is subjected to the stitch cam 80 (see FIG. 2) and therefore the knitting needle 11 is moved upward. Thus, the yarn forming a new loop is held by the knitting needle 11. When the sinker 120B and the selector jack 230 have reached the rotational position B, the knitting-needle butt 12 is subjected to the action of the stitch cam 80 and therefore the knitting needle 11 holding the yarn starts moving down.

Figure 23B:
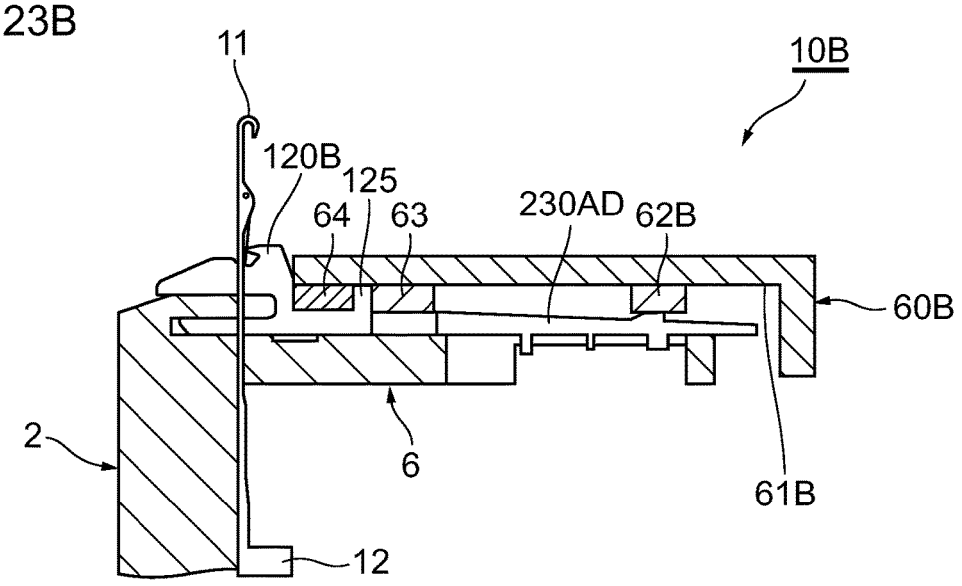

FIG. 23B shows a state where the sinker 120B and the selector jack 230 are located at the rotational position B, i.e., on the line O-B in FIG. 19. At the rotational position B, the sinker 120B and the selector jack 230 are spaced away from each other in the radial direction, that is, are not in contact with each other. The movement of the butt 125 of the sinker 120B in the radial direction is limited by the second cam 63 and the third cam 64. At the rotational position B, the knitting needle 11 is higher than at the rotational position A.

Figure 24A:
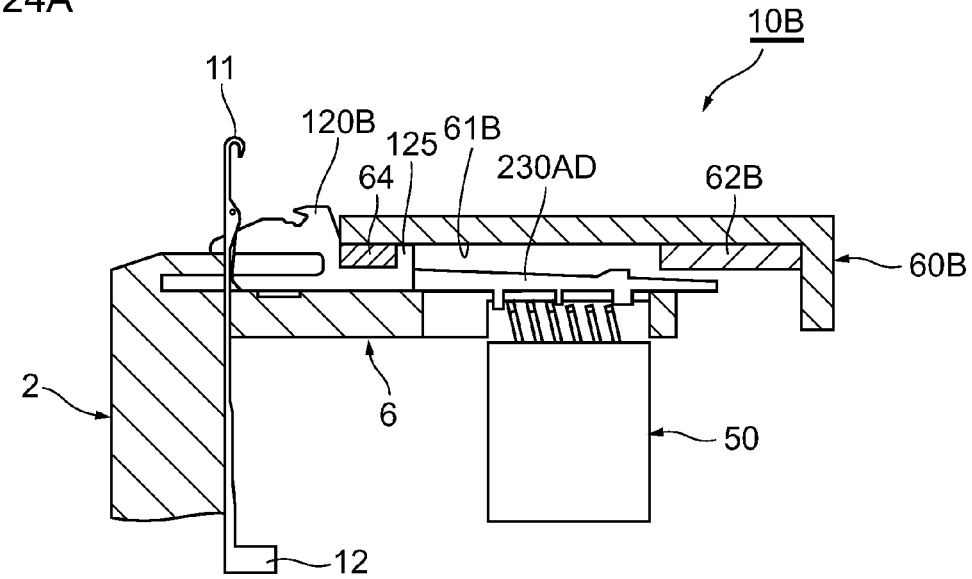
FIGS. 24A and 24B are cross-sectional views of the stitch forming device and the sinker cap, taken along a line O-C and a line O-D in FIG. 19, respectively.

FIG. 24A shows a state where the sinker 120B and the selector jack 230 are located at the rotational position C, i.e., on the line O-C in FIG. 19. The selector jack 230 is located above the actuator 50. The heads 51 to 56 of the actuator 50 are tilted, so they are not in contact with the selector butt 232 of the selector jack 230AD. Therefore, the actuator 50 does not act on the selector jack 230AD.

The sinker 120B moves backward while moving from the rotational position B to the rotational position C, because the movement thereof in the radial direction is limited by the third cam 64.

Figure 24B:
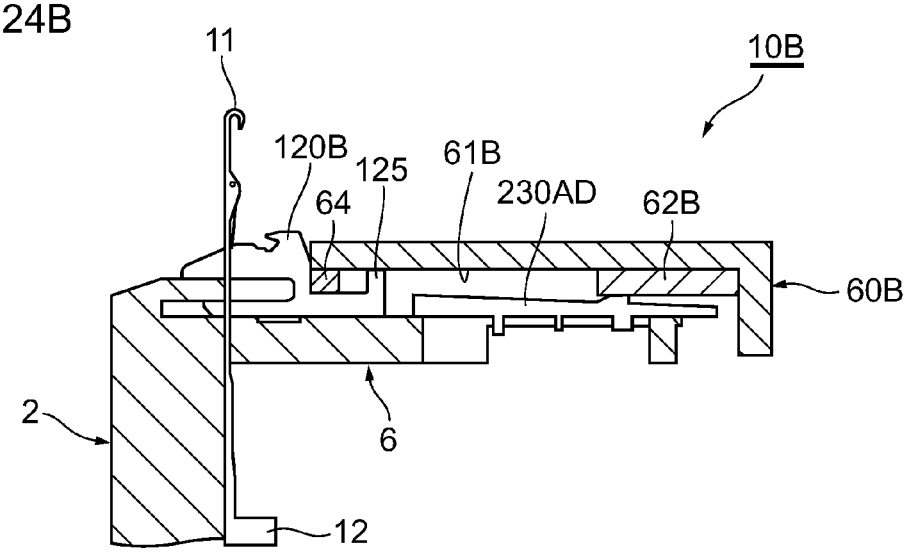

FIG. 24B shows a state where the sinker 120B and the selector jack 230AD are located at the rotational position D, i.e., on the line O-D in FIG. 19. The sinker 120B moves forward while moving from the rotational position C to the rotational position D, because the movement thereof in the radial direction is limited by the third cam 64.

Figure 25A:
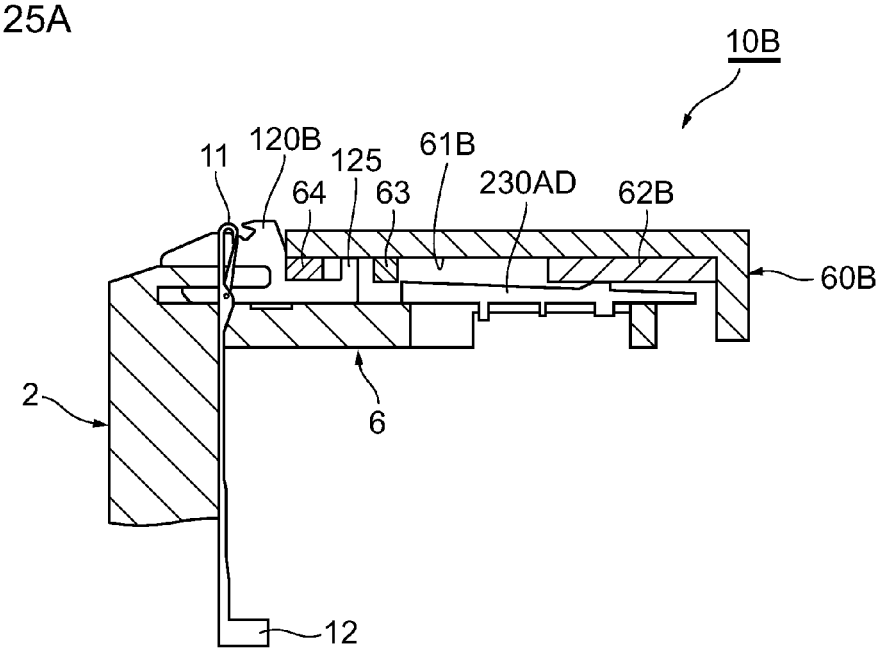
FIGS. 25A and 25B are cross-sectional views of the stitch forming device and the sinker cap, taken along a line O-E and a line O-F in FIG. 19, respectively.

FIG. 25A shows a state where the sinker 120B and the selector jack 230 are located at the rotational position E, i.e., on the line O-E in FIG. 19. The movement of the sinker 120B in the radial direction is limited by the third cam 64. The sinker 120B moves to a position at which the first sinker top 122 can hold the knitting yarn 91 (see FIG. 22A). That is, the sinker 120B holds the knitting yarn 91 with the first sinker top 122.

Figure 25B:
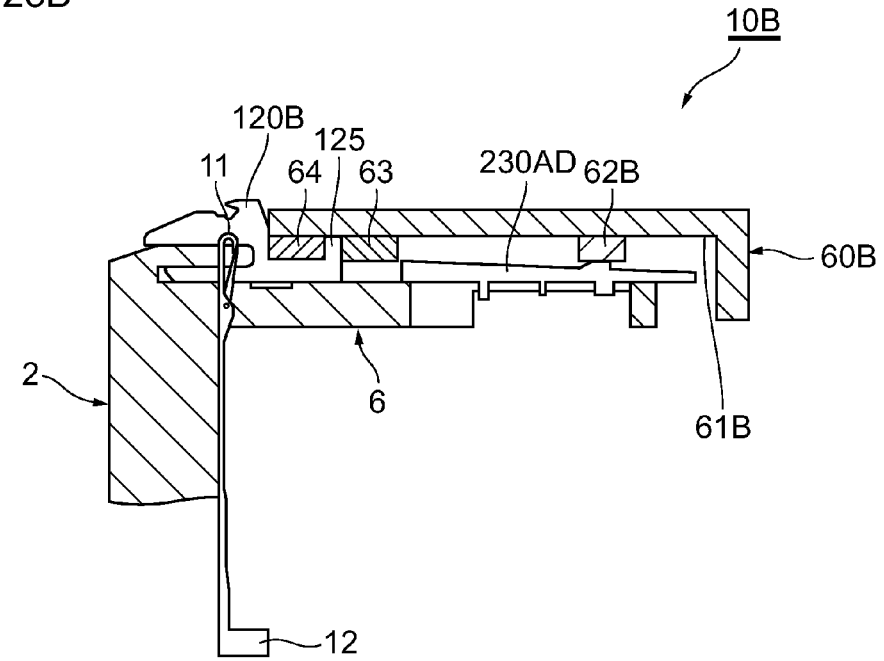

FIG. 25B shows a state where the sinker 120B and the selector jack 230AD are located at the rotational position F, i.e., on the line O-F in FIG. 19. While the first sinker top 122 holds the knitting yarn 91, the knitting needle 11 goes down to drawn in the knitting yarn so as to form the first stitch.

Figure 26:
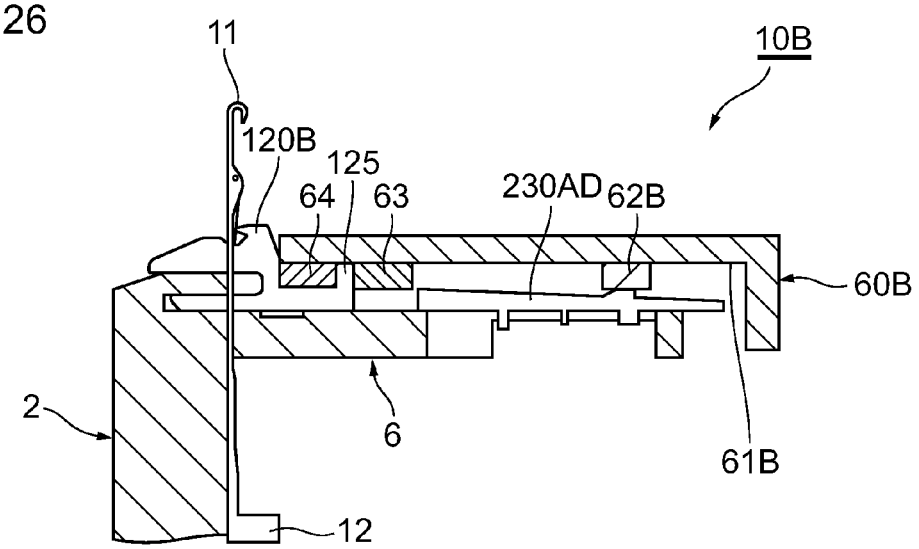
FIG. 26 is a cross-sectional view of the stitch forming device and the sinker cap, taken along a line O-G in FIG. 19.

FIG. 26 shows a state where the sinker 120B and the selector jack 230AD are located at the rotational position G, i.e., on the line O-G in FIG. 19. The knitting needle 11 goes upward while moving from the rotational position F to the rotational position G. The knitting yarn caught by the knitting needle 11 falls out of the knitting needle 11.

(Operation for Forming the Second Stitch: Forward Rotation)

At the rotational positions A and B, the operation for forming the first stitch and that for forming the second stitch are substantially the same as each other.

Figure 27A:
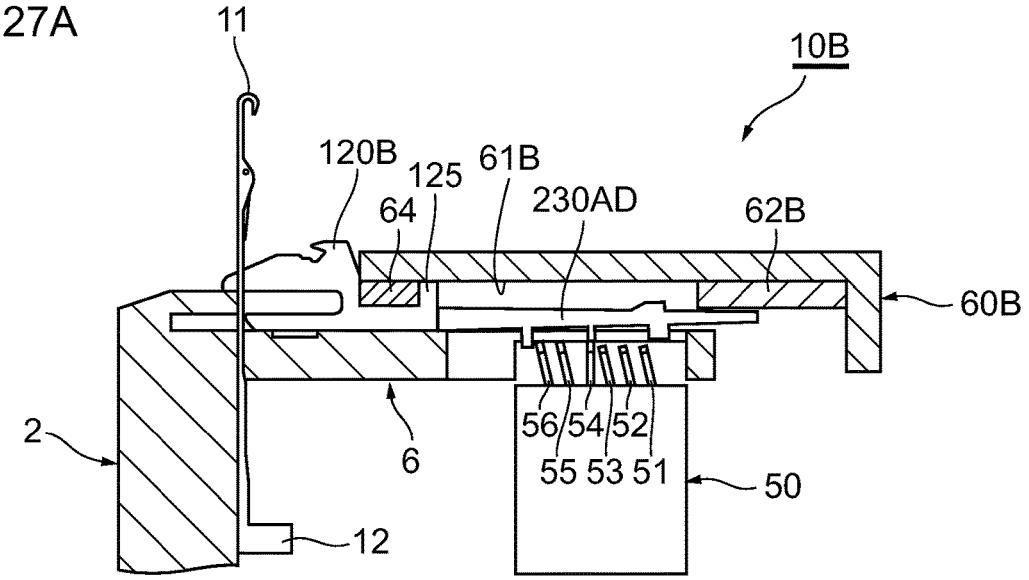
FIGS. 27A and 27B are cross-sectional views of the stitch forming device and the sinker cap, taken along the line O-C and the line O-D in FIG. 19, respectively.

FIG. 27A shows a state where the sinker 120B and the selector jack 230AD are located at the rotational position C. At the rotational position C, the selector jack 230AD is arranged above the actuator 50, and the head 54 of the actuator 50 stands substantially straight and is in contact with the selector butt 232*d* of the selector jack 230AD. The actuator 50 acts on the selector jack 230AD.

The selector jack 230 comes into contact with the head 54 and is pushed upward (see FIG. 6B). The rear end of the sinker 120B is in contact with the leading end of the selector jack 230AD.

Figure 27B:
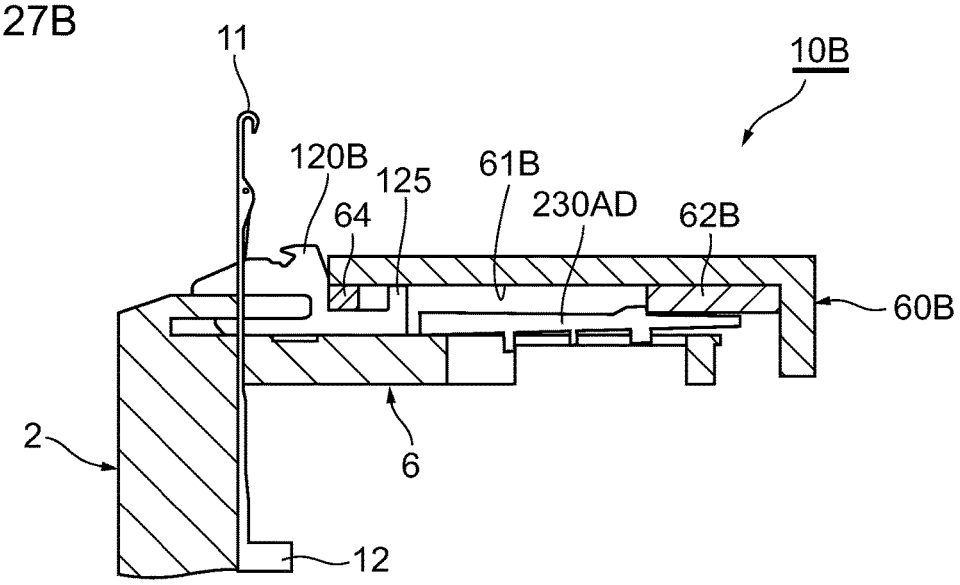

FIG. 27B shows a state where the sinker 120B and the selector jack 230AD are located at the rotational position D. The selector jack 230AD goes forward while moving from the rotational position C to the rotational position D, because the movement thereof is limited by the first cam 62B.

Figure 28A:
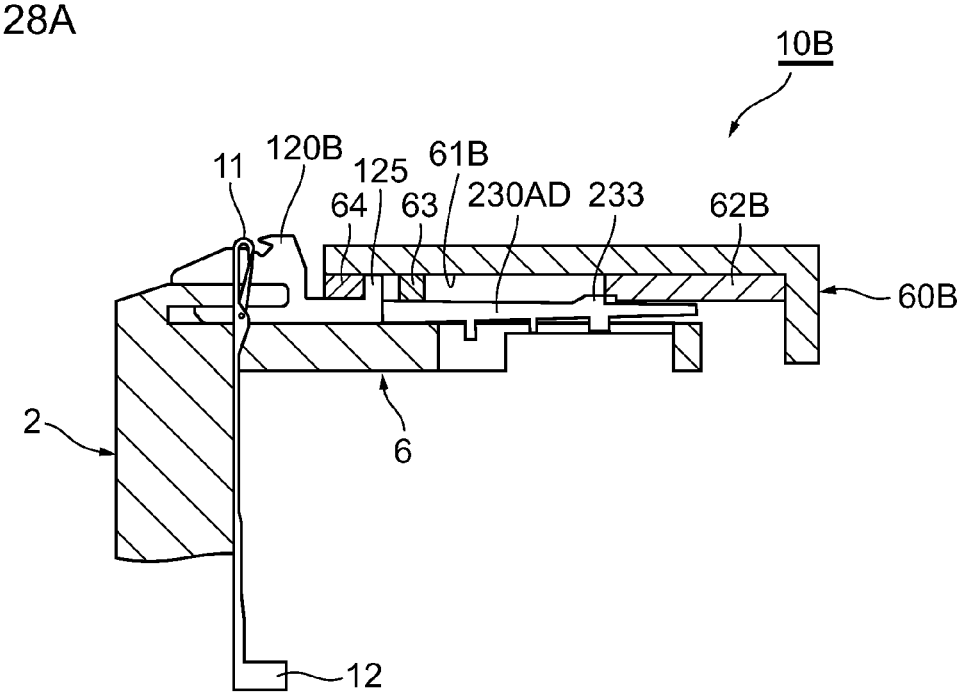
FIGS. 28A and 28B are cross-sectional views of the stitch forming device and the sinker cap, taken along the line O-E and the line O-F in FIG. 19, respectively.

FIG. 28A shows a state where the sinker 120B and the selector jack 230AD are located at the rotational position E. The selector jack 230AD moves forward while moving from the rotational position D to the rotational position E, because the movement thereof in the radial direction is limited by the first cam 62B. The selector boss 233 comes into contact with the first cam 62B (shown in FIG. 21A) to make the selector jack 230 go forward so as to push out the sinker 120B. Thus, the sinker 120B moves to such a position that the second sinker top 123 can hold the knitting yarn 91 (see FIG. 22C). The sinker 120B holds the knitting yarn 91 with the second sinker top 123.

Figure 28B:
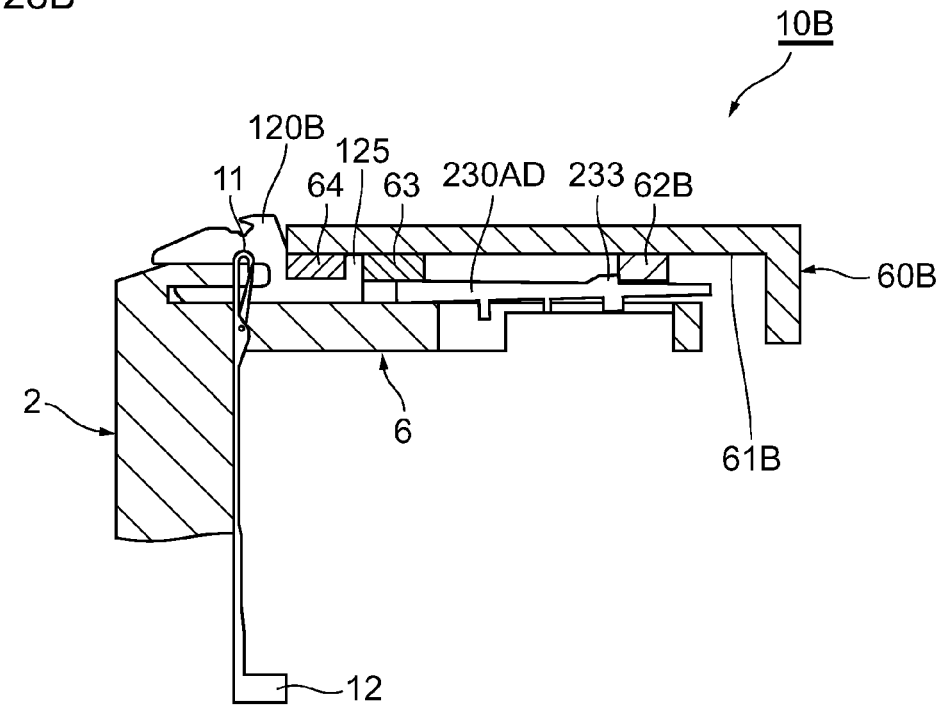

FIG. 28B shows a state where the sinker 120B and the selector jack 230AD are located at the rotational position F. While the second sinker top 123 holds the knitting yarn, the knitting needle 11 moves down and draws the knitting yarn in so as to form the second stitch. As shown in FIGS. 22A and 22B, because of the height difference (Z1>Z3>Z2) of the knitting yarn held by the sinker 120B, it is possible to provide a stitch size difference.

The knitting needle 11 moves upward during movement from the rotational position F to the rotational position G. The knitting yarn caught by the knitting needle 11 falls out of the knitting needle 11.

(Operation for Forming the Third Stitch: Forward Rotation)

At the rotational positions A and B, the operations for forming the first and second stitches and that for forming the third stitch are substantially the same as each other.

Figure 29A:
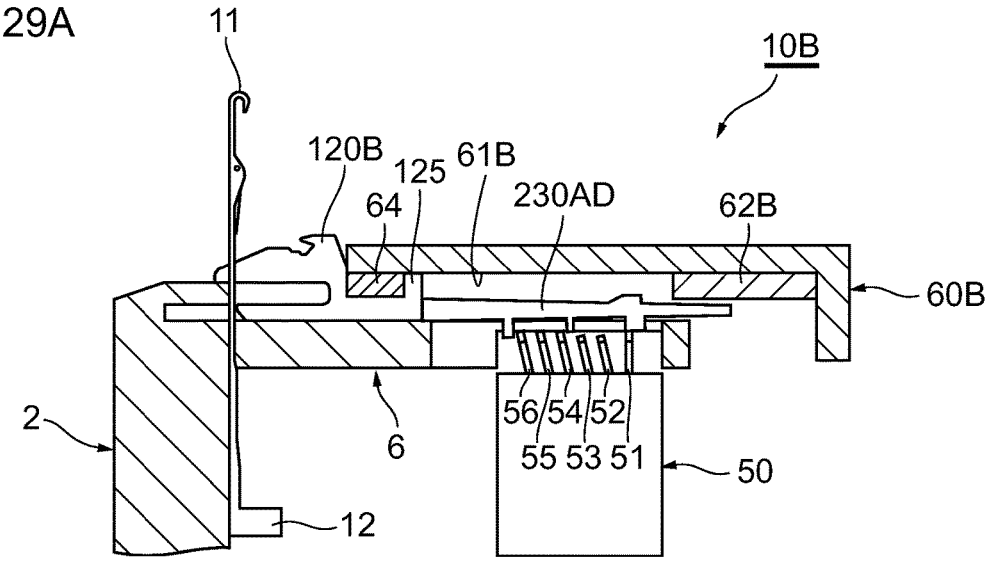
FIGS. 29A and 29B are cross-sectional views of the stitch forming device and the sinker cap, taken along the line O-C and the line O-D in FIG. 19, respectively.

FIG. 29A shows a state where the sinker 120B and the selector jack 230AD are located at the rotational position C. At the rotational position C, the selector jack 230AD is arranged above the actuator 50, and the head 51 of the actuator 50 stands substantially straight and is in contact with the selector butt 232*a*. Thus, the actuator 50 acts on the selector jack 230AD.

The selector jack 230AD comes into contact with the head 51 and is pushed upward (see FIG. 6B). The rear end of the sinker 120B is in contact with the leading end of the selector jack 230AD. Please note that the selector butt 132*a* used for forming the third stitch is shorter than the selector butt used for forming the second stitch in the vertical direction. Thus, the amount by which the selector jack 230AD is moved upward by the contact of the selector butt 232*a* with the actuator 50 is smaller than the amount by which the selector jack 230AD is moved during formation of the second stitch.

Figure 29B:
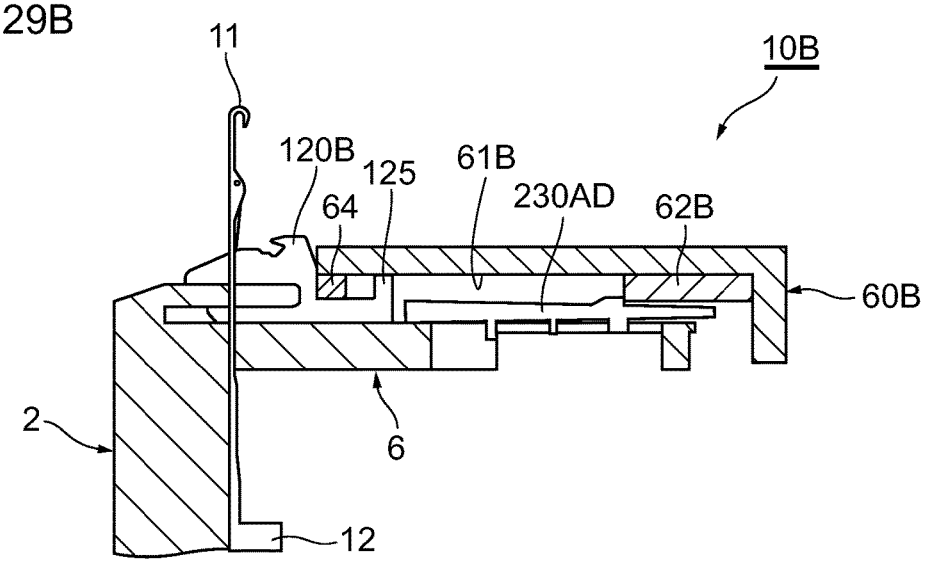

FIG. 29B shows a state where the sinker 120B and the selector jack 230AD are located at the rotational position D. The selector jack 230AD moves forward while moving from the rotational position C to the rotational position D, because the movement thereof in the radial direction is limited by the first cam 62B.

Figure 30A:
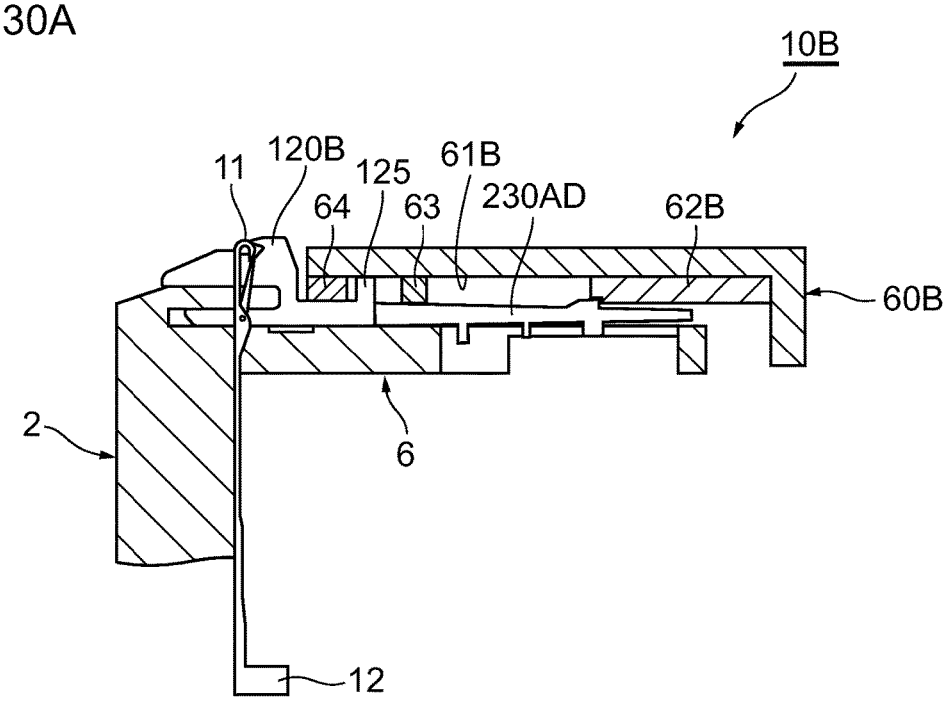
FIGS. 30A and 30B are cross-sectional views of the stitch forming device and the sinker cap, taken along the line O-E and the line O-F in FIG. 19, respectively.

FIG. 30A shows a state where the sinker 120B and the selector jack 230AD are located at the rotational position E. The selector jack 230AD moves forward while moving from the rotational position D to the rotational position E, because the movement thereof in the radial direction is limited by the first cam 62B. The selector boss 233 comes into contact with the stepped portion 62*b* of the first cam 62B (see FIG. 21B) to move the selector jack 230AD forward and to push out the sinker 120B. Thus, the sinker 120B moves to such a position that the third sinker top 124 can hold the knitting yarn 91 (see FIG. 22B). The sinker 120B holds the knitting yarn with the third sinker top 124.

Figure 30B:
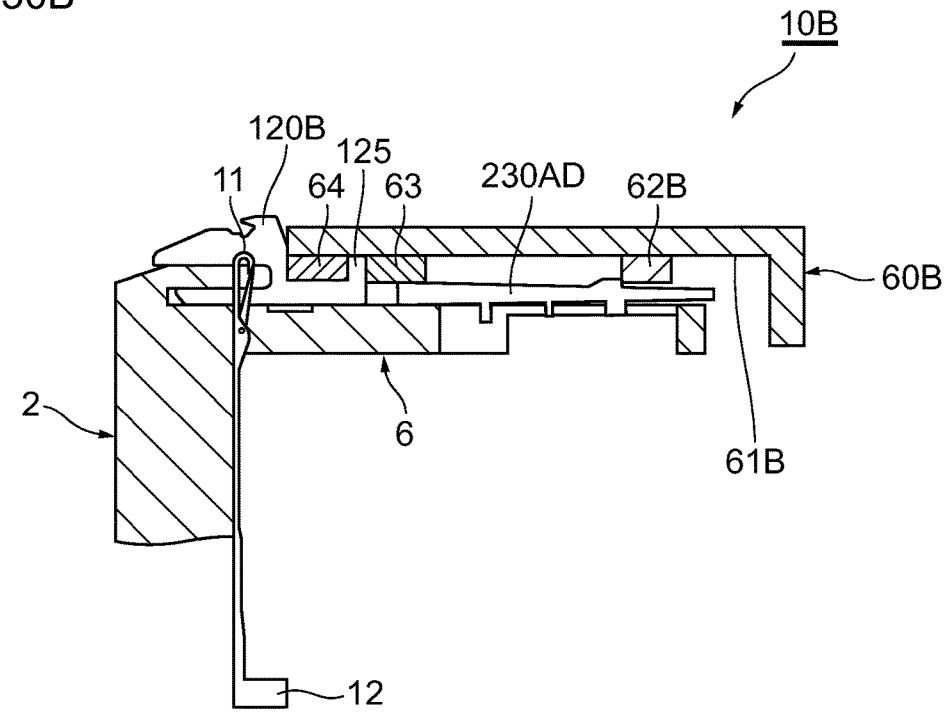
Figure 31A:
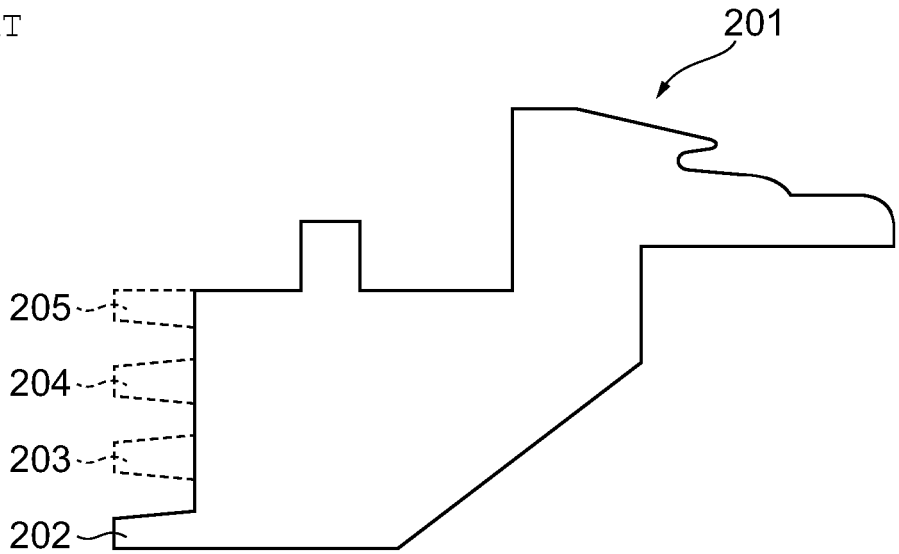
Fig. 31A PRIOR ART
FIGS. 31A and 31B show an exemplary conventional sinker and an exemplary conventional actuator.
Figure 31B:
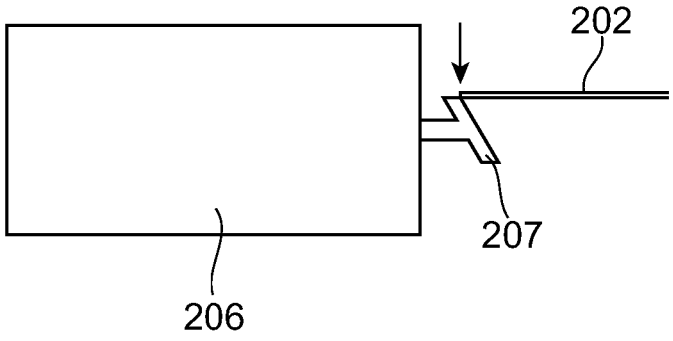
Fig. 31B PRIOR ART

FIG. 30B shows a state where the sinker 120B and the selector jack 230AD are located at the rotational position F. While the third sinker top 124 holds the knitting yarn, the knitting needle 11 moves down and draws the knitting yarn in, so as to form the third stitch. As shown in FIGS. 22A, 22B, and 22C, because of the height difference (Z1>Z3>Z2) of the knitting yarn held by the sinker 120B, it is possible to provide a stitch size difference.

The knitting needle 11 moves upward while moving from the rotational position F to the rotational position G. The knitting yarn caught by the knitting needle 11 falls out of the knitting needle 11.

According to the circular knitting machine 1B of this preferred embodiment, the sinker 120B and the selector jack 230 preferably are separate components, and the selector butt is provided in the selector jack 230 provided on the rear side of the sinker 120B. Therefore, the selector butts 232 of the different steps can be arranged in the radial direction. This enables the arrangement which can correspond to high-speed rotation to be provided. Thus, even in a case of high-speed rotation, an appropriate selector butt 232 can be reliably selected.

Moreover, cooperation of the actuator 50, the selector jack 230, and the first cam 62B with one another enables the amount of movement of the sinker 120B to be changed. Because the sinker 120B includes the first sinker top 122, the second sinker top 123, and the third sinker top 124, changing the position of the sinker 120B can change the position at which the knitting yarn is held, thus realizing three-step stitch-size control which forms large, medium, and small size stitches.

Third Preferred Embodiment

Next, a circular knitting machine according to the third preferred embodiment of the present invention is described. The same description as that of the first preferred embodiment is omitted. The circular knitting machine of the third preferred embodiment is a multi-pile knitting machine which can provide different pile lengths of stitches and, more specifically, can form knit fabric in which three types of knitting structures including a plain stitch, a high-pile stitch, and a low-pile stitch are selectively arranged on a stitch-by-stitch basis.

Figure 32:
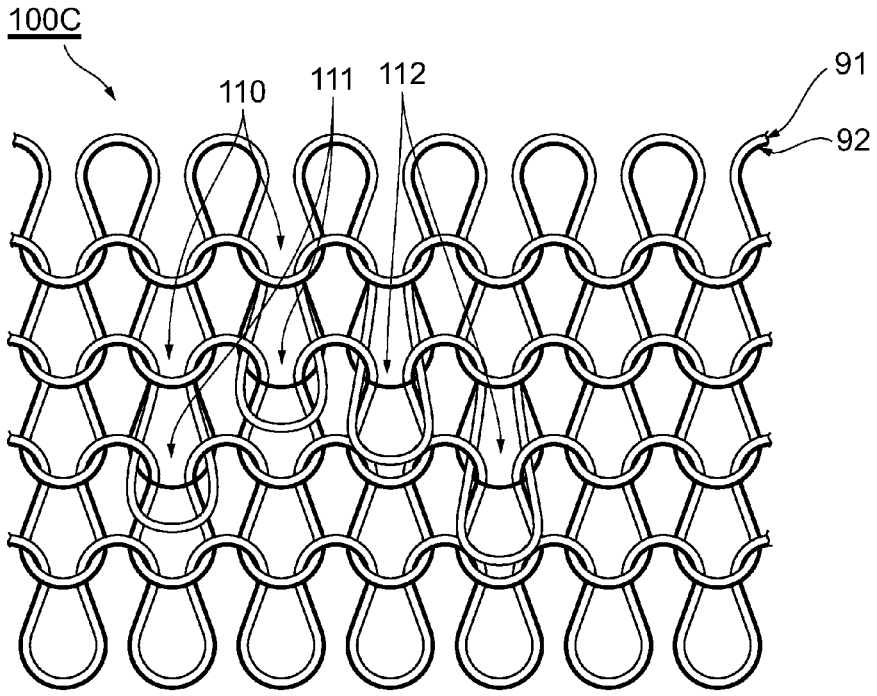
FIG. 32 shows exemplary knitting structures which can be formed by a circular knitting machine according to a third preferred embodiment of the present invention.

FIG. 32 shows exemplary knitting structures which can be formed by the circular knitting machine of this preferred embodiment. The knitting structure in which pile yarn 91 and ground yarn 92 are knitted together and the sinker-loop lengths of the pile yarn 91 and the ground yarn 92 are the same is called a plain stitch 110; the knitting structure in which the sinker loop of the pile yarn 91 is longer than that of the ground yarn 92 is called a low-pile stitch (also referred to as a short-pile stitch) 111; and the knitting structure in which the sinker loop of the pile yarn 91 is even longer than that of the ground yarn 92 is called a high-pile stitch (also referred to as a long-pile stitch) 112.

The circular knitting machine 1C according to the third preferred embodiment is now described. As shown in FIG. 2, the circular knitting machine 1C of the third preferred embodiment includes a needle cylinder 2 supported by a stand (not shown) to be rotatable, atop cylinder 4 attached inside the upper portion of the needle cylinder 2, a disk-shaped sinker bed 6 arranged outside the upper portion of the needle cylinder 2, and a stitch forming device 10C arranged to move a pair of sinkers 20 described later to/from between reciprocating knitting needles 11 to form a plurality of knitting structures.

The needle cylinder 2 is a substantially tubular component of the circular knitting machine 1C and is arranged to accommodate knitting needles 11 therein. The outer peripheral surface of the needle cylinder 2 includes a number of vertical slits 3 in which the knitting needles 11 are to be arranged therein to be slidable in the vertical direction. The vertical slits 3 are arranged to be equally spaced therebetween in the circumferential direction. The density of the vertical slits 3 on the needle cylinder 2 preferably is from 5 to 24 per inch in the circumferential direction, for example.

The top cylinder 4 is arranged to be rotatable together with the needle cylinder 2 and includes a plurality of horizontal slits 5 that guide a pair of sinkers 20, the details of which is described later. The horizontal slits 5 are arranged to extend along the radial direction of the needle cylinder 2 (hereinafter, simply referred to as "radial direction"). The horizontal slits 5 are formed between the vertical slits 3 of the needle cylinder 2, when seen from above in the vertical direction. That is, when seen from above in the vertical direction, the horizontal slits 5 and the vertical slits 3 are alternately arranged along the circumferential direction.

The sinker bed 6 is a substantially tubular component arranged to accommodate a pair of sinkers 20 described later, a pair of selector jacks 30, and a separator 40. The sinker bed 6 is arranged to be rotatable together with the needle cylinder 2 and includes a plurality of horizontal slits 7 in which the pair of sinkers 20, the pair of selector jacks 30 and the separator 40 are to be arranged to extend along the radial direction. The number of the horizontal slits 7 formed in the sinker bed 6 is preferably the same as the number of the horizontal slits 5 of the top cylinder 4, and each of the horizontal slits 7 and the corresponding horizontal slit 5 are arranged in the same radially extending line.

The stitch forming device 10C (see FIG. 37A and FIGS. 40A, 40B and 40C) includes a pair of sinkers 20, a pair of selector jacks 30, a separator 40, an actuator 50 and a sinker cap 60C. The sinkers 20, i.e., a low-pile sinker 21 and a high-pile sinker 25 are arranged to hold pile yarn 91 and ground yarn 92, respectively, when the pile yarn 91 and the ground yarn 92 for forming a new loop are drawn into an old loop. The selector jacks 30, i.e., a low-pile selector jack 31 and a high-pile selector jack 35 are arranged to selectively move the corresponding sinkers 20 forward. The separator 40 is arranged to prevent the low-pile sinker 31 and the low-pile selector jack 31 from adhering to the high-pile sinker 25 and the high-pile selector jack 35. The actuator 50 is arranged to selectively act on each of the selector jacks 30 in response to a signal input from the outside (not shown). The sinker cap 60C includes a group of cams including the first cam 62 that moves the selector jack 30 subjected to the action of the actuator 50 toward between knitting needles 11.

Figure 33A:
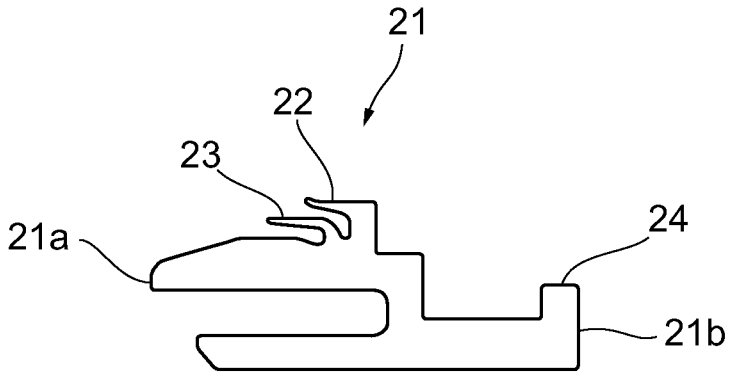
FIGS. 33A and 33B are side views of a low-pile sinker and a high-pile sinker in the third preferred embodiment of the present invention, respectively.
Figure 33B:
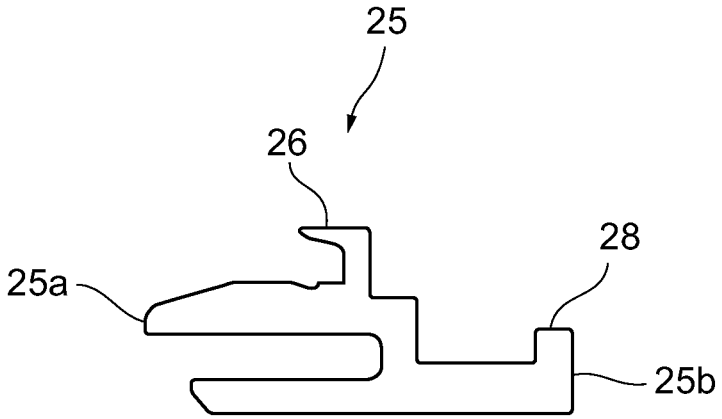

FIG. 33A is a side view of the low-pile sinker 21 and FIG. 33B is a side view of the high-pile sinker 25. The pair of sinkers 20 includes a low-pile sinker 21 including a low-pile nib 22 and a small nib 23, as shown in FIG. 33A, and a high-pile sinker 25 including a high-pile nib 26, as shown in FIG. 33B. Each of the low-pile sinker 21 and the high-pile sinker 25 preferably includes a plate-shaped member. The low-pile nib 22 and the high-pile nib 26 are arranged to hold pile yarn 91 during stitch formation, and the small nib 23 is to hold at least ground yarn 92. The low-pile sinker 21 and the high-pile sinker 25 are preferably about 0.2 mm to about 0.8 mm in thickness and formed by a steel member, for example.

Figure 34:
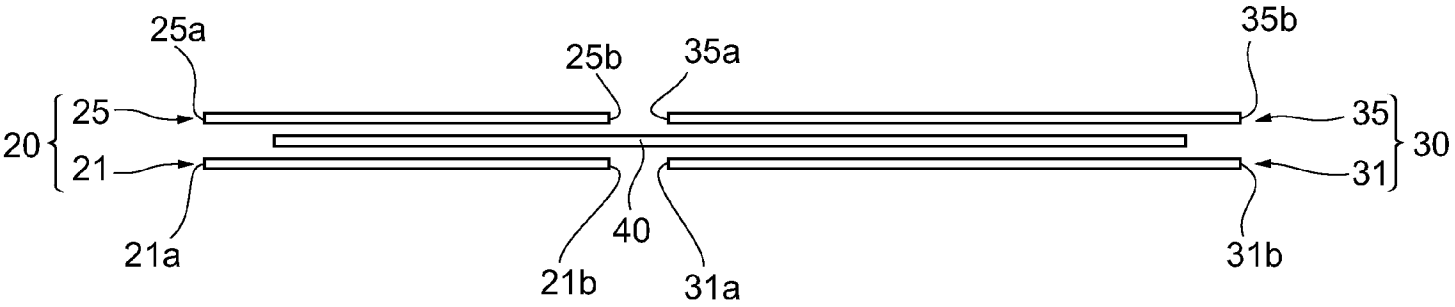
FIG. 34 shows an arrangement of sinkers, selector jacks, and a separator in the third preferred embodiment of the present invention.

FIG. 34 shows an arrangement of the sinkers 20 (21 and 25), the selector jacks 30 (31 and 35) and the separator 40. The low-pile sinker 21 and the high-pile sinker 25 are accommodated in the horizontal slits 7 formed in the sinker bed 6, and are arranged to extend along their moving direction to be opposed to each other with the separator 40 therebetween, as shown in FIG. 34. Also, the low-pile sinker 21 and the high-pile sinker 25 are arranged so that leading ends 21*a* and 25*a* thereof can be moved in and from between knitting needles 11. The rear ends 21*b* and 25*b* of the sinkers 21 and 25 include butts 24 and 28, respectively, as shown in FIGS. 33A and 33B. The butts 24 and 28 are arranged to be acted on the second cam 63 and the third cam 64 as described later. Please note that the horizontal direction in FIG. 34 coincides with the radial direction of the sinker bed 6 in FIG. 2 and left in FIG. 34 corresponds to the radially inside in FIG. 2.

The pair of selector jacks 30 includes a low-pile selector jack 31 which is arranged on the rear end 21*b* side (i.e., radially outside) of the low-pile sinker 21 and a high-pile selector jack 35 which is arranged on the rear end 25*b* side (i.e., radially outside) of the high-pile sinker 25. Each of the low-pile selector jack 31 and the high-pile selector jack 35 preferably include a plate-shaped member. The low-pile selector jack 31 and the high-pile selector jack 35 preferably are about 0.2 mm to about 0.8 mm in thickness, and formed of steel, for example.

The low-pile selector jack 31 and the high-pile selector jack 35 are accommodated in the horizontal slits 7 of the sinker bed 6, are arranged to extend along the direction in which they are moved, and are opposed to each other with the separator 40 therebetween.

Figure 35A:
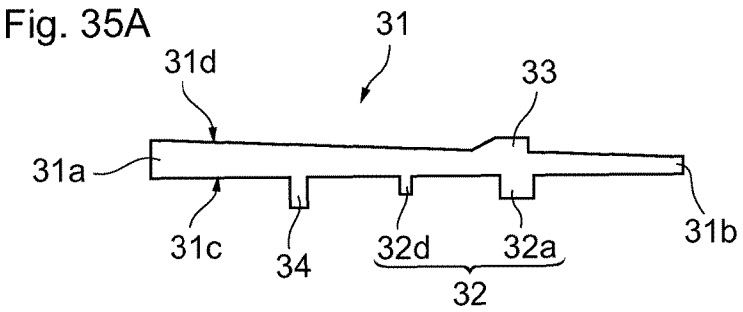
FIGS. 35A, 35B, 35C, 35D, 35E, and 35F show types of low-pile selector jacks and high-pile selector jacks used in the third preferred embodiment of the present invention.
Figure 35B:
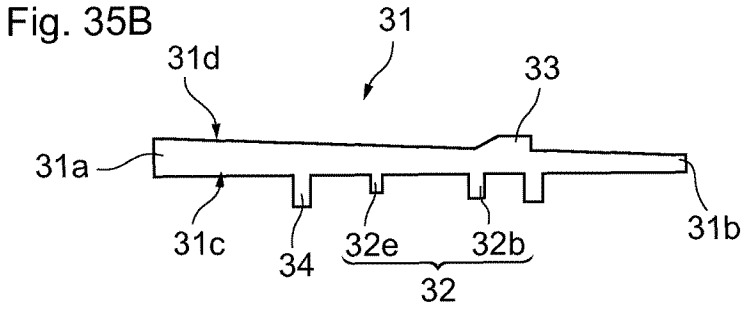
Figure 35C:
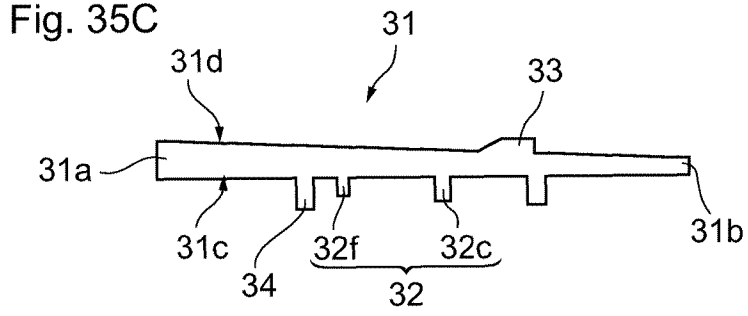
Figure 35D:
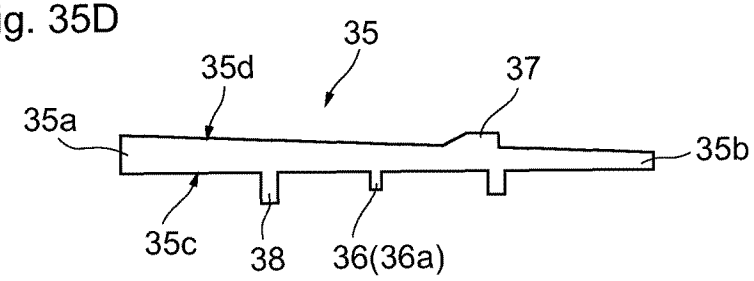
Figure 35E:
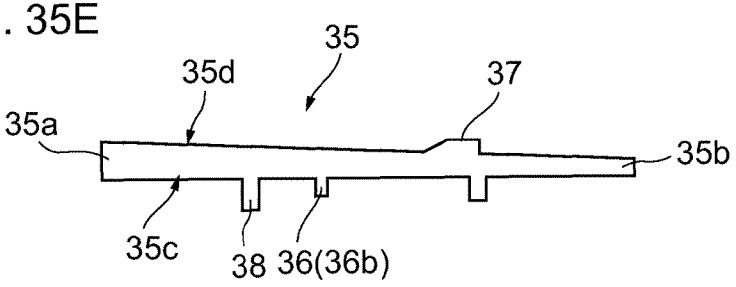
Figure 35F:
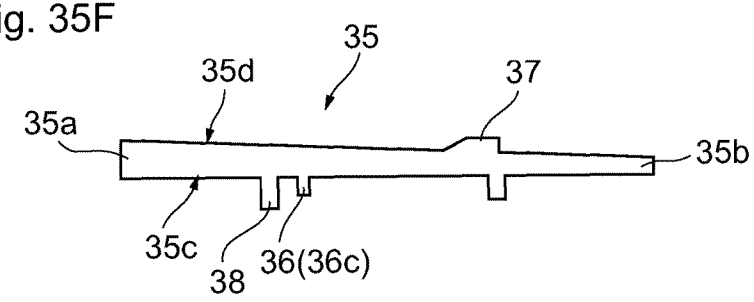

FIGS. 35A to 35F are side views of the selector jacks, showing the types of the low-pile selector jacks and the high-pile selector jacks used in this preferred embodiment of the present invention. FIGS. 35A, 35B, and 35C show the low-pile selector jacks 31, and FIGS. 35D, 35E, and 35F show the high-pile selector jacks 35. The low-pile selector jack 31 includes selector butts 32. More specifically, in this preferred embodiment, each low-pile selector jack 31 includes two selector butts 32*a* and 32*d*, 32*b* and 32*e*, or 32*c* and 32*f*, as shown in FIGS. 35A, 35B, and 35C. The high-pile selector jack 35 includes one selector butt 36. That is, the high-pile selector jack 35 includes a selector butt 36*a*, 36*b*, or 36*c*, as shown in FIGS. 35D, 35E, and 35F. The selector butts 32 and 36 are portions arranged to be subjected to the action of the actuator 50.

The low-pile selector jack 31 includes the aforementioned selector butts 32, a leading end 31*a* as a portion which can push the low-pile sinker 21 arranged inside the low-pile selector jack 31 in the radial direction, a rear end 31*b* that is an opposite end to the leading end 31*a*, and a butt 34 arranged to be subjected to the action of the fifth cam 66 described later. The selector butts 32 are arranged to project downward from the bottom 31*c* of an extending portion of the low-pile selector jack 31 between the leading end 31*a* and the rear end 31*b*. Similarly, the high-pile selector jack 35 includes the aforementioned selector butt 36, a leading end 35*a* as a portion which can push the high-pile sinker 25 arranged inside the high-pile selector jack 35 in the radial direction, a rear end 35*b* that is an opposite end to the leading end 35*a*, and a butt 38 arranged to be subjected to the action of the fifth cam 66 described later. The selector butt 36 is arranged to project downward from the bottom 35*c* of an extending portion of the high-pile selector jack 35 between the leading end 35*a* and the rear end 35*b*. Moreover, the top 31*d* of the extending portion of the low-pile selector jack 31 and the top 35*d* of the extending portion of the high-pile selector jack 35 are respectively provided with selector bosses 33 and 37 arranged to be subjected to the action of the first cam 62 described later. The selector bosses 33 and 37 are opposed to the first cam 62. The selector bosses 33 and 37 are arranged to project upward from the tops 31*d* and 35*d*.

Referring to FIG. 2 and FIGS. 35A to 35F, in the first horizontal slit 7 (shown with 701) of the sinker bed 6 shown in FIG. 2, a pair of sinkers 20; the low-pile selector jack 31 including the selector butts 32*a* and 32*d* shown in FIG. 35A which respectively serve as the first-step selector butt 32*a* and the fourth-step selector butt 32*d*; the high-pile selector jack 35 including the selector butt 36*a* shown in FIG. 35D, which serves as the fourth-step selector butt; and the separator 40 described later are inserted.

Similarly, in the second horizontal slit 7 (702) of the sinker bed 6 shown in FIG. 2, a pair of sinkers 20; the low-pile selector jack 31 including the selector butt 32*b* as the second-step selector butt and the selector butt 32*e* as the fifth-step selector butt shown in FIG. 35B; the high-pile selector jack 35 including the selector butt 36*b* as the fifth-step selector butt shown in FIG. 35E; and the separator 40 described later are inserted.

In the third horizontal slit 7 (703) of the sinker bed 6 shown in FIG. 2, a pair of sinkers 20; the low-pile selector jack 31 including the selector butts 32*c* and 32*f* as the third-step and sixth-step selector butts shown in FIG. 35C; the high-pile selector jack 35 including the selector butt 36*c* as the sixth-step selector butt shown in FIG. 35F; and the separator 40 described later are inserted.

From the fourth horizontal slit 7 (704) of the sinker bed 6 in FIG. 2, the arrangement mentioned above in connection with the first to third horizontal slits 701 to 703 is repeated. In this description, the example is described in which the number of the steps of the selector butts preferably is three. However, the present invention is not limited thereto, as long as the response speed of the actuator 50 electronically controlled by a signal input thereto can meet the rotation speed of the needle cylinder 2. That is, the number of the steps may be one or two, or four or more.

The selector butt 32*d* of the low-pile selector jack 31 shown in FIG. 35A and the selector butt 36*a* of the high-pile selector jack 35 shown in FIG. 35D are at the same radial position. When those selector jacks 31 and 35 are regarded as a pair of selector jacks 30, the selector butts 32*d* and 36 are opposed to each other and therefore can be regarded as selector butts as common components. This is the same for the selector butt 32*e* shown in FIG. 35B and the selector butt 36*b* shown in FIG. 35E and for the selector butt 32*f* shown in FIG. 35C and the selector butt 36*c* shown in FIG. 35F. Moreover, the selector butt 32*a* of the low-pile selector jack 31 shown in FIG. 35A has no counterpart portion of the high-pile selector jack 35 shown in FIG. 35D. In other words, no portion of the high-pile selector jack 35 is arranged at the same radial position as the selector butt 32*a* of the low-pile selector jack 31. Therefore, the selector butt 32*a* can be referred to as a single portion.

Figure 36:
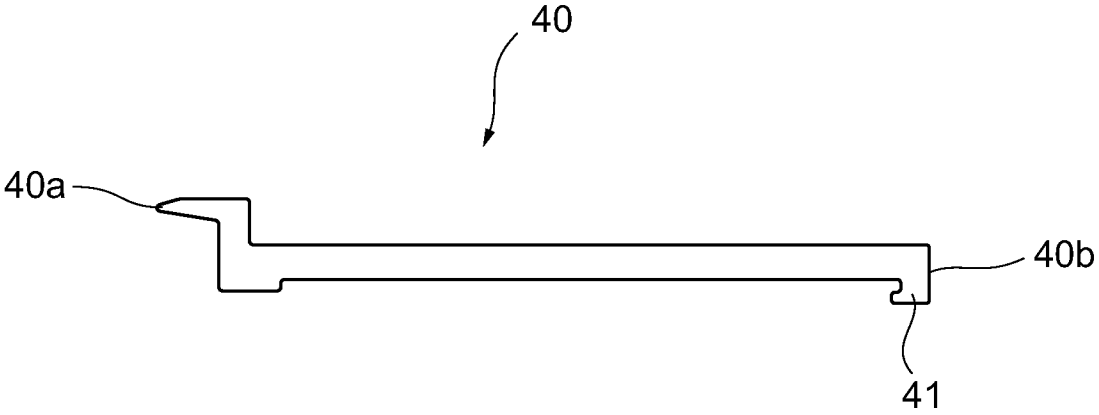
FIG. 36 is a side view of the separator.

Returning to FIG. 34, the separator 40 is arranged to extend between the low-pile sinker 21 and the high-pile sinker 25 and between the low-pile selector jack 31 and the high-pile selector jack 35. FIG. 36 is a side view of the separator 40. The separator 40 includes a leading end portion 40*a* which has a shape corresponding to the shape of a portion of the low-pile sinker 21 and a portion of the high-pile sinker 25, and a fixing butt 41 located on the bottom of a rear end portion 40*b*. The fixing butt 41 is arranged to fix the separator 40 to the horizontal slit 7. The separator 40 preferably is about 0.15 mm to about 0.25 mm in thickness, for example, and includes a steel member to have a plate-shaped configuration. The existence of the separator 40 can prevent the low-pile sinker 21 and the low-pile selector jack 31 from adhering to the high-pile sinker 25 and the high-pile selector jack 35.

Figure 37A:
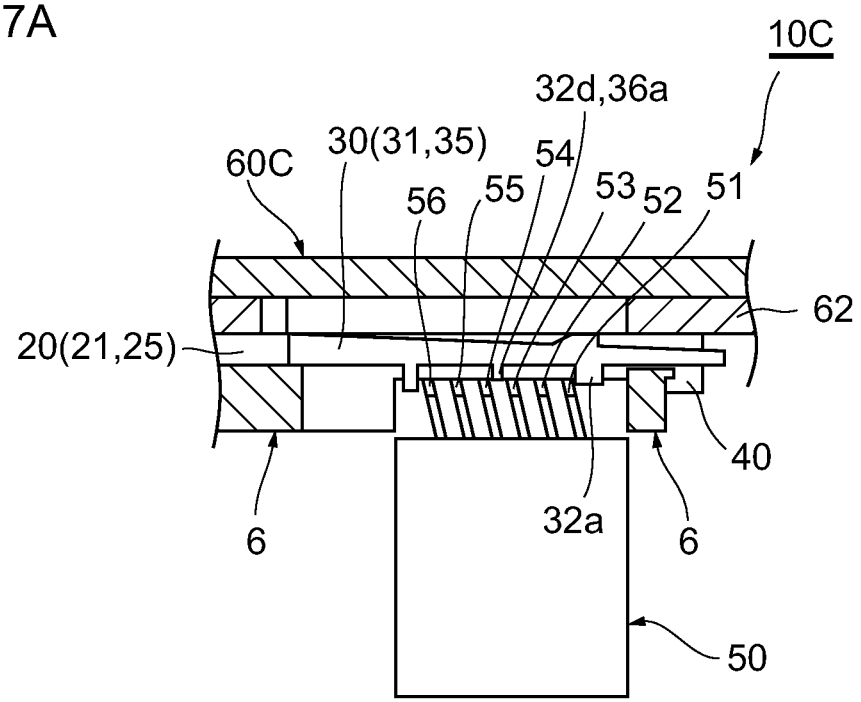
FIGS. 37A and 37B are a cross-sectional view of a portion of a stitch forming device which includes an actuator in the third preferred embodiment of the present invention, and a front view of a head included in the actuator, respectively.

FIG. 37A is a cross-sectional view of a portion of the stitch forming device in which the actuator is arranged, and shows the cross section of that portion when the low-pile selector jack 31 shown in FIG. 35A and the high-pile selector jack 35 shown in FIG. 35D are located above the actuator 50. The actuator 50 is arranged below the sinker bed 6 as shown in FIG. 37A, so that the actuator 50 can selectively act on the selector butts 32 and 36 of a pair of selector jacks 30. The actuator 50 includes heads 51, 52, and 53 provided to correspond to the selector butts 32*a*, 32*b*, and 32*c* (see FIGS. 35A, 35B, and 35C) as single components, respectively, and heads 54, 55, and 56 provided to correspond to the selector butts 32*d* and 36*a*, 32*e* and 36*b*, and 32*c* and 36*c* (see FIGS. 35A to 35F) as common components, respectively.

Figure 37B:
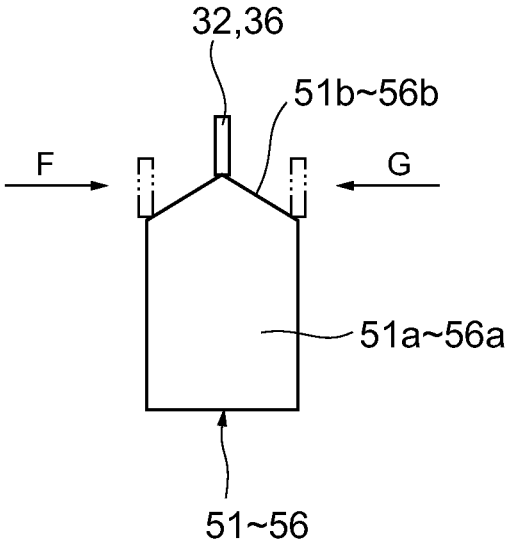

FIG. 37B is a front view of the head of the actuator, when seen from the radially inside. The heads 51 to 56 are substantially the same structure in this example. As shown in FIG. 37B, the head 51 to 56 of the actuator 50 includes a main surface 51*a* to 56*a* arranged to stand perpendicular or substantially perpendicular to the extending direction of the low-pile selector jack 31 and the high-pile selector jack 35 which move in direction F (reverse rotation direction) or direction G (forward rotation direction) during forward rotation or reverse rotation of the cylinder 2. When a top end 51*b* to 56*b* of the head 51 to 56 is brought into contact with the selector butts 32 and 36 of the low-pile selector jack 31 and the high-pile selector jack 35, the top end can act on the selector jacks 31 and 35.

The shape of the top end 51*b* to 56*b* of the plate-shaped head 51 to 56 is symmetrical with respect to the vertical center line of the main surface 51*a* to 56*a* when seen from the radially inside. Thus, both in a case of forward rotation in which the needle cylinder 2 makes a revolution in a counterclockwise direction when seen from above and a case of reverse rotation in which the knitting-needle 2 makes a revolution in a clockwise direction, the actuator 50 can act on the selector butts 32 and 36 in the same way. Consequently, even when the needle cylinder 2 makes a reciprocating rotation in which the needle cylinder 2 alternately repeats forward rotation for one revolution and reverse rotation for one revolution, the same control can be performed as a normal rotational movement.

Figure 38:
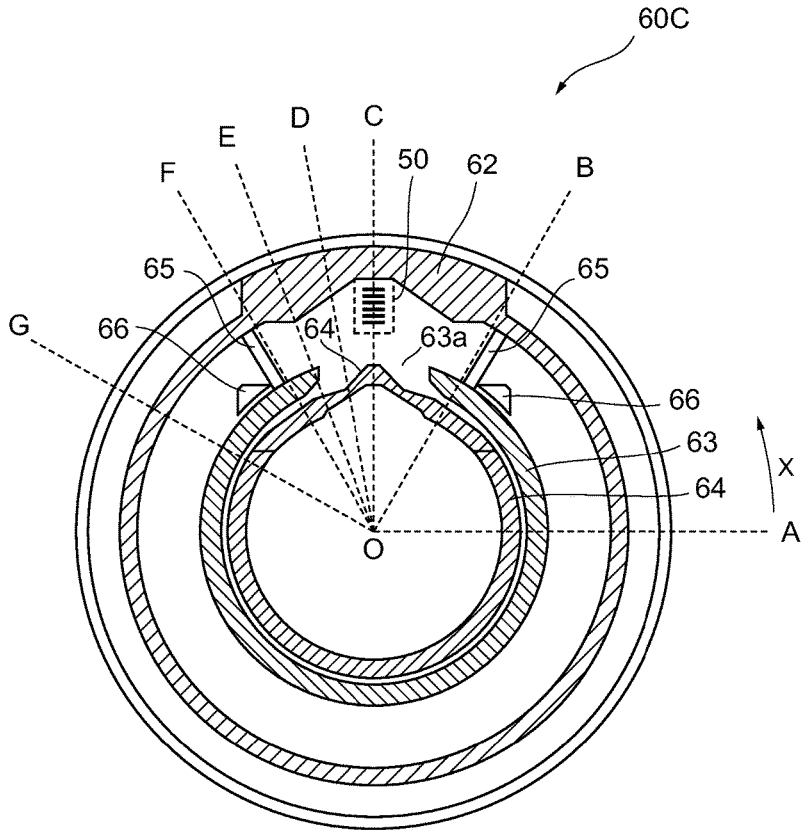
FIG. 38 is a plan view of a sinker cap in the third preferred embodiment of the present invention, showing an arrangement of a group of cams provided in the sinker cap.

FIG. 38 is a plan view of a sinker cap 60C including a group of cams thereon. The disk-shaped sinker cap 60C is arranged above the sinker bed 6 (see FIG. 2) and supported by a stand (not shown) so as not to be rotatable in such a manner that a cam-containing surface of the sinker cap 60C with a group of cams thereon faces down. FIG. 38 shows the sinker cap 60C when seen from above, but shows a group of cams arranged on the bottom side of the sinker cap 60C with solid line. Moreover, the position of the actuator 50 when seen from above is shown with broken line.

Referring to FIG. 38, the group of cams preferably includes at least the first cam 62 arranged at a radially outermost position; the second cam 63 arranged radially inside the first cam 62 and having a ring-like shape with an opening 63*a*; the third cam 64 arranged radially inside the second cam 63 and having an approximately ring-like shape; the fourth cam 65 arranged between the first cam 62 and the second cam 63 in the radial direction near the opening 63*a* of the second cam 63; and the fifth cam 66 arranged between the first cam 62 and the second cam 63 in the radial direction next to the fourth cam 65.

The first cam 62 acts on the outside of the selector bosses 33 and 37 of the low-pile selector jack 31 and the high-pile selector jack 35. The second cam 63 acts on the outside of the butts 24 and 28 of the low-pile sinker 21 and the high-pile sinker 25. The third cam 64 acts on the inside of the butts 24 and 28 of the low-pile sinker 21 and the high-pile sinker 25. The fourth cam 65 acts on the upper portion of the selector bosses 33 and 37 of the low-pile selector jack 31 and the high-pile selector jack 35. The fifth cam 66 acts on the butts 34 and 38 of the low-pile selector jack 31 and the high-pile selector jack 35.

Figure 39:
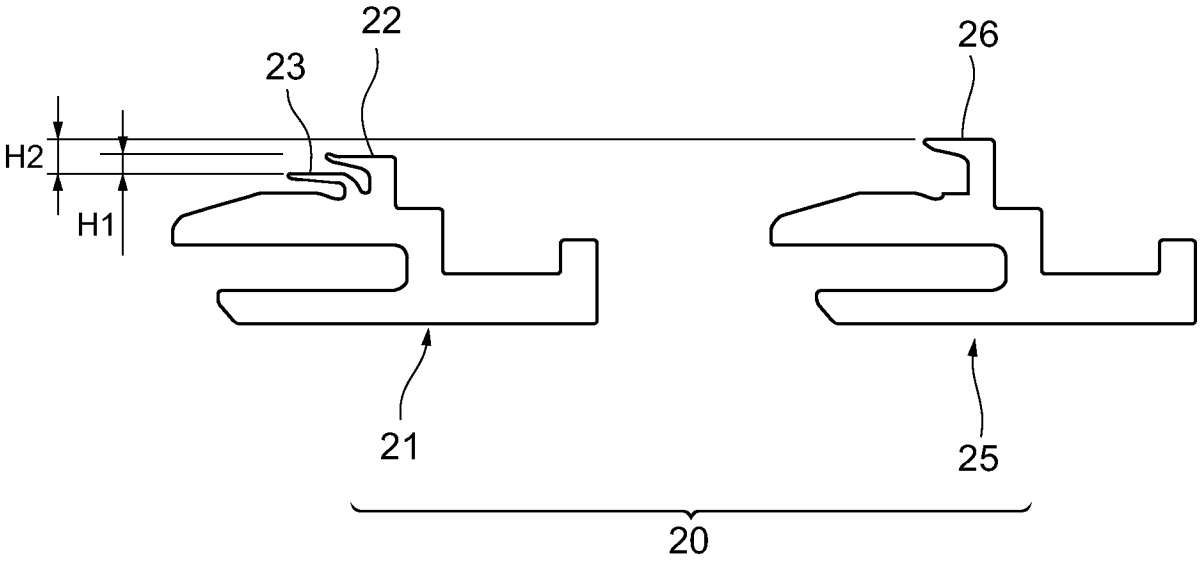
FIG. 39 shows a difference of a nib position between the low-pile sinker and the high-pile sinker in the third preferred embodiment of the present invention.

It is now described how the circular knitting machine 1 of this preferred embodiment can form the plain stitch 110, the low-pile stitch 111, and the high-pile stitch shown in FIG. 32. FIG. 39 illustrates a positional difference between the nibs of the low-pile sinker 21 and the high-pile sinker 25 arranged to be opposed to each other. The low-pile nib 22 and the small nib 23 of the low-pile sinker 21 and the high-pile nib 26 of the high-pile sinker 25 are different in position in the vertical direction, as shown in FIG. 39. More specifically, the distance H2 between the small nib 23 of the low-pile sinker 21 and the high-pile nib 26 of the high-pile sinker 25 is longer than the distance H1 between the small nib 23 and the low-pile nib 22 of the low-pile sinker 21. The circular knitting machine 1C of this preferred embodiment forms different knitting structures by using those distance differences (differences in height). In this preferred embodiment, the distance difference (H2–H1) preferably is about 0.5 mm to about 2.5 mm, for example. This range of the distance difference (H2–H1) can provide stitches of which sizes are apparently different.

Figure 40A:
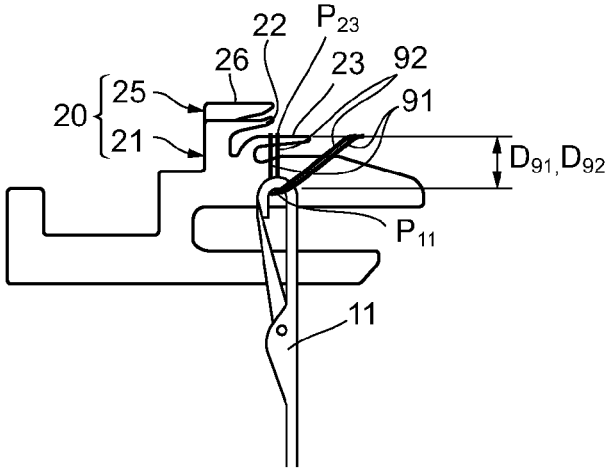
FIGS. 40A, 40B, and 40C show how to hold pile yarn and ground yarn during formation of a plain stitch, a low-pile stitch and a high-pile stitch, respectively.
Figure 40B:
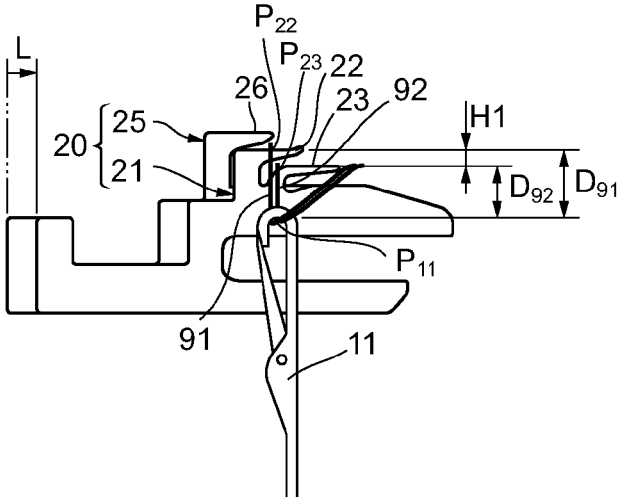
Figure 40C:
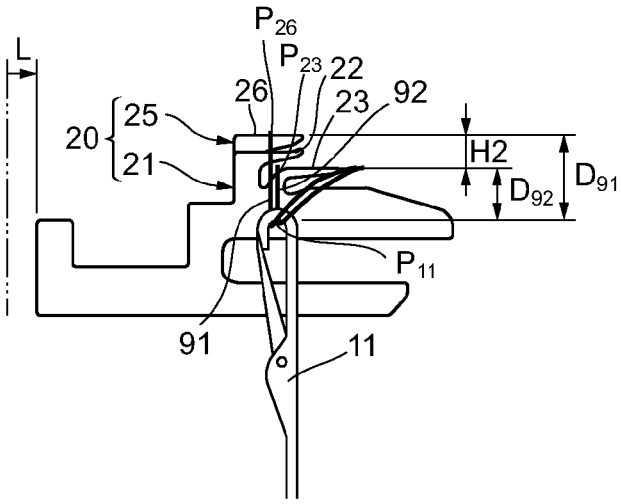

As shown in FIGS. 40A, 40B and 40C, when stitches are formed, the sinker loop length are determined in accordance with distances from contact points $P_{22}$, $P_{23}$, and $P_{26}$ of the pile yarn 91 and the ground yarn 92 with the respective nibs 22, 23, and 26 to a contact point $P_{11}$ of the pile yarn 91 and the ground yarn 92 with the knitting needle 11. More specifically, when the knitting needle 11 draws the pile yarn 91 and the ground yarn 92 into an old loop, the stitch type can be changed depending on which one of the low-pile nib 22, the small nib 23, and the high-pile nib 26 is used to hold the pile yarn 91 and the ground yarn 92. Selection of the nib used to hold the pile yarn 91 and the ground yarn 92 can be realized by selectively moving the low-pile sinker 21 and the high-pile sinker 25 forward, as shown in FIGS. 40A, 40B, and 40C.

As shown in FIG. 40A, in a case where the low-pile sinker 21 and the high-pile sinker 25 are not moved from predetermined positions with respect to the knitting needle 11, that is, the sinkers 21 and 25 are not moved forward, both the pile yarn 91 and the ground yarn 92 are held by the small nib 23 of the low-pile sinker 21. In this state, the distance $D_{91}$ from the contact point $P_{23}$ of the small nib 23 with the pile yarn 91 to the contact point $P_{11}$ of the knitting needle 11 with the pile yarn 91 is substantially equal to the distance $D_{92}$ from the contact point $P_{23}$ of the small nib 23 with the ground yarn 92 to the contact point $P_{11}$ of the knitting needle 11 with the ground yarn 92. Therefore, when the knitting needle 11 draws the pile yarn 91 and the ground yarn 92 into an old loop in the state of FIG. 40A, a plain stitch 110 in which the sinker loop length of the pile yarn 91 and that of the ground yarn 92 are the same is formed.

As shown in FIG. 40B, in a case where only the low-pile sinker 21 is moved from the predetermined position toward the knitting needle 11 by a distance L, that is, only the low-pile sinker 21 is moved forward, the pile yarn 91 is held by the low-pile nib 22 of the low-pile sinker 21 and the ground yarn 92 is held by the small nib 23 of the low-pile sinker 21. In this state, the distance $D_{91}$ from the contact point $P_{22}$ of the low-pile nib 22 with the pile yarn 91 to the contact point $P_{11}$ of the knitting needle 11 with the pile yarn 91 is different from the distance $D_{92}$ from the contact point $P_{23}$ of the small nib 23 with the ground yarn 92 to the contact point $P_{11}$ of the knitting needle 11 with the ground yarn 92 by a distance H1. Therefore, when the knitting needle 11 draws the pile yarn 91 and the ground yarn 92 into an old loop in the state of FIG. 40B, a low-pile stitch 111 in which the sinker loop length of the pile yarn 91 is longer than that of the ground yarn 92 is formed. The difference of the sinker loop length is substantially twice the distance H1.

As shown in FIG. 40C, in a case where both the low-pile sinker 21 and the high-pile sinker 25 are moved from the predetermined positions toward the knitting needle 11 by the distance L, that is, both the sinkers 21 and 25 are moved forward, the pile yarn 91 is held by the high-pile nib 26 of the high-pile sinker 25 and the ground yarn 92 is held by the small nib 23 of the low-pile sinker 21. In this state, the distance $D_{91}$ from the contact point $P_{26}$ of the high-pile nib 26 with the pile yarn 91 to the contact point $P_{11}$ of the knitting needle 11 with the pile yarn 91 is different from the distance $D_{92}$ from the contact point $P_{23}$ of the small nib 23 with the ground yarn 92 to the contact point $P_{11}$ of the knitting needle 11 with the ground yarn 92 by a distance H2. Please note that the distance H2 is longer than the distance H1. Therefore, when the knitting needle 11 draws the pile yarn 91 and the ground yarn 92 into an old loop in the state of FIG. 40C, a high-pile stitch 112 in which the sinker loop length of the pile yarn 91 is longer than that of the ground yarn 92 is formed. The difference of the sinker loop length is substantially twice the distance H2.

Operations of the circular knitting machine 1C of this preferred embodiment are now described, referring to FIGS. 41A to 48B. FIGS. 41A to 48B show a cross section of a portion of the stitch forming device 10C in which a pair of sinkers 20, a pair of selector jacks 30 and the separator 40 are arranged. In the description set forth below, the sinkers 20 (i.e., the low-pile sinker 21 and the high-pile sinker 25), the selector jacks 30 (i.e., the low-pile selector jack 31 and the high-pile selector jack 35), and the separator 40 are collectively referred to as a sinker unit 8.

The sinker unit 8 rotates together with the sinker bed 6. The sinker bed 6 is arranged to be opposed to the cam-containing surface 61 of the sinker cap 60C. Thus, the sinker unit 8 moves from a rotational position A to a rotational position G (see FIG. 38). The sinker unit 8 accommodated in the first horizontal slit 701 of the sinker bed 6 is described here as an example.

Figure 41A:
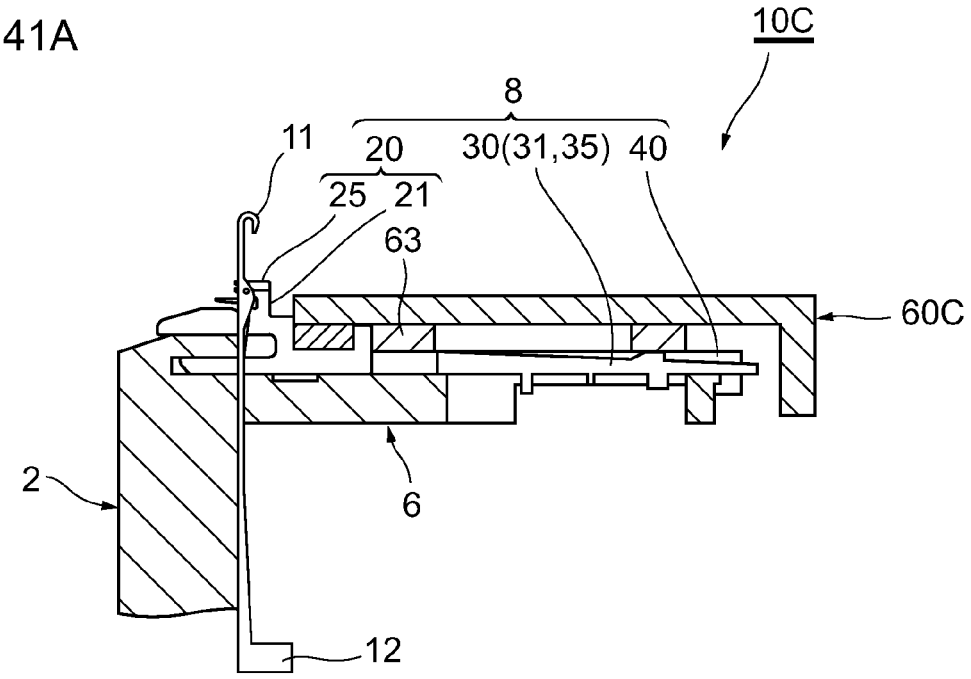
FIGS. 41A and 41B are cross-sectional views of the stitch forming device and the sinker cap, taken along a line O-A and a line O-B in FIG. 38, respectively.
Figure 41B:
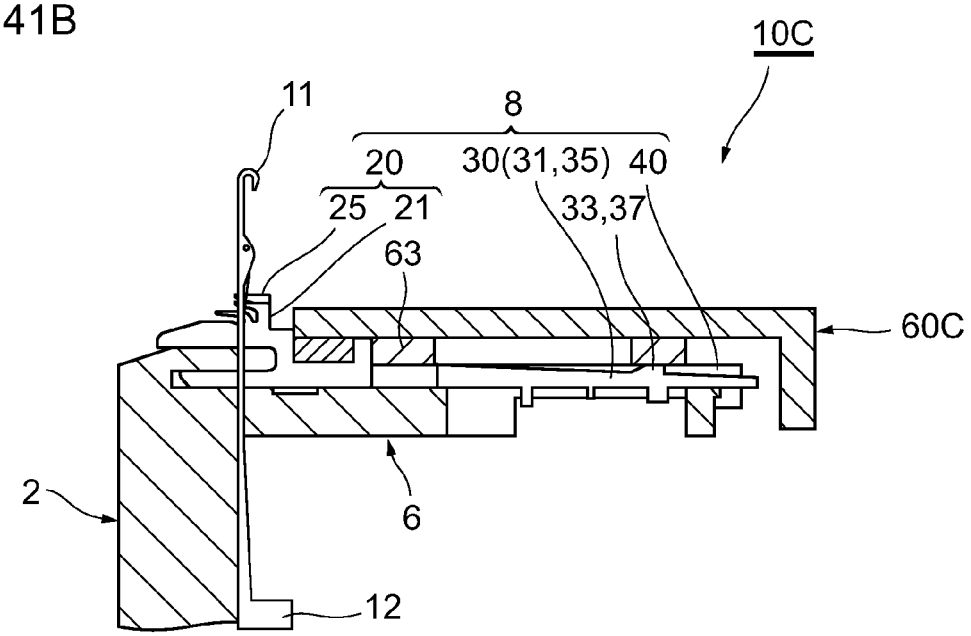

An operation for forming a low-pile stitch 111 is now described with reference to FIGS. 41A and 41B. This operation is also referred to as the first stitch forming control. FIGS. 41A and 41B show states where the sinker unit 8 is located at the rotational positions A and B, i.e., on the line O-A and line O-B, respectively.

At the rotational position A, the sinkers 20 are spaced away from the selector jacks 30 in the radial direction. The sinker unit 8 is moved from the rotational position A to the rotational position B as the needle cylinder 2 rotates in the direction X. In this state, a needle butt 12 that preferably is integrally formed with a knitting needle 11 is subjected to the action of a stitch cam 80 (see FIG. 2), such that the knitting needle 11 moves upward. Thus, pile yarn 91 and the ground yarn 92 for forming a new loop (both not shown) are held by the knitting needle 11. Then, when the sinker unit 8 has reached the rotational position B, the knitting-needle butt 12 is subjected to the action of the stitch cam 80 (see FIG. 2) and therefore the knitting needle 11 holding the pile yarn 91 and the ground yarn 92 begins to move down.

At the rotational position B, the sinkers 20 are spaced away from the selector jacks 30 and the selector bosses 33 and 37 of the low-pile selector jack 31 and the high-pile selector jack 35 are located below the first cam 62. Therefore, at this time, the first cam 62 does not act on the selector bosses 33 and 37 in this state.

Figure 42A:
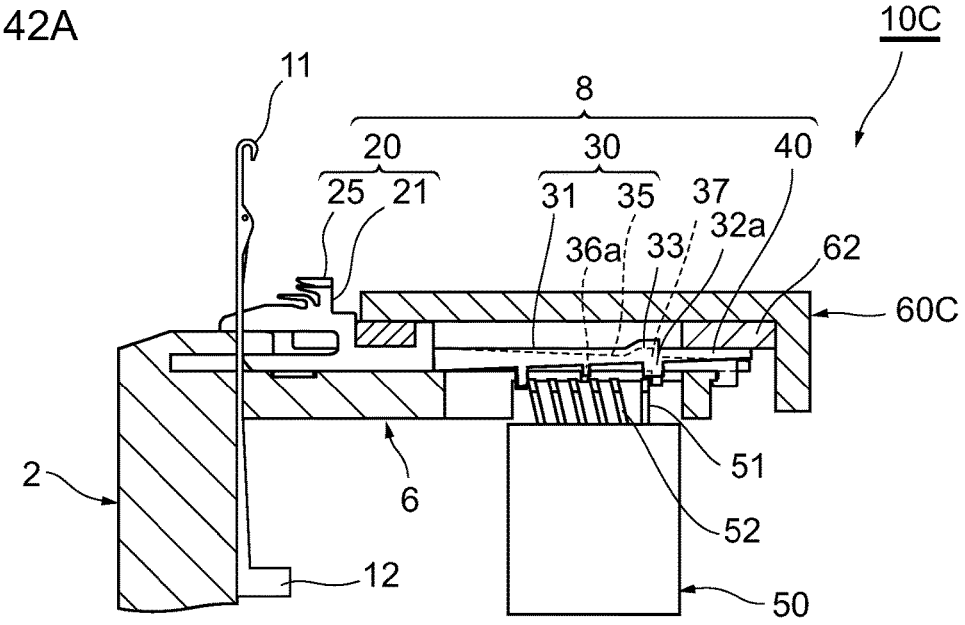
FIGS. 42A and 42B are cross-sectional views of the stitch forming device and the sinker cap, taken along a line O-C and a line O-D in FIG. 38, respectively.

FIG. 42A shows a state where the sinker unit 8 is located at the rotational position C, i.e., on the line O-C. The sinker unit 8 moves closer to the rotational position C as the needle cylinder 2 rotates. At the same time, the inside of the butts 24 and 28 of the low-pile sinker 21 and the high-pile sinker 25 are subjected to the action of the third cam 64 and are pushed to the radially outside. Also, if a signal from a selection signal output device which is not shown is input to the actuator 50, the head 51 provided to be swingable changes from an inclined state to a standing state. FIG. 42A shows that the head 51 is in the standing state and the head 52 arranged on left of the head 51 is in the inclined state.

When the sinker unit 8 has reached the rotational position C, the selector butt 32*a* of the low-pile selector jack 31 is subjected to the action of the head 51 in the standing state (first step). That low-pile selector jack 31 is therefore lifted upward. On the other hand, the high-pile selector jack 35 has no selector butt at a position to be subjected by the standing head 51. That is, the selector butt 36*a* is not located at the position to be subjected to the action of the standing head 51. Therefore, the high-pile selector jack 35 is not subjected to the action of the head 51. In this state, the first cam 62 is located outside the selector bosses 33 and 37 of the low-pile selector jack 31 and the high-pile selector jack 35.

Figure 42B:
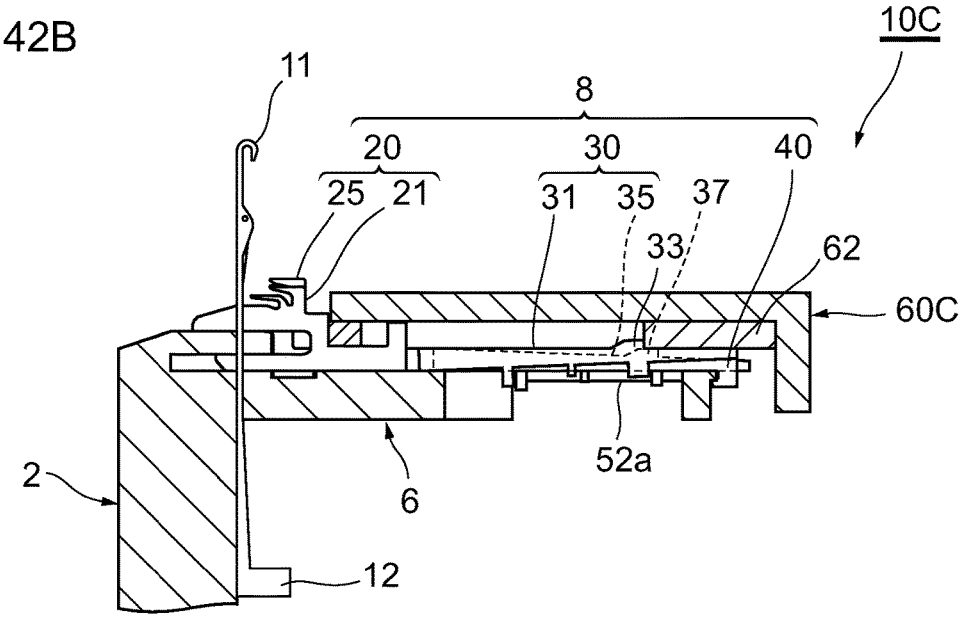

FIG. 42B shows a state where the sinker unit 8 is located at the rotational position D, i.e., on the line O-D. When the sinker unit 8 has reached the rotational position D, the first cam 62 engages with the outside of the selector boss 33 of the low-pile selector jack 31 lifted as described above and radially inwardly acts thereon (second step). Thus, the low-pile selector jack 31 is pushed out radially inwardly. On the other hand, the high-pile selector jack 35 is not lifted upward by the head 51 of the actuator 50. Thus, the outside of the selector boss 37 of the high-pile selector jack 35 does not engage with the first cam 62 nor is it subjected to the radially inward action. Therefore, the low-pile selector jack 31 is located radially inside with respect to the high-pile selector jack 35, that is, the low-pile selector jack 31 is moved forward.

Figure 43A:
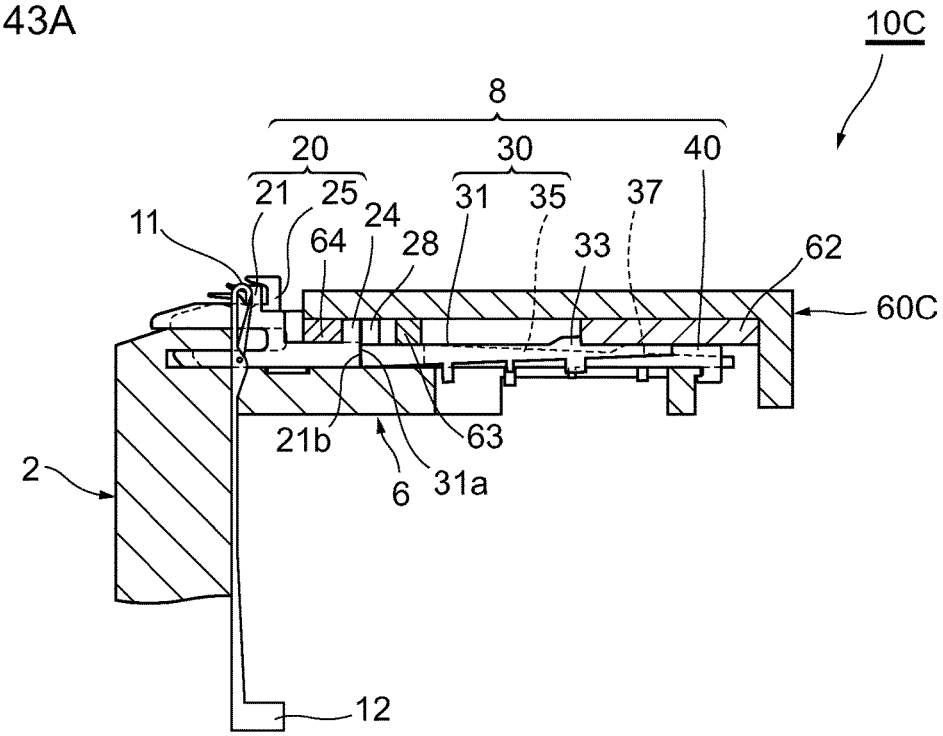
FIGS. 43A and 43B are cross-sectional views of the stitch forming device and the sinker cap, taken along a line O-E and a line O-F in FIG. 38, respectively.

FIG. 43A shows a state where the sinker unit 8 is located at the rotational position E, i.e., on the line O-E. When the sinker unit 8 has reached the rotational position E, the action of the first cam 62 on the selector boss 33 causes the leading end 31*a* of the low-pile selector jack 31 pushed radially inwardly as described above to come into contact with the rear end 21*b* of the low-pile sinker 21. Due to this contact, the low-pile sinker 21 is pushed radially inwardly. On the other hand, the high-pile sinker 25 is not pushed radially inwardly by the high-pile selector jack 35 and therefore remains unchanged. Consequently, the low-pile sinker 21 is located radially inside the high-pile sinker 25, that is, the low-pile sinker 21 is moved forward, as shown in FIG. 43A.

Figure 43B:
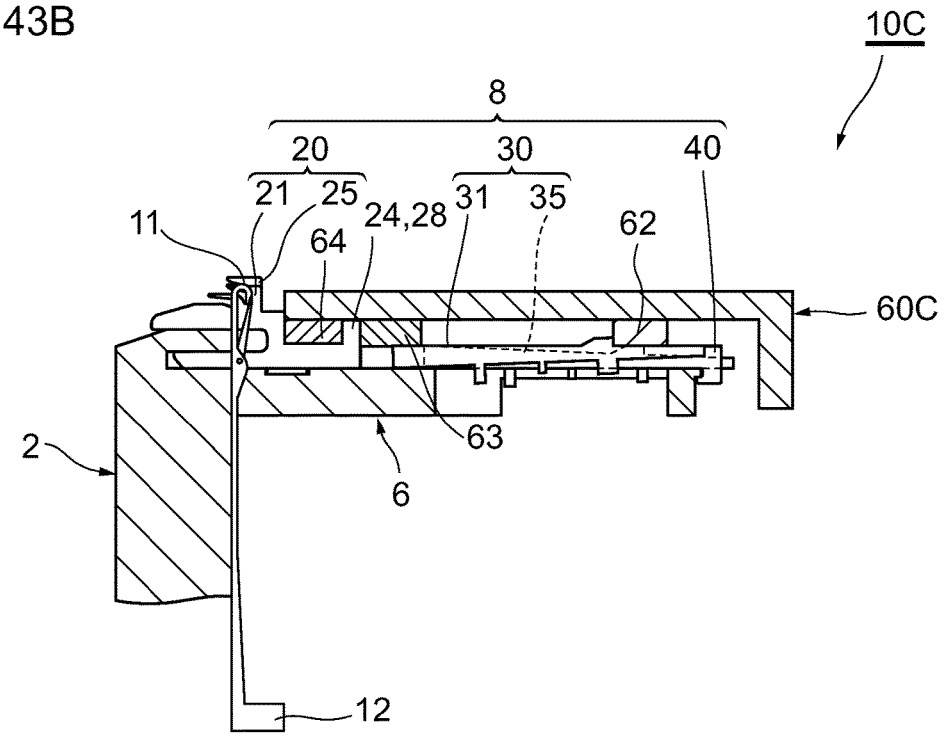

FIG. 43B shows a state where the sinker unit 8 is located at the rotational position F, i.e., on the line O-F. During a process in which the sinker unit 8 moves from the rotational position D to the rotational position E, the knitting needle 11 moves down due to the action of the stitch cam 80 (see FIG. 2) at the same time as the aforementioned operation of the low-pile sinker 21. At this time, the low-pile sinker 21 is located at a radially inside position than the high-pile sinker 25. Thus, as shown in FIG. 40B, the pile yarn 91 is held by the low-pile nib 22 of the low-pile sinker 21 and the ground yarn 92 is held by the small nib 23. Then, during a process in which the sinker unit 8 moves from the rotational position E to the rotational position F, the knitting needle 11 is further moved down. Thus, while the pile yarn 91 is held by the low-pile nib 22 of the low-pile sinker 21 and the ground yarn 92 is held by the small nib 23, they are drawn into an old loop of the pile yarn 91 and the ground yarn 92 to form a low-pile stitch 111.

During the process in which the sinker unit 8 moves from the rotational position E to the rotational position F, the butt 28 of the high-pile sinker 25 is subjected to the action of the second cam 63 from the outside. Thus, the high-pile sinker 25 is pushed out to the radially inside. Consequently, the radial position of the low-pile sinker 21 and that of the high-pile sinker 25 become substantially the same, as shown in FIG. 43B.

Figure 44:
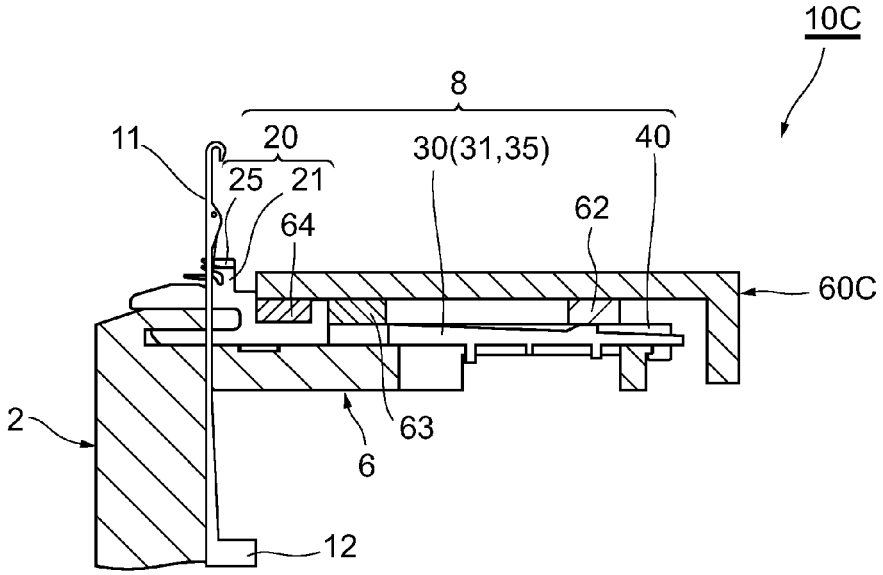
FIG. 44 is a cross-sectional view of the stitch forming device and the sinker cap, taken along a line O-G in FIG. 38.

FIG. 44 shows a state where the sinker unit 8 is located at the rotational position G, i.e., on the line O-G. During a process in which the sinker unit 8 moves from the rotational position F to the rotational position G, the selector boss 33 is subjected to the action of the fourth cam 65 (see FIG. 38), so as to cause the low-pile selector jack 31 to be pushed downward. Also, because the butt 34 is subjected to the action of the fifth cam 66 (see FIG. 38), the low-pile selector jack 31 is pushed radially outward.

An operation for forming the low-pile stitch 111 in association with reverse rotation (i.e., rotation in the opposite direction to the direction X in FIG. 38) of the needle cylinder 2 is substantially the same as the aforementioned operation for forward rotation. That is, the steps described above for forward rotation are performed during reverse rotation of the needle cylinder 2.

An operation for forming a high-pile stitch 112 is now described. This operation is also referred to as the second stitch-forming control. The states of the sinker unit 8 at the rotational positions A and B are substantially the same as those in the operation for forming the low-pile stitch 111, and therefore the detailed description is omitted.

Figure 45A:
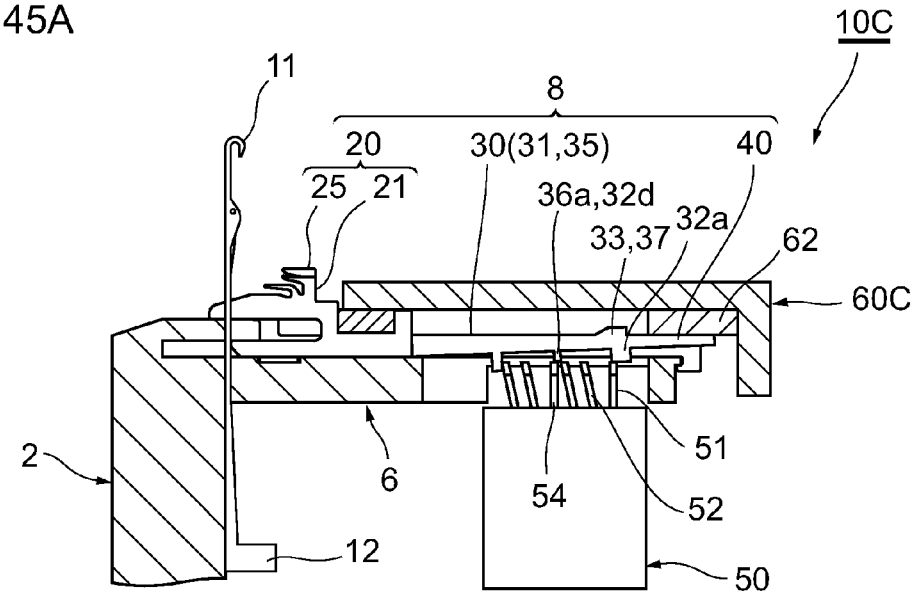
FIGS. 45A and 45B are cross-sectional views of the stitch forming device and the sinker cap, taken along the line O-C and the line O-D in FIG. 38, respectively.

FIG. 45A shows a state where the sinker unit 8 is located at the rotational position C. The sinker unit 8 gets closer to the rotational position C as the needle cylinder 2 rotates. During this, the inside of the butts 24 and 28 of the low-pile sinker 21 and the high-pile sinker 25 are subjected to the action of the third cam 64, so that the sinkers 21 and 25 are pushed radially outward. Also, during this operation, when t a signal corresponding to formation of a high-pile stitch is input to the actuator 50 from the selection signal output device which is not shown, the heads 51 and 54 provided to be swingable change from the inclined state to the standing state.

When the sinker unit 8 has reached the rotational position C, the selector butt 32*a* of the low-pile selector jack 31 is subjected to the action of the head 51 which is in the standing state (first step). Thus, the low-pile selector jack 31 is lifted upward. At the same time, the selector butt 36*a* of the high-pile selector jack 35 is subjected to the action of the standing head 54. Thus, the high-pile selector jack 35 is also lifted upward.

It should be noted that when the head 54 acts on the selector butt 36*a* of the high-pile selector jack 35, it also acts on the selector butt 32*d* of the low-pile selector jack 31 which is arranged at substantially the same radial position as the selector butt 36*a* to be opposed to the selector butt 36*a*. That is, the head 54 acts on the selector butts 36*a* and 32*d* serving as common components simultaneously. In this state, the first cam 62 is located outside of the selector bosses 33 and 37 of the low-pile selector jack 31 and the high-pile selector jack 35.

Figure 45B:
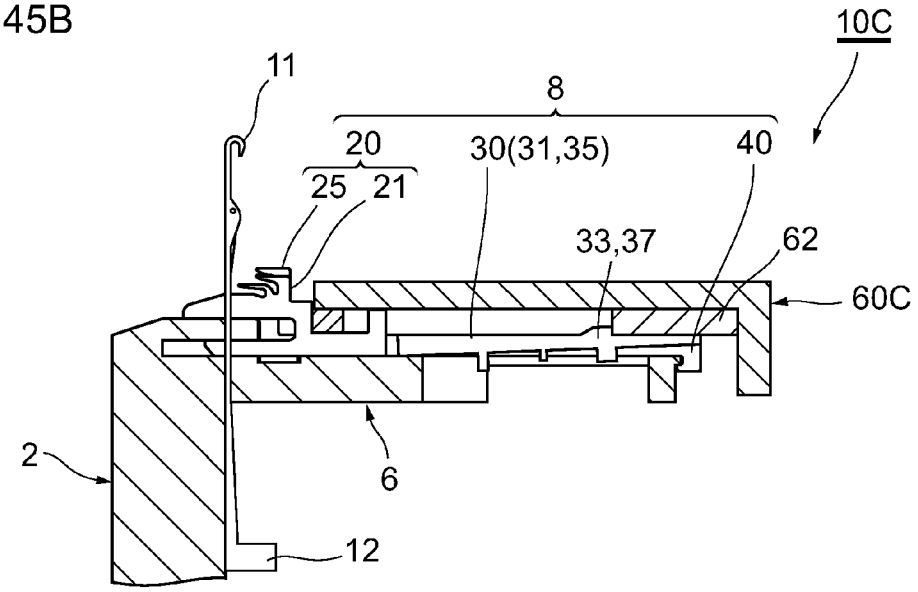

FIG. 45B shows a state where the sinker unit 8 is located at the rotational position D. When the sinker unit 8 has reached the rotational position D, the first cam 62 engages with the outside of the selector bosses 33 and 37 of the selector jacks 31 and 35 lifted upward and acts thereon radially inwardly (second step). Thus, the low-pile selector jack 31 and the high-pile selector jack 35 are pushed radially inward. That is, both the low-pile selector jack 31 and the high-pile selector jack 35 are moved forward.

Figure 46A:
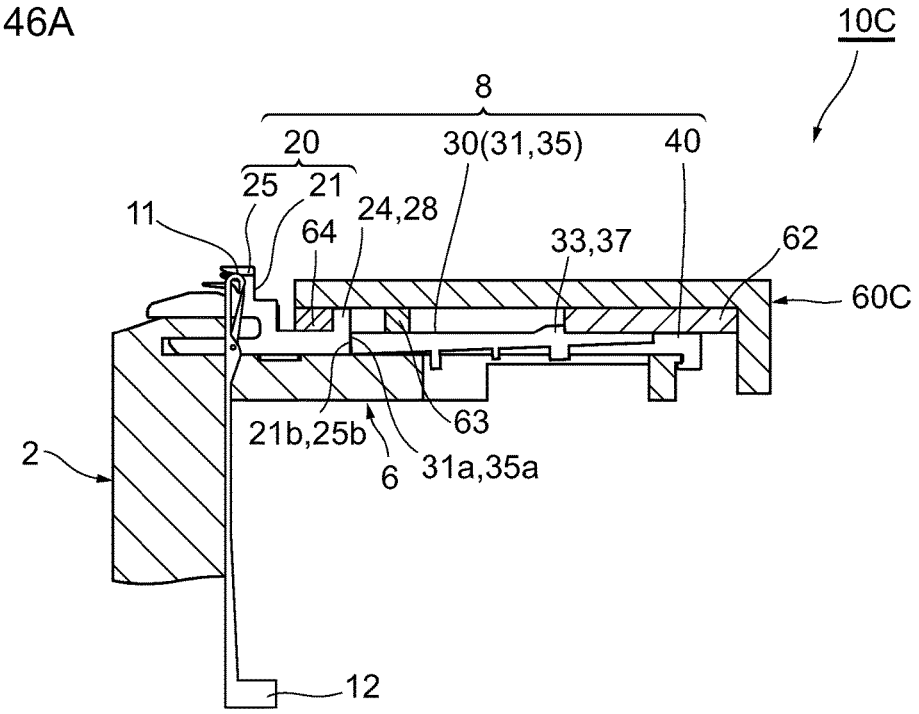
FIGS. 46A and 46B are cross-sectional views of the stitch forming device and the sinker cap, taken along the line O-E and the line O-F in FIG. 38, respectively.

FIG. 46A shows a state where the sinker unit 8 is located at the rotational position E. When the sinker unit 8 has reached the rotational position E, the action of the first cam 62 on the selector bosses 33 and 37 causes the leading ends 31*a* and 35*a* of the selector jacks 31 and 35 pushed radially inward to come into contact with the leading ends 21*b* and 25*b* of the pile sinkers 21 and 25, so as to push the pile sinkers 21 and 25 radially inward, respectively. Thus, as shown in FIG. 46A, both the low-pile sinker 21 and the high-pile sinker 25 are moved forward.

During a process in which the sinker unit 8 moves from the rotational position D to the rotational position E, the knitting needle 11 moves down because of the action of the stitch cam 80 (see FIG. 2) at the same time as the aforementioned movements of the pile sinkers 21 and 25. At this time, both the pile sinkers 21 and 25 have already moved forward. Therefore, as shown in FIG. 40C, the pile yarn 91 is held by the high-pile nib 26 of the high-pile sinker 25 while the ground yarn 92 holds the small nib 23. Then, while the sinker unit 8 moves from the rotational position E to the rotational position F, the knitting needle 11 is further moved down. Thus, while the pile yarn 91 is held by the high-pile nib 26 of the high-pile sinker 25 and the ground yarn 92 is held by the small nib 23, they are drawn into an old loop of the pile yarn 91 and the ground yarn 92 to form a high-pile loop 112.

Figure 46B:
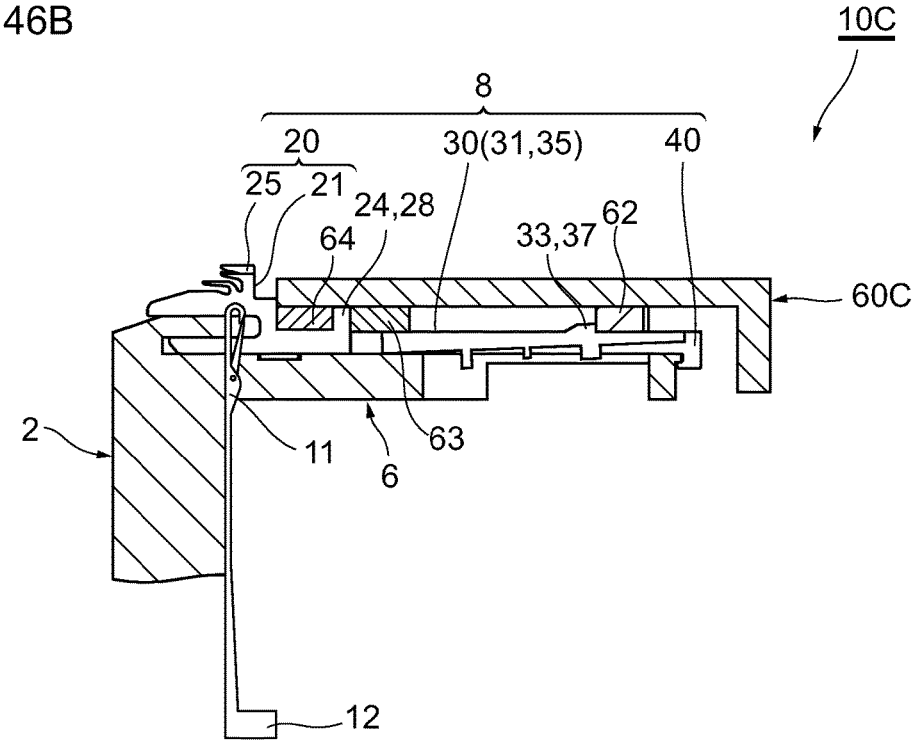

FIG. 46B shows a state where the sinker unit 8 is located at the rotational position F. During a process in which the sinker unit 8 moves from the rotational position E to the rotational position F, the low-pile sinker 21 and the high-pile sinker 25 are pushed radially outward because the butts 24 and 28 of the sinkers 21 and 25 are subjected to the action of the third cam 64 from the inside. The subsequent process in which the sinker unit 8 moves from the rotational position F to the rotational position G is substantially the same as that described for the operation for forming the low-pile stitch 111 and therefore the detailed description thereof is omitted.

An operation for forming the high-pile stitch 112 in association with reverse rotation of the needle cylinder 2 (i.e., rotation in the opposite direction to the direction X in FIG. 38) is substantially the same as the above. That is, substantially the same steps as those described for forward rotation of the needle cylinder 2 are performed during reverse rotation.

An operation for forming a plain stitch 110 is now described. This operation is also referred to as the third stitch-forming control. The states of the sinker unit 8 at the rotational positions A and B are substantially the same as those in the operation for forming the low-pile stitch 111, and therefore the detailed description is omitted.

Figure 47A:
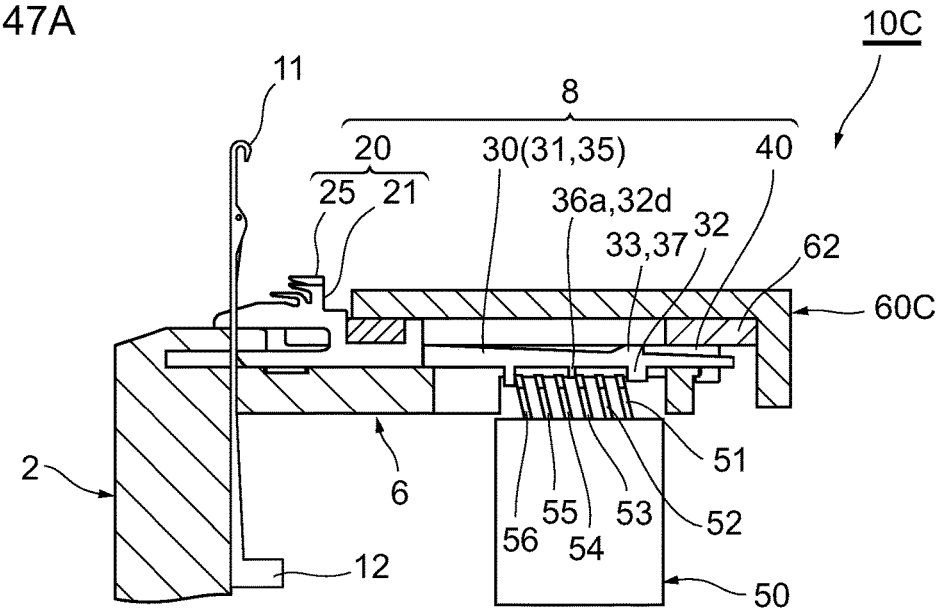
FIGS. 47A and 47B are cross-sectional views of the stitch forming device and the sinker cap, taken along the line O-C and the line O-D in FIG. 38, respectively.

FIG. 47A shows a state where the sinker unit 8 is located at the rotational position C. The sinker unit 8 gets closer to the rotational position C as the needle cylinder 2 rotates. During this operation, the inside of the butts 24 and 28 of the low-pile sinker 21 and the high-pile sinker 25 are subjected to the action of the third cam 64, so that the sinkers 21 and 25 are pushed radially outward. Also, during this, if the actuator 50 does not receive a signal input from the selection signal output device which is not shown, the heads 51 to 56 provided to be swingable remain inclined.

Even when the sinker unit 8 has reached the rotational position C, the selector butts 32*a*, 36*a*, and 32*d* of the selector jacks 31 and 35 are not subjected to any action (first step). At this time, the first cam 62 is located outside the selector bosses 33 and 37 of the selector jacks 31 and 35.

Figure 47B:
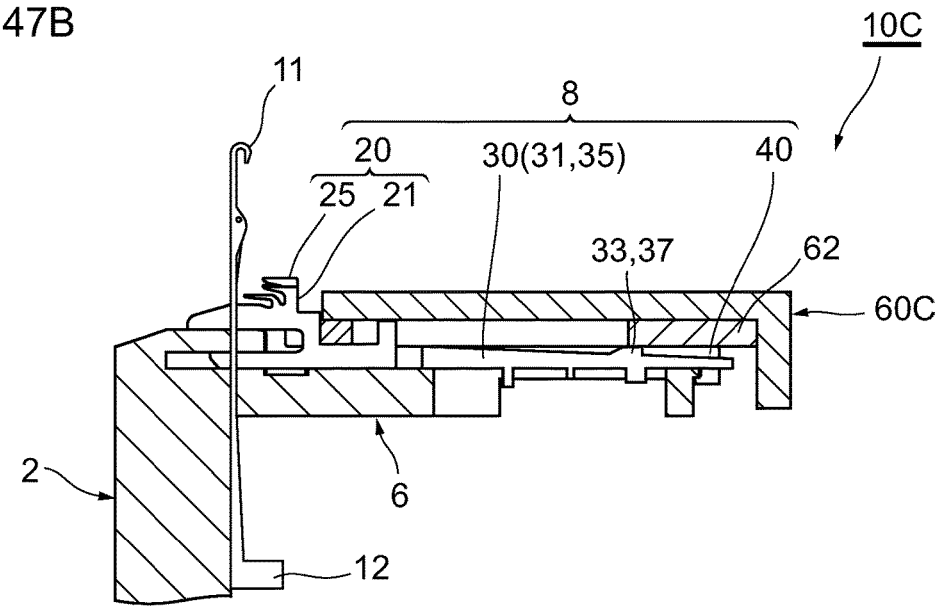

FIG. 47B shows a state where the sinker unit 8 is located at the rotational position D. Even when the sinker unit 8 has reached the rotational position D, the first cam 62 does not engage with the outside of the selector bosses 33 and 37 of the selector jacks 31 and 35, nor do acts thereon radially inwardly (second step). Thus, both the low-pile selector jack 31 and the high-pile selector jack 35 are kept in their original states.

Figure 48A:
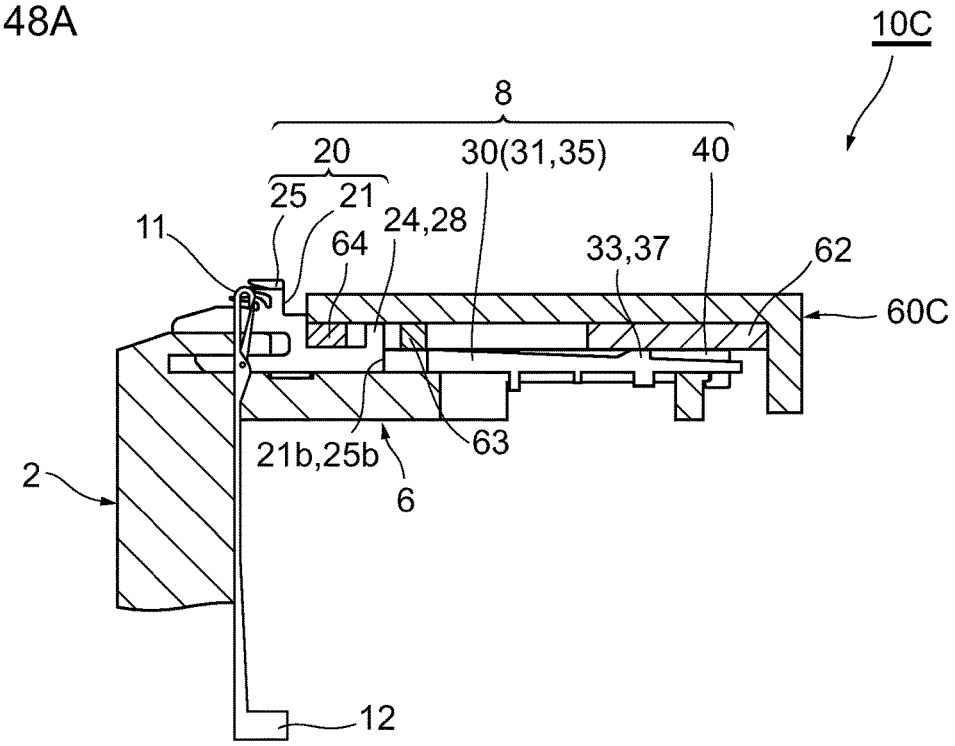
FIGS. 48A and 48B are cross-sectional views of the stitch forming device and the sinker cap, taken along the line O-E and the line O-F in FIG. 38, respectively.

FIG. 48A shows a state where the sinker unit 8 is located at the rotational position E. Even when the sinker unit 8 has reached the rotational position E, the first cam 62 does not engage with the selector bosses 33 and 37. Also, the selector jacks 31 and 35 are not pushed radially inward. Therefore, the leading ends 21*b* and 25*b* of the pile sinkers 21 and 25 are not subjected to any action. Thus, as shown in FIG. 48A, both the low-pile sinker 21 and the high-pile sinker 25 are kept in their original states.

During a process in which the sinker unit 8 moves from the rotational position D to the rotational position E, the knitting needle 11 moves down because of the action of the stitch cam 80 (see FIG. 2) at the same time as the aforementioned operations of the pile sinkers 21 and 25. At this time, both the pile sinkers 21 and 25 are kept in their original states. Therefore, as shown in FIG. 40A, both the pile yarn 91 and the ground yarn 92 are held by the small nib 23 of the low-pile sinker 21.

Figure 48B:
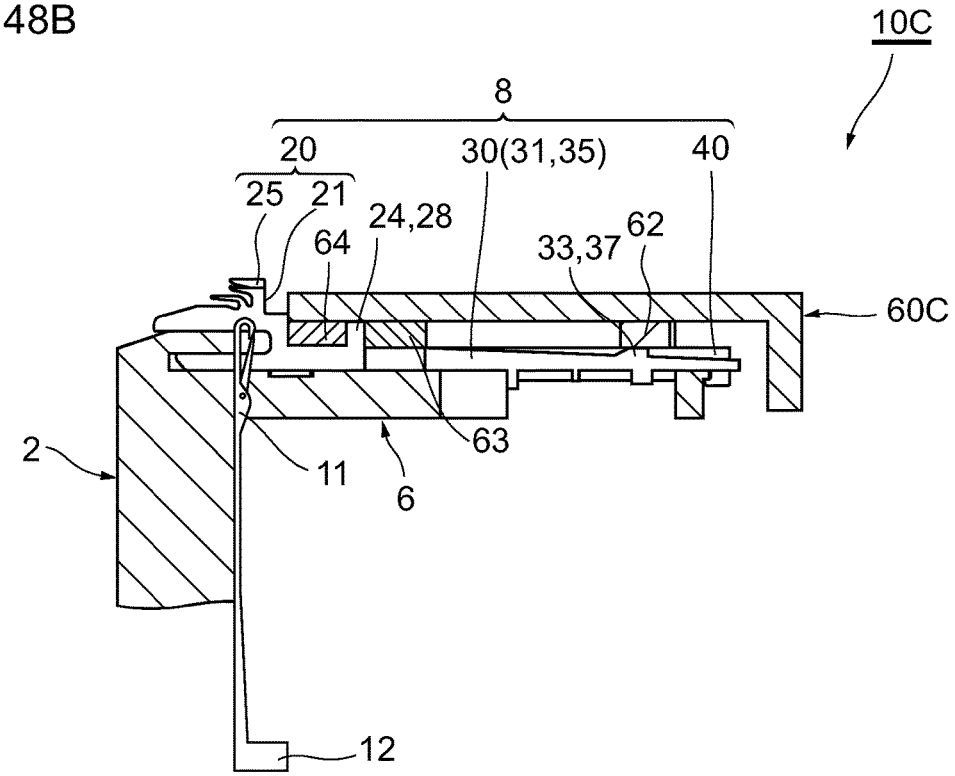

FIG. 48B shows a state where the sinker unit 8 is located at the rotational position F. During a process in which the sinker unit 8 moves from the rotational position E to the position F, the knitting needle 11 is moved down further by the action of the stitch cam 80. Thus, while the pile yarn 91 and the ground yarn 92 are held by the small nib 23, they are drawn into an old loop of the pile yarn 91 and the ground yarn 92 to form a plain stitch 110.

During a process in which the sinker unit 8 moves from the rotational position E to the rotational position F, the insides of the butts 24 and 28 of the sinkers 21 and 25 are spaced away from the leading end of the third cam 64 and therefore the sinker unit 8 is not subjected to any action of the third cam 64. The subsequent process in which the sinker unit 8 moves from the rotational position F to the position G is substantially the same as that described in the operation for forming the low-pile stitch 111 and therefore the detailed description thereof is omitted.

An operation for forming the plain stitch 110 in association with reverse rotation of the needle cylinder 2 (i.e., rotation in the opposite direction to the direction X in FIG. 38) is substantially the same as the above operation for forming the plain stitch 110 during forward rotation. That is, substantially the same steps as those for during forward rotation of the needle cylinder 2 are performed during reverse rotation.

The aforementioned series of operations for forming the low-pile stitch 111, the high-pile stitch 112, and the plain stitch 110 are realized by the actuator 50. Therefore, the aforementioned three types of stitch-forming control can be selectively performed on a stitch-by-stitch basis (needle-by-needle basis).

Next, advantageous effects of the circular knitting machine 1C of the third preferred embodiment are described. According to the arrangement of the circular knitting machine 1C of the third preferred embodiment, the difference in the knitting structures, i.e., the sinker-loop length corresponds to the difference from "the contact points of the pile yarn 91 and the ground yarn 92 with the low-pile sinker 21 and the high-pile sinker 25" to "the contact point of the pile yarn 91 and the ground yarn 92 with the knitting needle 11". Therefore, when the contact points of the pile yarn 91 and the ground yarn 92 with the sinkers 21 and 25, i.e., the positions on the pile sinkers 21 and 25 at which the pile yarn 91 and the ground yarn 92 are held are selected by moving the sinkers 21 and 25 forward and backward, the different knitting structures (the low-pile stitch 111, the high-pile stitch 112, and the plain stitch 110) can be formed. The low-pile stitch forming control in which the low-pile sinker 21 is moved forward, the high-pile stitch forming control in which the high-pile sinker 25 is moved forward, and the plain stitch forming control in which both the low-pile sinker 21 and the high-pile sinker 25 are moved forward can be selectively performed by the actuator 50. Therefore, knitted fabric in which the different knitting structures are arranged on a stitch-by-stitch basis can be formed.

Moreover, according to the circular knitting machine 1C of the third preferred embodiment, the selector butts 32*a* to 32*f* and 36*a* to 36*c* which are to be subjected to the action of the actuator 50 are arranged in the radial direction. Thus, even in a case where selector butts for a plurality of steps are provided for improving production efficiency or stabilizing an operation state, the size increase in the vertical direction can be prevented. This also makes it possible to avoid deterioration in workability and operationability.

According to the circular knitting machine 1C of the third preferred embodiment, both while the low pile sinker 21 is moved forward and while the high-pile sinker 25 is moved forward, the rear ends 21*b* and 25*b* thereof are in contact with the leading ends 31*a* and 35*b* of the low-pile selector jack 31 and the high-pile selector jack 35 and the movement of the rear ends 31*b* and 35*b* of the selector jacks 31 and 35 is limited by the first cam 62. Therefore, the low-pile sinker 21 can be surely positioned in the state where it has moved forward. Similarly, the high-pile sinker 25 can be also surely positioned in the state where it has moved forward. As a result, the possibility that any trouble occurs during stitch formation can be significantly reduced, realizing the stable operation of the circular knitting machine 1C.

Furthermore, according to the arrangement of the circular knitting machine 1C of the third preferred embodiment, when the sinkers 20 and the selector jacks 30 are separate components from each other and the selectors 30 are arranged on the rear side of the sinkers 20, it is possible to easily ensure the space for the actuator 50 which is arranged to act on the selector butts 32 in a radially outer portion. In other words, it is easy to arrange the actuator 50 at a more radially outer position.

In the above preferred embodiments, the circular knitting machine 1C can perform both forward rotation and reverse rotation. However, the circular knitting machine can rotate in one direction only.

According to the stitch-size controllable knitting machine of the preferred embodiments of the present invention, it is possible to increase the rotation speed of the cylinder while preventing a failure of selection of the sinker.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A stitch-size controllable knitting machine for forming tubular knitted fabric, the stitch-size controllable knitting machine comprising:

a cylinder arranged to be rotatable around its center axis and accommodating a plurality of knitting needles extending in a vertical direction parallel or substantially parallel to the center axis;

a disk-shaped sinker bed arranged such that a radial direction thereof is perpendicular or substantially perpendicular to the vertical direction;

a plurality of sinkers radially arranged on the sinker bed to be movable radially inwardly and outwardly between the knitting needles, each of the sinkers including a first yarn holding portion arranged to hold knitting yarn when a first stitch is formed and a second yarn holding portion arranged to hold the knitting yarn when a second stitch is formed, the first and second stitches having different knitting structures from each other;

a plurality of selector jacks provided radially outside the sinkers as separate components from the sinkers to respectively correspond to the sinkers, the selector jacks being movable radially inwardly and outwardly and, when moving radially inwardly, moving the corresponding sinkers radially inwardly between the knitting needles;

a selection member arranged to selectively act on the selector jacks in the vertical direction;

an actuator arranged to drive the selection member in accordance with which one of the first stitch and the second stitch is to be formed; and a sinker cap, covering the sinker bed, provided with a group of cams arranged to act on the sinkers and the selector jacks; wherein each of the selector jacks includes a selector butt projecting to one side in the vertical direction and a selector boss projecting to an opposite side in the vertical direction, the selector butt being arranged to be subjected to a vertical action of the selection member, the selector butt of each of the selector jacks being arranged at a different radial position from that of an adjacent one of the selector jacks;

the group of cams includes a cam arranged to act on the sinkers and one other cam arranged to, when the actuator drives the selection member to act on one of the selector jacks, come into contact with the selector butt of the one of the selector jacks to limit vertical movement of the one of the selector jacks and convert the vertical movement thereof into radially inward movement thereof;

when the first stitch is formed, the actuator performs no action on a corresponding one of the selector jacks via the selection member and the cam acts on a corresponding one of the sinkers to move the sinker to a position at which the first yarn holding portion holds knitting yarn;

when the second stitch is formed, the actuator acts on the selector butt of the corresponding one of the selector jacks via the selection member to bring the selector boss of the corresponding one of the selector jacks into contact with the other cam, and to cause the corresponding one of the selector jacks to move radially inwardly to move the corresponding sinker at another position at which the second yarn holding portion holds the knitting yarn;

the plurality of selector jacks include a plurality of groups of selector jacks, and each of the groups of the selector jacks include a first selector butt, a second selector butt located radially inside the first selector butt, a third selector butt located radially inside the second selector butt, a fourth selector butt located radially inside the third selector butt, a fifth selector butt located radially inside the fourth selector butt, and a sixth selector butt located radially inside the fifth selector butt;

the first, second, and third selector butts define first-stitch-forming selector butts, and the fourth, fifth, and sixth selector butts define second-stitch-forming selector butts;

when the first stitch is formed, the actuator acts on the first-stitch-forming selector butt of a corresponding one of the selector jacks via the selection member to lift the one of the selector jacks, and the lifted one of the selector jacks comes into contact with the other cam to move radially inwardly to cause a corresponding one of the sinkers to move to the position at which the first yarn holding portion holds the yarn; and when the second stitch is formed, the actuator acts on the second-stitch-forming selector butt of a corresponding one of the selector jacks via the selection member to lift the one of the selector jacks, and the lifted one of the selector jacks comes into contact with a stepped portion of the other cam to move radially inwardly to cause a corresponding one of the sinkers to move to another position at which the second yarn holding portion holds the yarn.

2. A stitch-size controllable knitting machine according to claim 1, wherein the first and second stitches are different in stitch size by about 0.1 mm to about 2.0 mm.

3. A stitch-size controllable knitting machine according to claim 1, wherein the group of cams is arranged radially outside the cylinder above the sinkers and the selector jacks.

4. A stitch-size controllable knitting machine according to claim 3, wherein the selector butt is arranged to project downward and the selector boss is arranged to project upward.

5. A stitch-size controllable knitting machine according to claim 1, wherein the sinker bed is arranged to perform both forward rotation and reverse rotation, and the selection member includes a first slope arranged to come into contact with the selector butt during the forward rotation and a second slope arranged to come into contact with the selector butt during the reverse rotation.

6. A stitch-size controllable knitting machine according to claim 1, wherein each of the sinkers further includes a third yarn holding portion which is arranged to hold the knitting yarn when a third stitch is formed and is different from the first and second yarn holding portions, the third stitch having a different stitch size from those of the first and second stitches;

the other cam that acts on the selector butt is provided with a stepped portion to change a moving distance of each of the selector jacks between the formation of the second stitch and the formation of the third stitch; and when the third stitch is formed, the actuator acts on a corresponding one of the selector jacks to lift up via the selection member to bring the corresponding selector jack into contact with the other cam, the other cam limits the vertical movement of the corresponding selector jack to move the corresponding selector jack radially inward, and to move a corresponding one of the sinkers to a position at which the third yarn holding portion holds the knitting yarn.

7. A stitch-size controllable knitting machine according to claim 6, wherein the third yarn holding portion is located radially outside the second yarn holding portion.

8. A stitch-size controllable knitting machine according to claim 1, wherein each of the plurality of groups of the selector jacks includes a first selector jack including the first selector butt, a second selector jack including the second selector butt, a third selector jack including the third selector butt, a fourth selector jack including the fourth selector butt, a fifth selector jack including the fifth selector butt, and a sixth selector jack including the sixth selector butt.

9. A stitch-size controllable knitting machine according to claim 1, wherein each of the sinkers further includes a third yarn holding portion which is arranged to hold the knitting yarn when a third stitch is formed and is different from the first and second yarn holding portions, the third stitch having a stitch size between those of the first and second stitches;

each of the selector jacks includes a further selector butt for the third stitch, the further selector butt being shorter than the selector butt for the second stitch;

the other cam is provided with a stepped portion which is arranged to come into contact with the further selector butt and change a moving distance of each of the selector jacks between the formation of the second stitch and the formation of the third stitch; and when the third stitch is formed, the actuator acts on the further selector butt of a corresponding one of the selector jacks via the selection member to lift the corresponding one of the selector jacks to a level which is lower than a level to which the corresponding one of the selector jack is lifted when the second stitch is formed, and to bring the selector boss of the selector jacks into contact with the stepped portion of the other cam and cause the corresponding one of the selector jacks to move radially inwardly, and the moved one of the selector jacks causes a corresponding one of the sinkers to move to a position at which the third yarn holding portion holds the yarn.

* * * * *